US008988726B2

(12) United States Patent
Atsumi

(10) Patent No.: US 8,988,726 B2
(45) Date of Patent: Mar. 24, 2015

(54) IMAGE FORMING APPARATUS CAPABLE OF CORRECTING TRASPORT POSITION DISPLACEMENT OF RECORDING SHEET

(75) Inventor: Hidetoshi Atsumi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 675 days.

(21) Appl. No.: 13/310,285

(22) Filed: Dec. 2, 2011

(65) Prior Publication Data

US 2012/0141179 A1 Jun. 7, 2012

(30) Foreign Application Priority Data

Dec. 3, 2010 (JP) ..... 2010-270413

(51) Int. Cl.
*G03G 15/00* (2006.01)
*G03G 15/23* (2006.01)

(52) U.S. Cl.
CPC ..... *G03G 15/6567* (2013.01); *G03G 15/235* (2013.01); *G03G 15/6564* (2013.01)
USPC ..... 358/1.18; 358/488; 399/381

(58) Field of Classification Search
CPC ..... G03G 15/65; G03G 15/6555; G03G 15/6558; G03G 15/6561; G03G 15/656; G03G 2215/005617; G03G 2215/00949; H04N 1/00082; H04N 1/0057; H04N 1/123; H04N 1/3878
USPC ..... 358/1.1, 1.18, 488, 498, 296; 399/361, 399/381, 384, 388, 394, 395
See application file for complete search history.

(56) References Cited

U.S. PATENT DOCUMENTS

| | | | | |
|---|---|---|---|---|
| 4,814,792 | A * | 3/1989 | Yamanobe et al. | 347/248 |
| 6,052,552 | A * | 4/2000 | Ohsumi et al. | 399/394 |
| 6,342,909 | B1 * | 1/2002 | Joichi et al. | 347/129 |
| 6,873,820 | B2 * | 3/2005 | Tanaka et al. | 399/395 |
| 6,934,504 | B2 * | 8/2005 | Morita | 399/394 |
| 6,937,263 | B2 * | 8/2005 | Namiki et al. | 347/248 |
| 8,032,041 | B2 * | 10/2011 | Atsumi et al. | 399/51 |
| 8,179,541 | B2 * | 5/2012 | Nakazawa | 358/1.13 |
| 2008/0054555 | A1 | 3/2008 | Atsumi et al. | |
| 2009/0201525 | A1 | 8/2009 | Nakazawa | |

FOREIGN PATENT DOCUMENTS

| | | |
|---|---|---|
| JP | 2003-330334 | 11/2003 |
| JP | 2006-293280 A | 10/2006 |
| JP | 2009-186848 A | 8/2009 |

* cited by examiner

*Primary Examiner* — Thomas D Lee
(74) *Attorney, Agent, or Firm* — Keating & Bennett, LLP

(57) ABSTRACT

An image forming apparatus includes a high speed correction mode in which, at the time of a successive image forming process on a plurality of recording sheets, a preset number of recording sheets among the plurality of recording sheets are subjected to image formation based on a corrected image writing position, and other recording sheets are subjected to image formation based on the corrected image writing position; and a linear correction mode in which the plurality of recording sheets are subjected to image formation based on the corrected image writing position; and performs switching to either one of the high speed correction mode and the linear correction mode according to a correction amount βb for a recording sheet detected at the time of image formation with respect to a correction amount βa for the preset number of recording sheets.

19 Claims, 25 Drawing Sheets

(Control example 1)

(High speed correction mode)

(Linear correction mode)

FIG.12 (Control example 2)
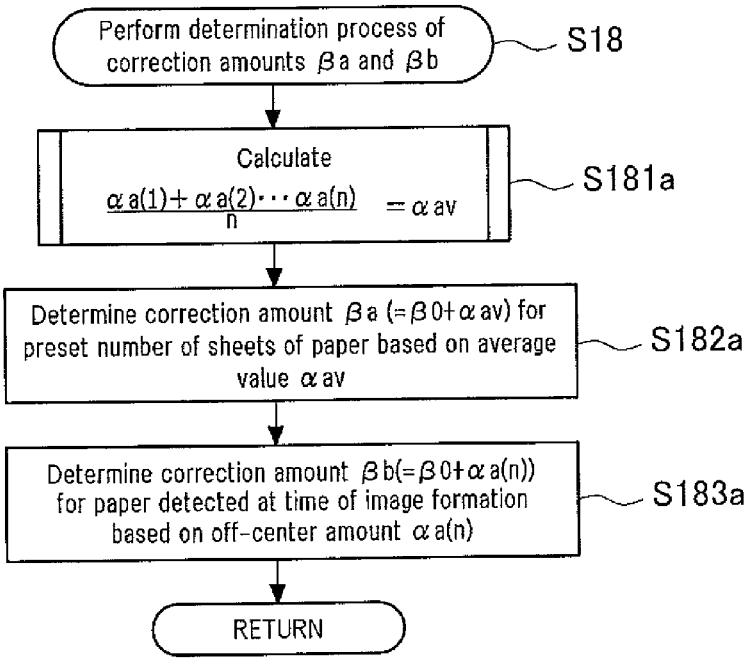
FIG.13 (Control example 3)
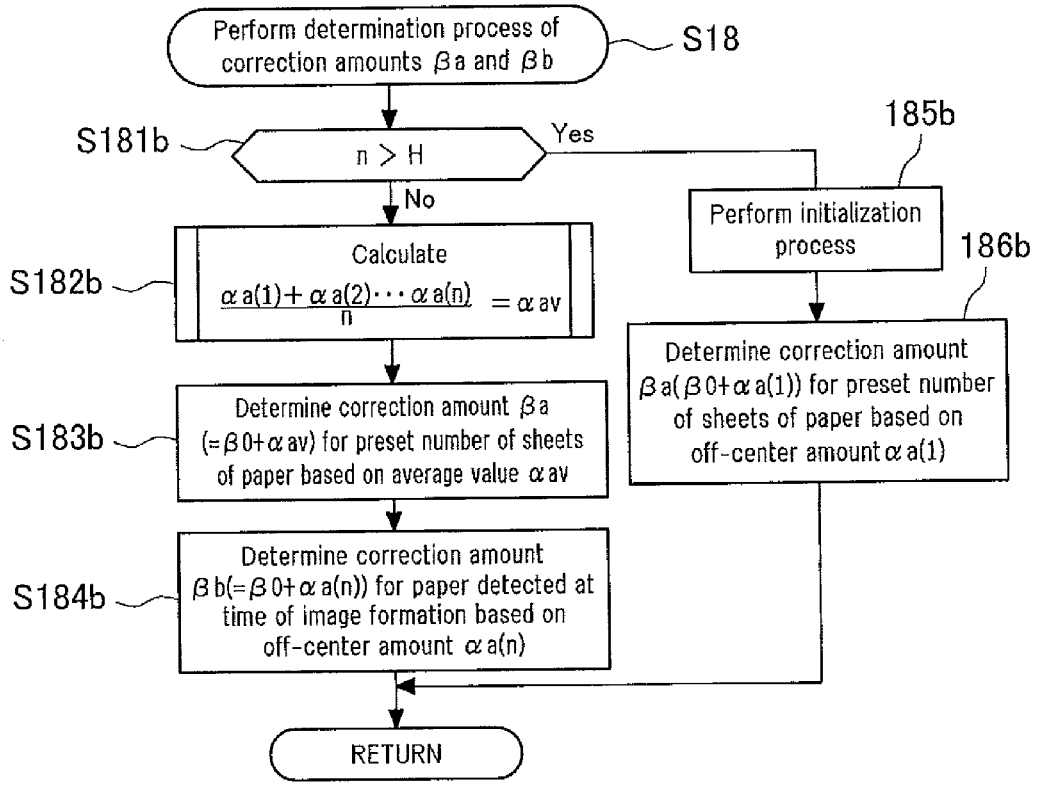

(Control example 4)

(Control example 4)

(Control example 5)

(Control example 5)

(Control example 7)

(Control example 9)

IMAGE FORMING APPARATUS CAPABLE OF CORRECTING TRASPORT POSITION DISPLACEMENT OF RECORDING SHEET

CROSS-REFERENCE TO RELATED APPLICATION

This application claims priority under 35 U.S.C. §119(a) on Patent Application No. 2010-270413 filed in Japan on Dec. 3, 2010, the entire contents of which are herein incorporated by reference.

BACKGROUND OF THE INVENTION

1. Field of the Invention

The present disclosure relates to an image forming apparatus, and more specifically relates to an image forming apparatus compatible with a high speed apparatus.

2. Related Art

In recent image forming apparatuses, space-saving vertical transport-type image forming apparatuses have become mainstream in order to reduce installation space. For example, a plurality of sheet feed portions (i.e., paper feed trays or paper feed cassettes) are arranged at multiple levels in the lower portion of the apparatus main body, and an image forming portion and a fixing portion are arranged thereabove. The image forming portion forms an image on a recording sheet such as paper at an image forming region that is disposed on a sheet transport path for transporting a recording sheet, and the fixing portion fixes the image formed by the image forming portion.

FIGS. 27A and 27B are explanatory views for illustrating an exemplary configuration for forming an image on paper P at an image forming region (i.e., a transfer nip portion N1) that is disposed on a sheet transport path 228 for transporting the paper P. FIG. 27A is a schematic side view showing the configuration thereof, and FIG. 27B is a schematic side view showing an enlarged view of registration rollers R51 and R52 that are arranged on the upstream side of an image forming region (i.e., the transfer nip portion N1) in a transport direction Y1 of the paper P.

In the configuration shown in FIG. 27A, the paper P fed from a sheet feed portion (not shown) is once transported upward and then transported toward the transfer nip portion N1.

On the sheet transport path 228, a pair of transport rollers R31 and R32, pre-registration rollers R41 and R42, and the registration rollers R51 and R52 are arranged in this order in the transport direction Y1 of the paper P. The registration rollers R51 and R52 face the transfer nip portion N1 at a predetermined distance (e.g., distance of approximately 50 mm) therefrom. The transfer nip portion N1 is a portion in which an intermediate transfer member or an image bearing member (a photosensitive drum 214 in the drawing) and a transfer roller 217*a* are in contact with each other.

FIG. 28 is a timing chart showing the operation timings of the registration rollers R51 and R52 and the pre-registration rollers R41 and R42.

As shown in FIGS. 27A, 27B, and 28, when the paper P is transported through the sheet transport path 228 up to the registration rollers R51 and R52, the registration rollers R51 and R52 stop first at a time t1, and, when a leading edge (edge on the downstream side in the transport direction Y1) of the paper P makes contact with a nip portion N5 between the registration rollers R51 and R52, the pre-registration rollers R41 and R42 stop at a time t2 that is slightly after the time t1. Due to stoppage according to this time difference, the paper P sandwiched by the registration rollers R51 and R52 and the pre-registration rollers R41 and R42 is kept bowed in a slight curve. When the paper P is slightly bowed in this manner, tilting of the paper P is prevented, and distortion of a formed image with respect to the width direction of the paper P is eliminated. That is to say, regarding the paper P temporarily stopped by the registration rollers R51 and R52, the sheet transport state such as tilting of the paper P during transport is corrected by the registration rollers R51 and R52.

Subsequently, the registration rollers R51 and R52 and the pre-registration rollers R41 and R42 start transport of the paper P again at a time t3 where an image forming position at which an image is to be formed on the paper P is caused to match an image writing position (e.g., leading edge) of image information made visible on the photosensitive drum 214 in the transport direction Y1 (sub-scanning direction) (see FIG. 27A). Accordingly, the image forming position on the paper P from the registration rollers R51 and R52 can be caused to match the image writing position onto the photosensitive drum 214 in the transport direction Y1 (sub-scanning direction). At that time, writing of the image information is performed onto the photosensitive drum 214 such that the image forming position on the paper P matches the image writing position onto the photosensitive drum 214 also in the width direction (main-scanning direction) along a recording sheet face orthogonal to the transport direction Y1 of the paper P.

Incidentally, there is an increasing demand for recent image forming apparatuses to perform an image forming (printing) process at higher speed. For example, conventionally, an image forming apparatus capable of 60 sheets per minute (in the case of A4 sideways transport) or more was deemed to be a high speed apparatus, but recently, an image forming apparatus capable of 80 sheets per minute or more is referred to as a high speed apparatus, and moreover, development of image forming apparatuses capable of 100 to 120 sheets per minute or more is progressing. Thus, the processing speed of image formation in color printing is also increased so as to be more than 70 sheets per minute.

In this sort of image forming apparatus, it is necessary to maintain or improve the image quality when transferring a toner image on a photosensitive drum onto the paper P. An important factor for maintaining or improving the image quality is maintaining or improving the precision of the positional matching of the image writing position onto an image bearing member and the image forming position on a recording sheet.

As a technique regarding the precision of positional matching, an image forming apparatus is proposed in JP 2003-330334A.

JP 2003-330334A discloses an image forming apparatus that detects a length of displacement in a direction orthogonal to the recording sheet transport direction, and performs control so as to continue image formation if that displacement length does not exceed a prescribed value, and temporarily stop recording sheet transport if that displacement length exceeds the prescribed value.

However, due to the recent demand for further increasing the processing speed of image formation, during successive printing of a plurality of sheets, it is difficult to perform timing adjustment of recording sheets transported subsequent to a first recording sheet. That is to say, when printing the first sheet, there is time to spare in the initialization process or the like of the image forming apparatus, and, thus, it is possible to secure time to spare for adjusting the image writing position (image writing position in the transport direction and/or the width direction) by making earlier the timing of feeding a recording sheet from a sheet feed portion. However, the timing of transporting the second and subsequent recording sheets depends on the print processing speed, that is, the transport speed, and writing of image information onto the image bearing member has started before the leading edge of the second and subsequent recording sheets makes contact with the nip portion between the registration rollers, and, thus, no time to spare is available for adjusting the desired image writing position at which an image is to be formed on the recording sheet.

Regarding this aspect, Japanese Patent No. 4315988 discloses an image forming apparatus in which other recording sheets, on which image formation is to be performed after a preset number of recording sheets, are subjected to image formation at an image forming region based on a corrected image writing position, that is, detection by a sheet transport position detecting portion regarding the preset number of recording sheets is used regarding the image forming position of the other recording sheets, thereby enabling image formation to be performed while correcting the image writing position of a plurality of recording sheets even in a high speed apparatus.

However, in the image forming apparatus disclosed in Japanese Patent No. 4315988, since detection by the sheet transport position detecting portion regarding the preset number of recording sheets is used regarding the image forming position of recording sheets other than the preset number of recording sheets, for example, if the transport rollers are expanded by heat generated by friction or the like or recording sheets are replenished to sheet feed portions such as paper feeds tray or paper feed cassettes during the process of the preset number of recording sheets, so that the sheet transport position (position in the transport direction and/or the width direction) is suddenly significantly displaced, the image writing position based on the used detection is significantly displaced from the proper image writing position (based on an actually detected sheet transport position). Therefore, the precision of positional matching of the image forming position on a recording sheet and the image writing position onto an image bearing member becomes poor.

SUMMARY OF THE INVENTION

It is an object of the present technology to provide an image forming apparatus in which the positional matching of the image forming position on a recording sheet and the image writing position onto an image bearing member can be precisely performed even when a sheet transport position of a recording sheet is suddenly significantly displaced.

The present technology is directed to an image forming apparatus, comprising: an image bearing member on which an image is to be formed; a registration roller that is disposed on upstream side in a recording sheet transport direction of an image forming region, which is disposed on a sheet transport path for transporting a recording sheet, that performs transport and transport stoppage of the recording sheet, and that corrects a sheet transport state; and a sheet transport position detecting portion that detects a sheet transport position of a recording sheet on the sheet transport path on upstream side of the registration roller in the transport direction; wherein the image forming apparatus is provided with: a high speed correction mode in which, at time of a successive image forming process on a plurality of recording sheets, the sheet transport position is detected by the sheet transport position detecting portion for a preset number of recording sheets among the plurality of recording sheets, a correction amount of an image writing position onto the image bearing member is determined based on the detected sheet transport position, the image writing position is corrected based on the determined correction amount, and the preset number of recording sheets are subjected to image formation at the image forming region based on the corrected image writing position, and one or more other recording sheets, on which image formation is to be performed after the preset number of recording sheets, are subjected to image formation at the image forming region based on the corrected image writing position; and a linear correction mode in which, at time of the successive image forming process, the sheet transport position is detected by the sheet transport position detecting portion for the plurality of recording sheets, a correction amount of an image writing position onto the image bearing member is determined based on the detected sheet transport position, the image writing position is corrected based on the determined correction amount, and the recording sheets are subjected to image formation at the image forming region based on the corrected image writing position; and switching is performed to either one of the high speed correction mode and the linear correction mode according to the correction amount for a recording sheet detected at time of image formation with respect to the correction amount for the preset number of recording sheets.

In the present technology, for example, image formation may be performed from the image bearing member directly to a recording sheet if the direct transfer method is adopted, or image formation may be performed from the image bearing member indirectly via an intermediate transfer member such as an intermediate transfer belt to a recording sheet if the intermediate transfer method is adopted. Examples of the sheet transport position detected by the sheet transport position detecting portion include a sheet transport position in a width direction along a sheet face orthogonal to the transport direction and a sheet transport position in the transport direction.

According to the present technology, in the case where switching is performed to the high speed correction mode, detection by the sheet transport position detecting portion regarding the preset number of (one, or two or more) recording sheets is used regarding the image forming position at which an image is to be formed on other recording sheets, and, thus, it is possible to perform image formation on the plurality of recording sheets while correcting the image writing position even in a high speed apparatus. Accordingly, even in a high speed apparatus, it is possible to obtain precise positional matching of the image forming position on a recording sheet and the image writing position onto the image bearing member. Moreover, since switching is performed to either one of the high speed correction mode and the linear correction mode according to the correction amount for a recording sheet detected at the time of the image formation with respect to the correction amount for the preset number of recording sheets, for example, if the transport rollers are expanded by heat generated by friction or the like or recording sheets are replenished to sheet feed portions (i.e., paper feed trays or paper feed cassettes), so that the sheet transport position is significantly displaced, the switching is performed to the linear correction mode, and, thus, the corrected image writing position matches the proper image writing position (based on the actually detected sheet transport position). Accordingly, even when the sheet transport position of a recording sheet is suddenly significantly displaced, it is possible to obtain precise positional matching of the image forming position on a recording sheet and the image writing position onto the image bearing member.

An exemplary embodiment of the present technology can be shown in which the sheet transport position detecting portion includes a first sheet transport position detecting portion that detects the sheet transport position at a position close to the registration roller on upstream side of the registration roller in the recording sheet transport direction, and a second sheet transport position detecting portion that detects the sheet transport position on upstream side of the first sheet transport position detecting portion in the recording sheet transport direction.

According to this specific aspect, since the sheet transport position is detected by the second sheet transport position detecting portion on the upstream side of the first sheet transport position detecting portion in the recording sheet transport direction, a value corresponding to the correction amount for a recording sheet detected at the time of the image formation with respect to the correction amount for the preset number of recording sheets can be obtained before starting the writing of the image information onto the image bearing member, and switching between the high speed correction mode and the linear correction mode can be performed before starting the writing of the image information onto the image bearing member. That is to say, if detection by the first sheet transport position detecting portion is performed at a position close to the registration roller on the upstream side of the registration roller in the recording sheet transport direction, the sheet transport position can be precisely detected in the high speed correction mode, and, moreover, if detection by the first sheet transport position detecting portion regarding the preset number of recording sheets is used, the writing of the image information onto the image bearing member can be started before the first sheet transport position detecting portion detects the sheet transport position in the high speed correction mode, and the processing speed of image formation can be accordingly increased in the high speed correction mode.

An exemplary embodiment of the present technology can be shown in which switching is performed to the high speed correction mode in a case where a difference value between the correction amount for the preset number of recording sheets and the correction amount for a recording sheet detected at time of the image formation is within a preset reference range, and switching is performed to the linear correction mode in a case where the difference value is not within the reference range.

According to this specific aspect, since the switching between the high speed correction mode and the linear correction mode is determined using a difference value between the correction amount for the preset number of recording sheets and the correction amount for a recording sheet detected at the time of the image formation, switching to either one of the high speed correction mode and the linear correction mode can be easily performed with a simple calculation configuration that calculates the difference value using the size (level) of the difference value as a trigger to perform switching between the high speed correction mode and the linear correction mode.

An exemplary embodiment of the present technology can be shown in which a plurality of sheet feed portions that feed a recording sheet to the sheet transport path are arranged on upstream side of the registration roller in the recording sheet transport direction, and in a case where a difference value between the correction amount for the preset number of recording sheets and the correction amount for a recording sheet detected at time of the image formation is successively not within the reference range for a prescribed number of sheets, a recording sheet is fed from another sheet feed portion for the same size, and the count of a number of successive sheets in which the difference value is successively not within the reference range is reset.

According to this specific aspect, since, among the plurality of sheet feed portions, feeding of recording sheets from a sheet feed portion in which a difference value between the correction amount for the preset number of recording sheets and the correction amount for a recording sheet detected at the time of the image formation is successively out of the reference range for the prescribed number of sheets is changed to feeding of recording sheets from another sheet feed portion for the same size, even when any of the plurality of sheet feed portions is out of order regarding the sheet transport position, it is possible to obtain precise positional matching of the image forming position on a recording sheet and the image writing position onto the image bearing member. Moreover, if the difference value is successively not within the reference range for the prescribed number of sheets, the count of the number of successive sheets is reset, and, thus, the speed can be retuned to the processing speed of image formation in the high speed correction mode.

An exemplary embodiment of the present technology can be shown in which the image forming apparatus further includes a notifier (notification means) that gives notice to effect that it is necessary to check a sheet feed portion that was feeding a recording sheet before the other sheet feed portion feeds a recording sheet in a case where a recording sheet is fed from the other sheet feed portion.

According to this specific aspect, since the image forming apparatus further includes a notifier that gives notice to the effect that it is necessary to check a sheet feed portion that was feeding a recording sheet before another sheet feed portion feeds a recording sheet, the user can easily recognize that the sheet feed portion has to be checked.

Here, examples of the notifier typically include display means for giving visual notification, by displaying, on a display portion disposed on the image forming apparatus, a message to the effect that the sheet feed portion has to be checked, lighting or flashing a light-emitting element with respect to a message indicated on an operation portion disposed on the image forming apparatus, and the like. In addition, the notifier may be alarm means for giving visual notification with voice, alarm sound, or the like.

An exemplary embodiment of the present technology can be shown in which an average value obtained by measuring the correction amount of the image writing position for the preset number of recording sheets in the high speed correction mode and averaging the correction amounts of the number of recording sheets is used as the correction amount of the image writing position.

According to this specific aspect, since the average value obtained by averaging correction amounts of the preset number of recording sheets in the high speed correction mode is used as the correction amount of the image writing position, the precision of the positional matching of the image forming position on a recording sheet and the image writing position onto the image bearing member can be improved with a simple calculation configuration.

An exemplary embodiment of the present technology can be shown in which a difference value between the correction amount for the preset number of recording sheets and the correction amount for a recording sheet detected at time of the image formation is not within the preset reference range, the correction amount in which the difference value is not within the reference range is excluded from data for the average value.

According to this specific aspect, since the correction amount in which the difference value is not within the reference range is excluded from data for the average value, and the unreliable data is not used as data for the average value, the precision of data for the average value can be improved, and the precision of the image writing position onto the image bearing member can be accordingly improved.

An exemplary embodiment of the present technology can be shown in which it is possible to select one of: a mode switching operation that performs switching to either one of the high speed correction mode and the linear correction mode according to the correction amount for the recording sheet detected at time of the image formation with respect to the correction amount for the preset number of recording sheets; and a linear correction mode prioritizing operation that performs switching to the linear correction mode regardless of a value corresponding to the correction amount for the recording sheet detected at time of the image formation with respect to the correction amount for the preset number of recording sheets.

According to this specific aspect, if there is a request to give priority to the linear correction mode in which the image writing position onto the image bearing member matches the proper image writing position, the user selects the linear correction mode prioritizing operation, so that the image writing position onto the image bearing member can match the proper image writing position regardless of a value corresponding to the correction amount for a recording sheet detected at the time of the image formation with respect to the correction amount for the preset number of recording sheets. Accordingly, even if the processing speed of image formation in the high speed correction mode cannot be achieved, a request to give priority to the linear correction mode also can be met.

Here, selection from among the mode switching operation and the linear correction mode prioritizing operation is performed in a service simulation mode in which service personnel performs desired setting or selection or a user simulation mode in which the user performs desired setting or selection.

As described above, according to the present technology, it is possible to obtain precise positional matching of the image forming position on a recording sheet and the image writing position onto the image bearing member even in a high speed apparatus. Furthermore, since switching is performed to either one of the high speed correction mode and the linear correction mode according to the correction amount for the recording sheet detected at the time of image formation with respect to the correction amount for the preset number of recording sheets, for example, if the transport rollers are expanded by heat generated by friction or the like or recording sheets are replenished to sheet feed portions (i.e., paper feed trays or paper feed cassettes), so that the sheet transport position is significantly displaced, the switching is performed to the linear correction mode, and, thus, the corrected image writing position matches the proper image writing position (based on the actually detected sheet transport position). Accordingly, even when the sheet transport position of a recording sheet is suddenly significantly displaced, it is possible to obtain precise positional matching of the image forming position on a recording sheet and the image writing position onto the image bearing member.

BRIEF DESCRIPTION OF THE DRAWINGS

FIGS. 2A and 2B are explanatory views for illustrating a configuration for detecting paper on a main transport path, wherein FIG. 2A is a side view schematically showing an exemplary configuration of a sheet transport position detecting portion and a sheet detecting portion, and FIG. 2B is a plan view schematically showing an exemplary configuration of the sheet transport position detecting portion and the sheet detecting portion.

FIG. 8B is a view for illustrating a correction amount of the image writing position onto the photosensitive drums determined in the control example 1.

FIGS. 9A and 9B are schematic plan views showing image information detected by a second sheet transport position detecting portion in the control example 1, wherein FIG. 9A is a view for illustrating an off-center amount of a measured paper transport position measured in the control example 1, and FIG. 9B is a view for illustrating a correction amount of the image writing position onto the photosensitive drums determined in the control example 1.

FIG. 12 is a flowchart showing the sub routine of "determination of correction amounts" of a control example 2 of the correcting process according to Embodiment 2.

FIG. 13 is a flowchart showing the sub routine of "determination of correction amounts" of a control example 3 of the correcting process according to Embodiment 3.

FIGS. 20A and 20B are explanatory views for illustrating a configuration for detecting paper on a main transport path, wherein FIG. 20A is a side view schematically showing another exemplary configuration of the sheet transport position detecting portion and the sheet detecting portion, and FIG. 20B is a plan view schematically showing another exemplary configuration of the sheet transport position detecting portion and the sheet detecting portion.

FIGS. 27A and 27B are explanatory views for illustrating an exemplary configuration for forming an image on paper at an image forming region that is disposed on a sheet transport path for transporting paper, wherein FIG. 27A is a schematic side view showing the configuration thereof and FIG. 27B is a schematic side view showing an enlarged view of registration rollers that are arranged on the upstream side of an image forming region in a paper transport direction.

DESCRIPTION OF THE PREFERRED EMBODIMENTS

Hereinafter, embodiments of the present technology will be described with reference to the accompanying drawings. The embodiments described below are only examples in which the present technology is embodied, and are not intended to limit the technical scope of the present technology.

[Description of the Overall Configuration of the Image Forming Apparatus]

Figure 1:
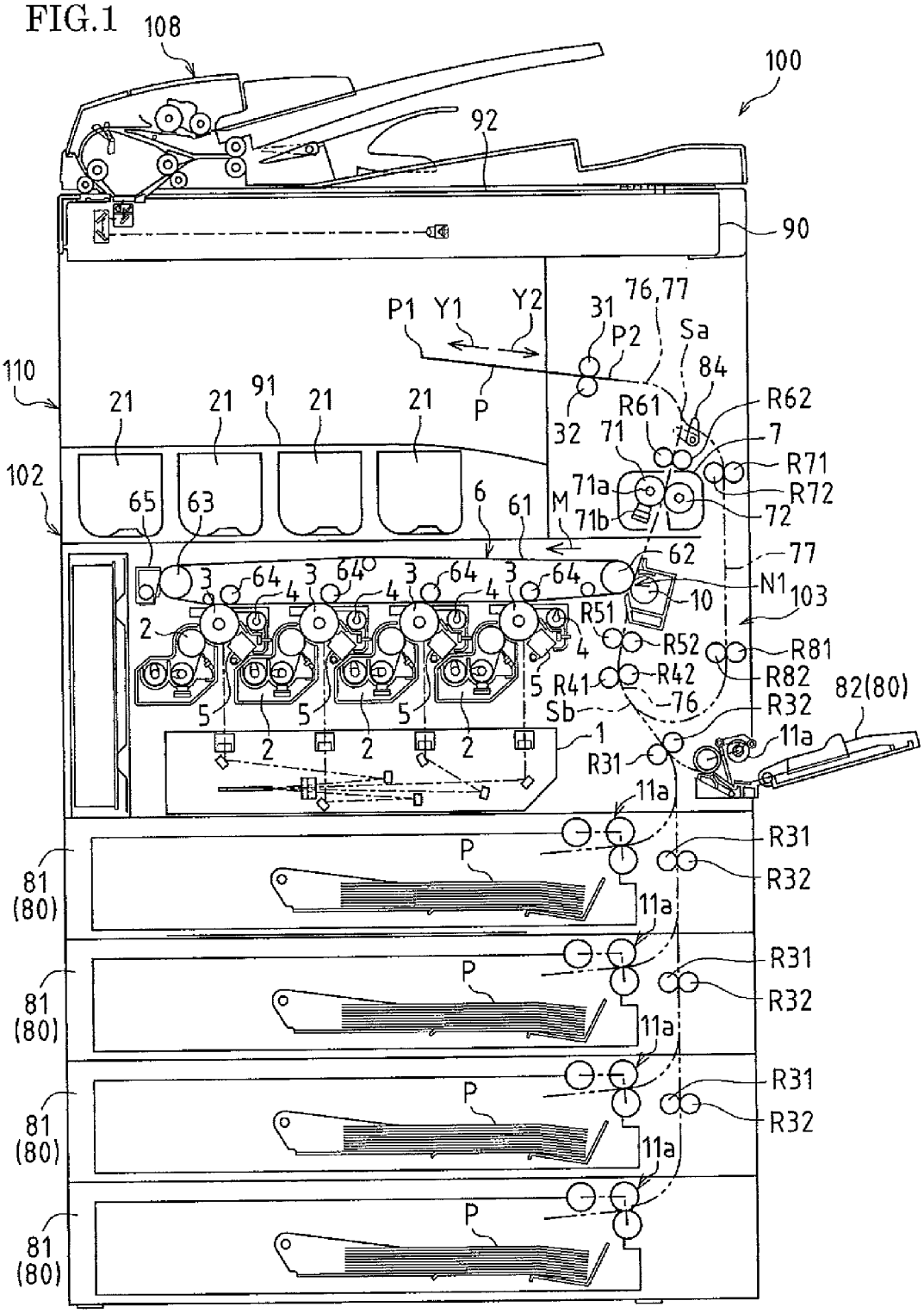
FIG. 1 is a schematic cross-sectional view of an image forming apparatus according to an embodiment of the present technology when viewed from the front.

FIG. 1 is a schematic cross-sectional view of an image forming apparatus 100 according to an embodiment of the present technology when viewed from the front.

In this embodiment, the image forming apparatus 100 shown in FIG. 1 is an image forming apparatus compatible with a high speed apparatus in which the processing speed of image formation is 100 sheets per minute in monochrome printing and 70 sheets per minute in color printing.

The image forming apparatus 100 is a color image forming apparatus that forms multicolor and monochrome images on recording sheets such as recording paper (hereinafter referred to as, "paper P") in response to image data transmitted from the outside. The image forming apparatus 100 includes an original reading apparatus 108 and an apparatus main body 110. The apparatus main body 110 includes an image forming portion 102, a paper transport system 103, and a fixing unit 7.

The image forming portion 102 includes an exposing unit 1, a plurality of development units 2, a plurality of photosensitive drums 3, a plurality of cleaning portions 4, a plurality of charging units 5, an intermediate transfer belt unit 6, and a plurality of toner cartridge units 21.

Furthermore, the paper transport system 103 includes a paper feed portion that functions as a sheet feed portion (a plurality of paper feed portions 80 including paper feed trays 81 arranged at a plurality of levels and a manual paper feed tray 82, in this example), a main transport path 76 (exemplary sheet transport path), a reverse transport path 77, and a discharge tray 91.

An original placement stage 92 made of transparent glass on which an original (sheet) is placed is disposed above the apparatus main body 110, and an optical unit 90 for reading an original is disposed below the original placement stage 92. Furthermore, the original reading apparatus 108 is disposed above the original placement stage 92. The original reading apparatus 108 automatically transports an original onto the original placement stage 92. Furthermore, the original reading apparatus 108 is attached pivotally to the apparatus main body 110 with the front side openable, and an original can be placed manually after exposing the surface of the original placement stage 92.

The original reading apparatus 108 can read an original automatically transported or an original placed on the original placement stage 92. The entire image of the original read by the original reading apparatus 108 is transmitted as image data to the apparatus main body 110 of the image forming apparatus 100, and an image formed based on the image data is recorded on the paper P in the apparatus main body 110.

The image data that can be processed in the image forming apparatus 100 is that corresponds to color images using a plurality of colors (black (K), cyan (C), magenta (M), yellow (Y), in this example). Accordingly, a plurality of units (four units that respectively correspond to black, cyan, magenta, and yellow, in this example) of development units 2, photosensitive drums 3, cleaning portions 4, charging units 5, and toner cartridge units 21 are set so as to form images of a plurality of types (four types, in this example) corresponding to the respective colors, and, thus, a plurality of (four, in this example) image stations are formed.

The charging units 5 are charging means for uniformly charging the surface of the photosensitive drums 3 to a predetermined potential, and may be charging units of charger type as shown in FIG. 1 or may be charging units of contact type such as rollers or brushes.

The exposing unit 1 is configured in a laser scanning unit (LSU) provided with a laser irradiating portion and reflection mirrors. The exposing unit 1 is provided with a polygon mirror scanned by a laser beam, and optical elements such as lenses or mirrors for guiding the laser light reflected by the polygon mirror to the photosensitive drums 3. Furthermore, the exposing unit 1 may use concepts other than above, such as a concept employing a writing head in which light-emitting elements such as EL (electroluminescence) elements or LEDs (light-emitting diodes) are arranged in an array.

The photosensitive drums 3 that have been charged in accordance with input image data are exposed to light by the exposing unit 1, and, thus, electrostatic latent images in accordance with the image data are formed on the respective surfaces of the photosensitive drums 3.

The toner cartridge units 21 are units that contain toner, and supply toner to the development baths of the development units 2. In the apparatus main body 110 of the image forming apparatus 100, the toner supplied from the toner cartridge units 21 to the development baths of the development units 2 is controlled such that the toner concentration of a developer in the development baths is constant.

The development units 2 make the electrostatic latent images formed on the respective photosensitive drums 3 visible with four color toners (Y, M, C, and K). The cleaning portions 4 remove and recover toner that is left on the surfaces of the photosensitive drums 3 after development and image transfer.

The intermediate transfer belt unit 6 arranged above the photosensitive drums 3 includes an intermediate transfer belt 61 that functions as an intermediate transfer member, an intermediate transfer belt drive roller 62, an intermediate transfer belt idler roller 63, a plurality of intermediate transfer rollers 64, and an intermediate transfer belt cleaning unit 65.

Four intermediate transfer rollers 64 are provided corresponding to the respective colors Y, M, C, and K. The intermediate transfer belt drive roller 62 supports the intermediate transfer belt 61 in cooperation with the intermediate transfer belt idler roller 63 and the intermediate transfer rollers 64 in a tensioned state. When the intermediate transfer belt drive roller 62 is rotationally driven, the intermediate transfer belt 61 is rotationally moved in the movement direction (direction indicated by arrow M in FIG. 1), which causes the idler roller 63 and the intermediate transfer rollers 64 to rotate idly.

The intermediate transfer rollers 64 are supplied with a transfer bias for transferring a toner image formed on the photosensitive drums 3 onto the intermediate transfer belt 61.

The intermediate transfer belt 61 is disposed so as to be in contact with each of the photosensitive drums 3. Toner images of the respective colors formed on the photosensitive drums 3 are successively transferred to the intermediate transfer belt 61 so as to be superimposed one after another, and, thus, a color toner image (multicolor toner image) is formed on the surface of the intermediate transfer belt 61. The intermediate transfer belt 61 is formed as an endless belt made of a film having a thickness of approximately 100 μm to 150 μm, for example.

Toner images are transferred from the photosensitive drums 3 to the intermediate transfer belt 61 by means of the intermediate transfer rollers 64 that are in contact with the back face of the intermediate transfer belt 61. The intermediate transfer rollers 64 are supplied with a high voltage transfer bias (high voltage having an opposite polarity (+) to the polarity (−) of the charged toner) for transferring toner images. Each of the intermediate transfer rollers 64 is a roller made by forming its core with a metal (e.g., stainless steel) shaft having a diameter of 8 mm to 10 mm and covering the surface of the core with a conductive elastic material (e.g., resin materials such as EPDM (ethylene propylene diene rubber) or foamed urethane). The intermediate transfer rollers 64 are function as transfer electrodes that apply a high voltage uniformly to the intermediate transfer belt 61 with the conductive elastic material. Although roller-like transfer electrodes are used as the transfer electrodes in this embodiment, brush-like transfer electrodes also can be used.

As described above, toner images that are made visible in accordance with the color phases on the respective photosensitive drums 3 are layered on the intermediate transfer belt 61. The toner images layered on the intermediate transfer belt 61 are transferred onto a paper P by a transfer roller 10 forming a secondary transfer mechanism portion arranged at a position where the paper P is in contact with the intermediate transfer belt 61, by means of the rotational movement of the intermediate transfer belt 61. Here, the configuration of the secondary transfer mechanism portion is not limited to transfer rollers, but also other transfer configurations such as those employing corona chargers or transfer belts can be used.

At this time, the transfer roller 10 is supplied with a voltage (high voltage having an opposite polarity (+) of the polarity (−) of the charged toner) for transferring toner onto the paper P in a state where an image forming region (i.e., a transfer nip portion N1) is formed between the transfer roller 10 and the intermediate transfer belt 61. The transfer nip portion N1 is formed between the transfer roller 10 and the intermediate transfer belt 61 by the transfer roller 10 and the intermediate transfer belt drive roller 62 pressing against each other. In order to steadily obtain the transfer nip portion N1, either the transfer roller 10 or the intermediate transfer belt drive roller 62 is a hard roller made of a hard material (such as metal) and the other is an elastic roller made of a soft material (elastic rubber or resin materials such as foamed resin).

When transferring a toner image from the intermediate transfer belt 61 onto the paper P with the transfer roller 10, toner may remain on the intermediate transfer belt 61 without being transferred onto the paper P. The toner that has remained on the intermediate transfer belt 61 may cause mixture of colors in subsequent processes. Therefore, the toner that has remained on the intermediate transfer belt 61 is removed and recovered by the intermediate transfer belt cleaning unit 65. More specifically, the intermediate transfer belt cleaning unit 65 is provided with a cleaning member (e.g., cleaning blade) that is in contact with the intermediate transfer belt 61. The idler roller 63 supports the intermediate transfer belt 61 from the inside (back face side), and the cleaning member is in contact with the intermediate transfer belt 61 so as to press it toward the idler roller 63 from the outside.

The plurality of paper feed portions 80 including the paper feed trays 81 at a plurality of levels and the manual paper feed tray 82 are arranged on the upstream side of registration rollers R51 and R52 in a transport direction Y1 of the paper P, and transport (feed) the paper P to the main transport path 76.

The paper feed trays 81 is a tray that stores in advance the paper P on which an image is to be formed (printed), and is detachably attached from the front side of the apparatus main body 110. The paper feed trays 81 are arranged at a plurality of levels (four levels, in this example) in the vertical direction below the exposing unit 1 in the apparatus main body 110. Furthermore, the paper P on which an image is to be formed is placed on the manual paper feed tray 82. Here, the plurality of paper feed portions 80 may be any constituent members as long as they transport the paper P to the main transport path 76, and examples thereof include not only the paper feed trays 81 and the manual paper feed tray 82 but also an automatic duplex paper feed apparatus, a paper feed cassette, and a large capacity cabinet (LCC).

The discharge tray 91 is disposed above the image forming portion 102 in the apparatus main body 110, and accommodates face-down the paper P on which an image has been formed.

Furthermore, the apparatus main body 110 includes the main transport path 76 for transporting the paper P from the paper feed tray 81 or the manual paper feed tray 82 via the transfer roller 10 and the fixing unit 7 to the discharge tray 91. Paper feed rollers 11*a*, transport rollers R31 and R32, pre-registration rollers R41 and R42, the registration rollers R51 and R52, the transfer roller 10, a heat roller 71 and a pressure roller 72 in the fixing unit 7, transport rollers R61 and R62, and discharge rollers 31 and 32 are arranged close to the main transport path 76. Transport rollers R71 and R72 and transport rollers R81 and R82 are arranged close to the reverse transport path 77

The transport rollers (R31 and R32), (R61 and R62), (R71 and R72) and (R81 and R82) are small rollers for promoting and assisting transport of the paper P. The paper feed roller 11*a* disposed close to the paper feeding side of the paper feed tray 81 picks up the paper P sheet by sheet from the paper feed tray 81 and feeds it to the main transport path 76. In a similar manner, the paper feed roller 11*a* disposed close to the paper feeding side of the manual paper feed tray 82 picks up the paper P sheet by sheet from the manual paper feed tray 82 and feeds it to the main transport path 76.

Furthermore, the pre-registration rollers R41 and R42 are arranged on the upstream side of the registration rollers R51 and R52 in the transport direction Y1, and transport the paper P to the registration rollers R51 and R52.

The registration rollers R51 and R52 rotate in synchronization with rotation of the intermediate transfer belt 61 and the transfer roller 10, and transport the paper P to the transfer nip portion N1 between the intermediate transfer belt 61 and the transfer roller 10. More specifically, the registration rollers R51 and R52 temporarily hold the paper P that is being transported along the main transport path 76, and corrects the paper transport state (sheet transport state). The registration rollers R51 and R52 transport the paper P to the transfer nip portion N1 at a timing when the leading edge of a toner image on the intermediate transfer belt 61 matches a leading edge P1 (edge on the downstream side in the transport direction Y1) of the paper P.

The fixing unit 7 fixes an unfixed toner image onto the paper P, and includes the heat roller 71 and the pressure roller 72 that function as fixing rollers. When being rotationally driven, the heat roller 71 transports the paper P while sandwiching the paper P together with the pressure roller 72 that idly rotates. The heat roller 71 is heated by a heater 71*a* disposed inside it, and is maintained at a predetermined fixing temperature based on a signal from a temperature detector 71*b*. The heat roller 71 heated by the heater 71*a* performs thermo-compression bonding of a multicolor toner image transferred onto the paper P on the paper P together with the pressure roller 72, and, thus, the multicolor toner image is melted, mixed, and pressed and thus is thermo-fixed onto the paper P.

The reverse transport path 77 is a transport path for transporting the paper P that is to be transported in a reverse direction Y2 opposite the transport direction Y1, and is a transport path connecting part of the main transport path 76, which is from the discharge rollers 31 and 32 to a branching portion Sa between the fixing unit 7 and the discharge rollers 31 and 32, and a connecting portion Sb connected with the main transport path 76, which is between the image forming portion 102 and the paper feed portions 80. Accordingly, the main transport path 76 and the reverse transport path 77 have a shared transport path between a paper transport apparatus 300 and the branching portion Sa.

The branching portion Sa is provided with a branching gate (i.e., a branching claw 84). The branching claw 84 is configured so as to be in a first posture (the posture indicated by the solid line in FIG. 1) in which the paper P from the fixing unit 7 is guided toward the discharge rollers 31 and 32, and in a second posture (the posture indicated by the broken line in FIG. 1) in which the paper P transported in the reverse direction Y2 opposite the transport direction Y1 by reverse rotation of the discharge rollers 31 and 32 is guided toward the reverse transport path 77.

Figure 27A:
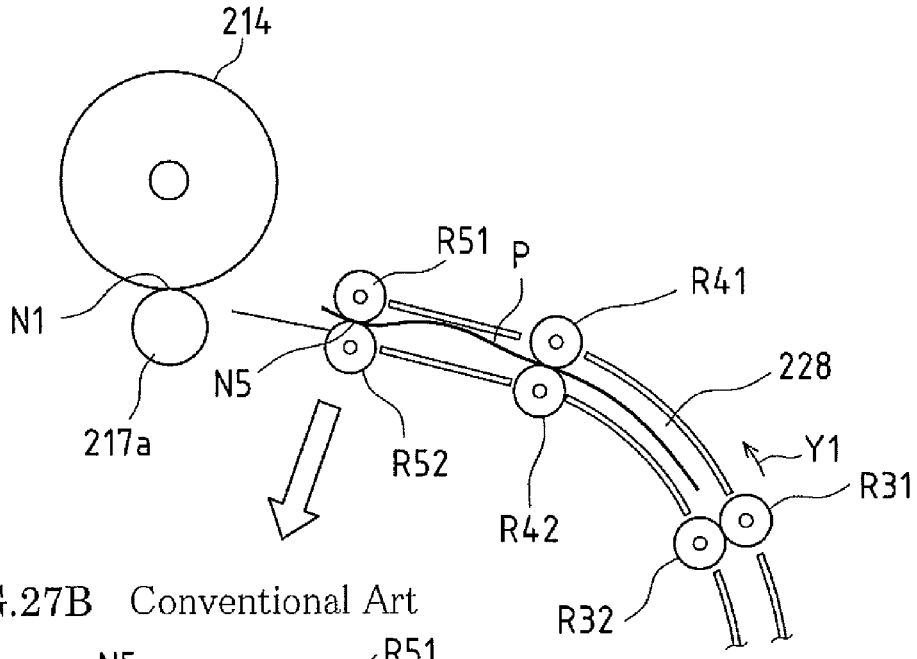
FIG.27A Conventional Art
Figure 27B:
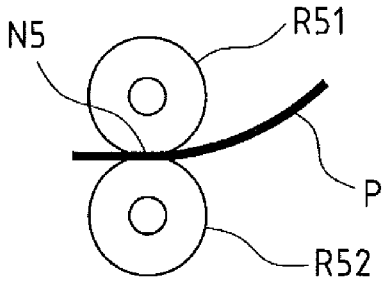
FIG.27B Conventional Art
Figure 28:
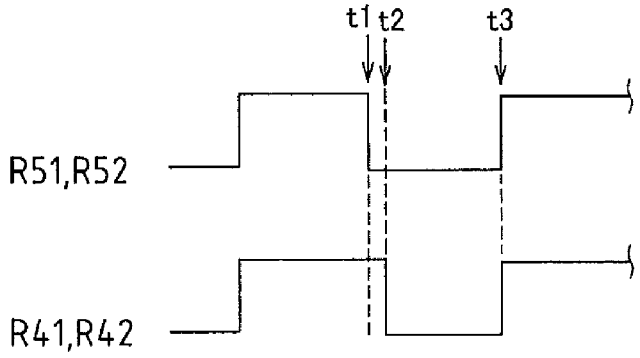
FIG.28 Conventional Art
FIG. 28 is a timing chart showing the operation timings of registration rollers and pre-registration rollers.

In the thus configured image forming apparatus 100, the paper P fed from the paper feed tray 81 or the manual paper feed tray 82 is transported along the main transport path 76 by the transport rollers R31 and R32 toward the pre-registration rollers R41 and R42, and stopped in a state where a trailing edge P2 (edge on the upstream side in the transport direction Y1) is sandwiched by the pre-registration rollers R41 and R42 and the leading edge P1 is in contact with a nip portion N5 (see FIGS. 2A and 2B described later) between the registration rollers R51 and R52. The configuration of this portion is substantially the same as that shown in FIGS. 27A and 27B. Also, the operation timing of the registration rollers R51 and R52 and the pre-registration rollers R41 and R42 is substantially the same as that shown in FIG. 28, and transport of the paper P on the main transport path 76, in which the paper P is transported to the transfer nip portion N1 between the intermediate transfer belt 61 and the transfer roller 10, and transport stoppage are performed by the registration rollers R51 and R52. The paper P that has been transported up to the registration rollers R51 and R52 is transported by the registration rollers R51 and R52 at a timing when the leading edge P1 of the paper P matches the leading edge of a toner image on the intermediate transfer belt 61, and receives a corona discharge by the transfer roller 10 at the transfer nip portion N1, and, thus, a toner image carried on the surface of the intermediate transfer belt 61 is transferred to the paper P. Subsequently, as the paper P passes through the fixing unit 7, unfixed toner on the paper P is fixed by melting with the application of heat.

Then, the branching claw 84 is brought into the first posture, and, in the case where an image is to be formed on one face of the paper P, the paper P from the fixing unit 7 is transported by the transport rollers R61 and R62 and then by the discharge rollers 31 and 32 that are being rotated forward, and discharged onto the discharge tray 91.

Furthermore, in the case where an image is to be formed on both faces of the paper P, the leading edge P1 of the paper P that has passed through the fixing unit 7 is temporarily discharged to the outside, and the trailing edge P2 of the paper P passes through the branching portion Sa. Then, the branching claw 84 is brought into the second posture, and the paper P is transported in the reverse direction Y2 (switchback) by reverse rotation of the discharge rollers 31 and 32, via the transport rollers (R71 and R72) and (R81 and R82) to the connecting portion Sb, which is on the upstream side of the registration rollers R51 and R52, while the front and the back faces of the paper are reversed along the reverse transport path 77. Then, after an image is formed on the back face, the paper P that has been transported via the registration rollers R51 and R52 to the transfer nip portion N1 is transported by the discharge rollers 31 and 32 that are being rotated forward and discharged onto the discharge tray 91.

[Correction of the Image Writing Position]

Next, correction of the image writing position onto the photosensitive drums 3 with respect to the paper transport position (sheet transport position) of the paper P on the main transport path 76 will be described.

The image forming apparatus 100 according to this embodiment includes a sheet transport position detecting portion 170 and a sheet detecting portion 180. Here, the sheet transport position detecting portion 170 and the sheet detecting portion 180 are shown in FIGS. 2A and 2B (described later), and are not shown in FIG. 1.

Figure 2A:
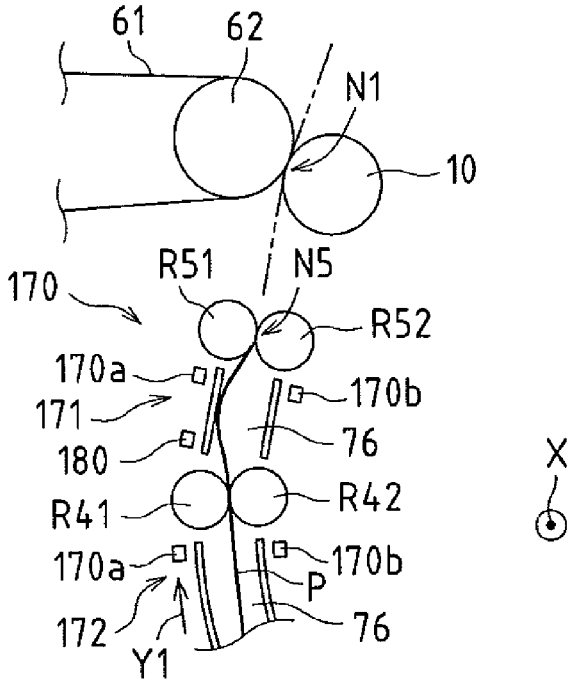
Figure 2B:
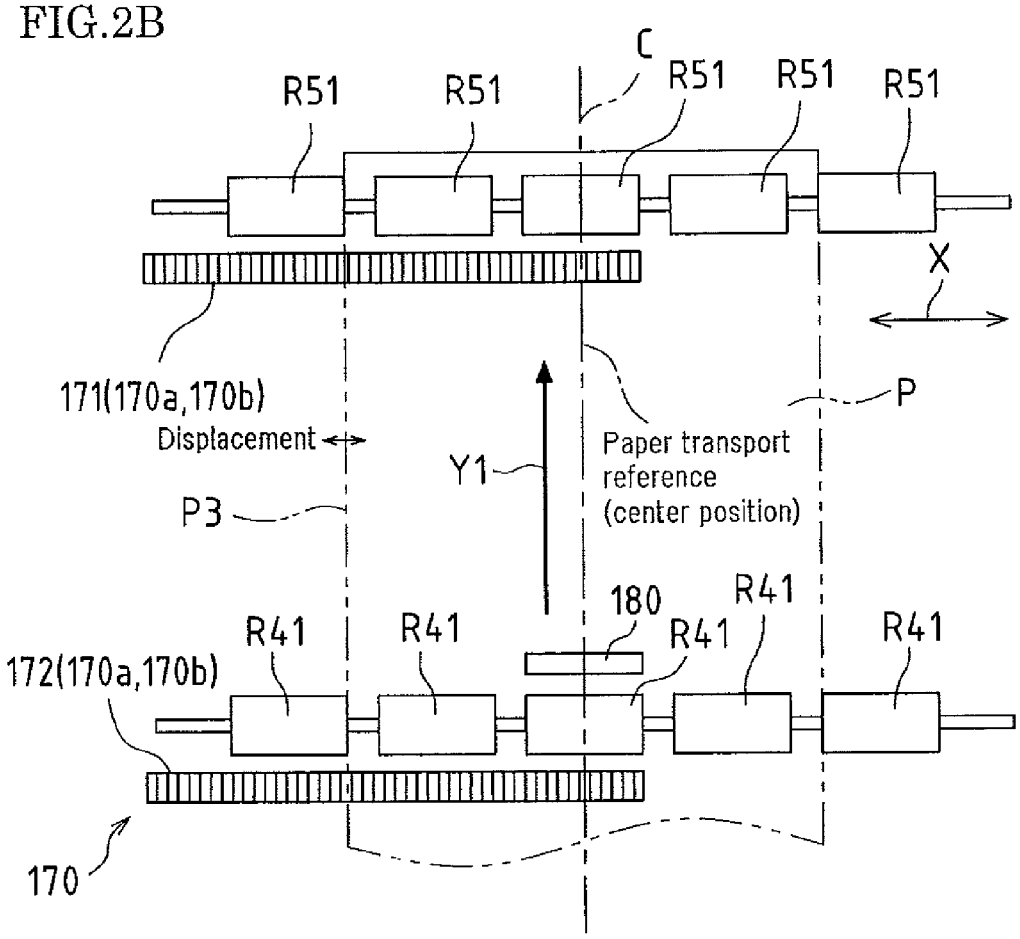

FIGS. 2A and 2B are explanatory views for illustrating a configuration for detecting paper P on the main transport path 76. FIG. 2A is a side view schematically showing an exemplary configuration of the sheet transport position detecting portion 170 and the sheet detecting portion 180, and FIG. 2B is a plan view schematically showing an exemplary configuration of the sheet transport position detecting portion 170 and the sheet detecting portion 180.

As shown in FIGS. 2A and 2B, the registration rollers R51 and R52 are arranged on the upstream side of the transfer nip portion N1 in the transport direction Y1. The sheet transport position detecting portion 170 is disposed on the upstream side of the registration rollers R51 and R52 in the transport direction Y1, and detects a paper transport position of the paper P on the main transport path 76.

In this embodiment, the sheet transport position detecting portion 170 includes a first sheet transport position detecting portion 171 that is disposed close to the registration rollers R51 and R52 on the upstream side of the registration rollers R51 and R52 in the transport direction Y1, and detects a paper transport position, and a second sheet transport position detecting portion 172 that is disposed on the upstream side of the first sheet transport position detecting portion 171 in the transport direction Y1, and detects a paper transport position.

More specifically, the second sheet transport position detecting portion 172 is disposed close to the pre-registration rollers R41 and R42 on the upstream side of the pre-registration rollers R41 and R42 in the transport direction Y1. The registration rollers R51 and R52 are arranged on the upstream side of the transfer nip portion N1 in the transport direction Y1. The pre-registration rollers R41 and R42 are arranged on the upstream side of the registration rollers R51 and R52 in the transport direction Y1. As shown in FIG. 2B, a plurality of pairs (five pairs, in this example) of registration rollers R51 and R52 and a plurality of pairs (five pairs, in this example) of pre-registration rollers R41 and R42 are arranged at predetermined intervals in a width direction X (horizontal direction in FIG. 2B) along the section of the diagram orthogonal to the transport direction Y1.

The first sheet transport position detecting portion 171 detects a paper transport position of the paper P on the main transport path 76 in a state where the paper P is sandwiched by the registration rollers R51 and R52 and the pre-registration rollers R41 and R42 and stopped. The second sheet transport position detecting portion 172 detects a paper transport position of the paper P that is being transported by the pre-registration rollers R41 and R42. In this example, the first and the second sheet transport position detecting portions 171 and 172 detect a displacement amount (off-center amount) from a preset paper transport reference (center position) C in the width direction X along the section of the diagram orthogonal to the transport direction Y1.

More specifically, the first and the second sheet transport position detecting portions 171 and 172 include light-emitting sections 170*a* and light-receiving sections 170*b*. In this example, the first and the second sheet transport position detecting portions 171 and 172 form a line sensor that is a CIS (contact image sensor) configured from the light-emitting sections (i.e., light-emitting line sensors) 170*a* and the light-receiving sections (i.e., light-receiving line sensors) 170*b* of a line sensor that employs a method of coupling using an array of equal magnification lenses that correspond to pixels lined up in a single line. The light-emitting sections 170*a* and the light-receiving sections 170*b* face each other with the main transport path 76 interposed therebetween (see FIG. 2A), and are arranged in the width direction X so as to be along the registration rollers R51 and R52 and the pre-registration rollers R41 and R42 (see FIG. 2B). The thus arranged first and second sheet transport position detecting portions 171 and 172 are formed so as to have a length that allows one side edge P3 in the width direction X of the paper P to be detected for minimum (e.g., postcard size) to maximum (e.g., A3 portrait size) widths of the transported paper P. Here, the first and the second sheet transport position detecting portions 171 and 172 may be a CCD sensor.

The sheet detecting portion 180 (i.e., a PIN sensor) detects presence or absence of the paper P (whether or not the paper P is being passing therethrough). The sheet detecting portion 180 is disposed close to the pre-registration rollers R41 and R42 on the downstream side of the pre-registration rollers R41 and R42 in the transport direction Y1.

Next, the configuration of a control system in the image forming apparatus 100 will be described with reference to FIG. 3.

Figure 3:
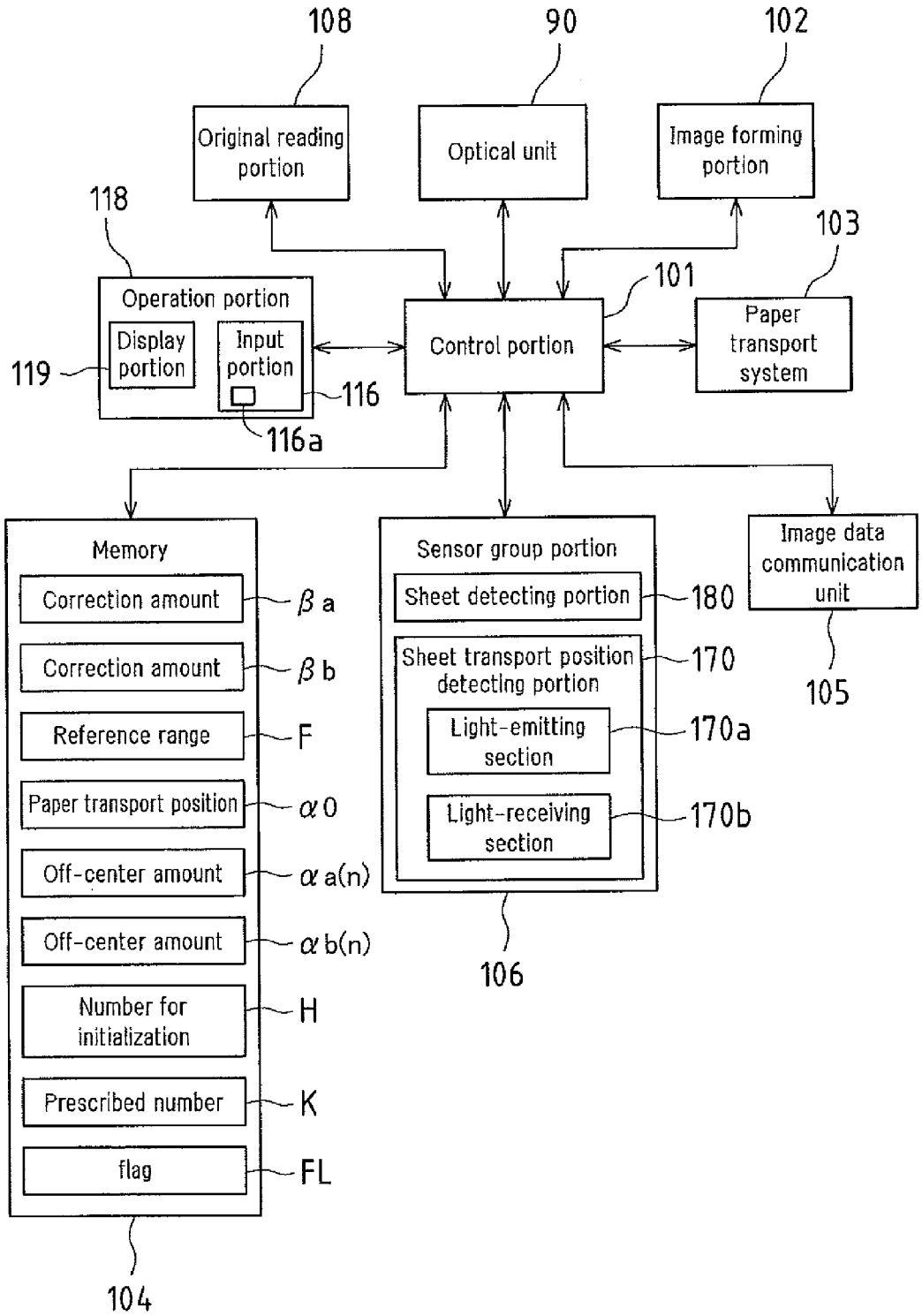
FIG. 3 is a block diagram showing a schematic configuration of a control system in the image forming apparatus according to an embodiment of the present technology.

FIG. 3 is a block diagram showing a schematic configuration of the control system in the image forming apparatus 100 according to an embodiment of the present technology.

The image forming apparatus 100 further includes a control portion 101 (i.e., a central processing unit) and a sensor group portion 106 that includes the sheet transport position detecting portion 170 and the sheet detecting portion 180. The control portion 101 performs sequence control to manage drive mechanism portions (not shown) of the original reading apparatus 108, the optical unit 90, the image forming portion 102, and the paper transport system 103 described above, and outputs control signals to each portion based on detected values of the sensor group portion 106 that includes the sheet transport position detecting portion 170 and the sheet detecting portion 180.

Furthermore, the image forming apparatus 100 further includes an operation portion 118, a memory 104, and an image data communication unit 105.

The operation portion 118, the memory 104, and the image data communication unit 105 are connected to the control portion 101 in a state such that they can communicate with each other.

When receiving input data such as various types of setting information on the entire image forming apparatus, information for operating the functions, and conditions of an image forming process through an input operation by an operator such as a user or service personnel, the operation portion 118 transmits the received input data to the control portion 101. In this example, the operation portion 118 is an operation panel disposed at the upper portion of the front face of an exterior cover on the image forming apparatus 100. The operation portion 118 includes a display portion 119 such as a display apparatus and an input portion 116 (see also FIG. 17 described later). In this example, the input portion 116 is a key input operation portion that has a plurality of input keys 116*a* and through which an operator performs key input operations. Furthermore, the display portion 119 displays input contents, operation instructions, or messages from the input portion 116, or the operation status of the entire apparatus. In this example, a touch panel that receives an input operation by an operator is provided as a display screen of the display portion 119. This touch panel functions as an input portion.

The memory 104 stores various types of control information necessary for controlling the image forming apparatus 100. More specifically, the memory 104 stores various types of data from correcting the image writing position (described later).

The image data communication unit 105 is a communication unit provided for enabling information communication of image information, image control signals, and the like to be performed with other digital image devices.

In the thus configured image forming apparatus 100, when controlling an image forming process according to the conditions of the image forming process set and input by a user through an operation using the operation portion 118, the control portion 101 operates the paper transport system 103 to temporarily stop the paper P in a state where the paper P is bowed, by keeping the leading edge P1 of the paper P contact with the nip portion N5 between the registration rollers R51 and R52, and rotating the pre-registration rollers R41 and R42 sandwiching the trailing edge P2 of the paper P based on detected values from the sheet detecting portion 180.

(Embodiment 1)

The control portion 101 is provided with a high speed correction mode that can improve the speed of an image forming process and a linear correction mode that can improve the precision of an image writing position, as correction modes for correcting the image writing position onto the photosensitive drums 3 with respect to the paper transport position of the paper P.

In the high speed correction mode, during a successive image forming process on a plurality of sheets of paper P, the paper transport position on the main transport path 76 is detected by the sheet transport position detecting portion 170 for a preset number of (one, or two or more) sheets of paper P among the plurality of sheets of paper P, a correction amount βa of the image writing position onto the photosensitive drums 3 is determined based on the detected paper transport position, the image writing position is corrected based on the determined correction amount βa, an image forming process is performed on the paper P that has been transported to the transfer nip portion N1 based on the corrected image writing position, and, other sheets of paper P on which an image forming process is to be performed after the preset number of sheets of paper P are subjected to an image forming process such that the process is performed on the paper P that has been transported to the transfer nip portion N1 based on the corrected image writing position.

In the linear correction mode, during a successive image forming process on a plurality of sheets of paper P, the paper transport position on the main transport path 76 is detected by the sheet transport position detecting portion 170 for the plurality of sheets of paper P, a correction amount βb of the image writing position onto the photosensitive drums 3 is determined based on the detected paper transport position, the image writing position is corrected based on the determined correction amount βb, and an image forming process is performed on the paper P that has been transported to the transfer nip portion N1 based on the corrected image writing position.

Here, the control portion 101 corrects the image writing position for each of the plurality of paper feed portions 80 independently of each other. That is to say, the control portion 101 corrects the image writing position in units of paper feed portions such as the paper feed trays 81 at a plurality of levels and the manual paper feed tray 82, and, thus, correction of the image writing position for each paper feed portion does not affect correction of the image writing position for another paper feed portion. Furthermore, the memory 104 is provided for each of the paper feed portions 80, and the memory 104 corresponding to the paper feed portion to which the paper P is fed stores data of a correcting process (described later) (i.e., a paper transport position α0, a correction amount (βa, etc.).

Then, the control portion 101 is configured so as to perform switching to either one of the high speed correction mode and the linear correction mode, according to the correction amount βb (see FIG. 9B described later) determined based on the paper transport position of the paper P (the paper P that has been fed and ready for image formation) detected by the sheet transport position detecting portion 170 at the time of image formation with respect to the correction amount βa (see FIG. 8B described later) determined based on the paper transport position detected for a preset number of sheets of paper P.

Here, the correction amount of the image writing position is determined based on a displacement amount of the paper transport position of the paper P detected by the sheet transport position detecting portion 170 with respect to the paper transport position of a preset number of sheets of paper P on the main transport path 76. Furthermore, in this example, the correction amount of the image writing position is a displacement amount in which, when writing the same image onto the same position of the photosensitive drums 3, displacement of an image formed on the front and the back faces of the paper P is a predetermined value (e.g., maximum 0.5 mm) or less.

In Embodiment 1, the control portion 101 has a configuration in which, if a difference value Δβ between the correction amount βa for the preset number of sheets of paper P and the correction amount βb for the paper P detected at the time of the image formation is within a preset reference range F (e.g., ±0.5 mm), switching is performed to the high speed correction mode, and, if the difference value is not within the reference range F, switching is performed to the linear correction mode. Here, the correction amounts βa and βb are stored and updated in the memory 104 according to the image writing position correcting process, and the reference range F is stored in the memory 104 in advance (see FIG. 3). Here, as the correction amount βa for the preset number of sheets of paper P, an initial value preset at the time of production or the like is initially stored in the memory 104.

According to the image forming apparatus 100 described above, in the case where switching is performed to the high speed correction mode, detection by the sheet transport position detecting portion 170 regarding the preset number of sheets of paper P is used regarding the image forming position at which an image is to be formed on the other sheets of paper P, and, thus, it is possible to perform image formation while correcting the image writing position of a plurality of sheets of paper P even in a high speed apparatus as in this embodiment. Accordingly, even in a high speed apparatus as in this embodiment, positional matching of the image forming position on the paper P and the image writing position onto the photosensitive drums 3 can be performed precisely at high speed. Furthermore, the correction amounts βa and βb are determined based on the displacement amount of the paper transport position of the paper P on the main transport path 76, and, thus, the image writing position can be corrected in any direction. As a result, it is possible to deal with displacement (displacement of the paper transport position in the width direction X, in this example) of the paper transport position on the main transport path 76 in any direction (e.g., paper transport position such as the width direction X or the transport direction Y1).

Moreover, since switching is performed to either one of the high speed correction mode and the linear correction mode according to the correction amount βb for the paper P detected at the time of the image formation with respect to the correction amount βa for the preset number of sheets of paper P, if the transport rollers R31 and R32, the pre-registration rollers R41 and R42, the registration rollers R51 and R52, and the like are expanded by heat generated by friction or the like, or the paper P is replenished to the paper feed trays 81 or the manual paper feed tray 82, so that the paper transport position is significantly displaced, switching is performed to the linear correction mode, and, thus, the corrected image writing position matches the proper image writing position (based on the actually detected paper transport position). Accordingly, even when the paper transport position of the paper P is suddenly significantly displaced, it is possible to obtain precise positional matching of the image forming position on the paper P and the image writing position onto the photosensitive drums 3.

Incidentally, in consideration of the influence of displacement caused by transport of the paper P to the registration rollers R51 and R52, the precision in detection of the paper transport position increases as the detection is performed at a position closer to the registration rollers R51 and R52 on the upstream side of the registration rollers R51 and R52. However, in a conventionally configured high speed apparatus, if the detection of the paper transport position is performed at a position too close to the registration rollers on the upstream side of the registration rollers, writing of the image information onto the photosensitive drum starts before detecting the paper transport position, and, thus, correction of the image writing position onto the photosensitive drum cannot be performed. Therefore, the writing of the image information onto the photosensitive drum has to be started after detecting the paper transport position at a position close to the registration rollers on the upstream side of the registration rollers, and the processing speed of image formation is accordingly lowered.

Regarding this aspect, in Embodiment 1, the sheet transport position detecting portion 170 is provided with the first sheet transport position detecting portion 171 that detects a paper transport position at a position close to the registration rollers R51 and R52 on the upstream side of the registration rollers R51 and R52 in the transport direction Y1, and the second sheet transport position detecting portion 172 that detects a paper transport position on the upstream side of the first sheet transport position detecting portion 171 in the transport direction Y1, and, thus, the first sheet transport position detecting portion 171 can detect a paper transport position at a position close to the registration rollers R51 and R52 on the upstream side of the registration rollers R51 and R52 in the transport direction Y1 in the high speed correction mode and the linear correction mode. Furthermore, the second sheet transport position detecting portion 172 can detect a paper transport position on the upstream side of the first sheet transport position detecting portion 171 in the transport direction Y1 before determining the switching between the high speed correction mode and the linear correction mode. That is to say, if the paper transport position is detected by the second sheet transport position detecting portion 172 on the upstream side of the first sheet transport position detecting portion 171 in the transport direction Y1, a value corresponding to the correction amount βb for the paper P whose paper transport position has been detected by the second sheet transport position detecting portion 172 at the time of the image formation with respect to the correction amount βa for the preset number of sheets of paper P can be obtained before starting the writing of the image information onto the photosensitive drums 3, and switching between the high speed correction mode and the linear correction mode can be performed before starting the writing of the image information onto the photosensitive drums 3. In order to precisely detect a paper transport position in the high speed correction mode, as in Embodiment 1, even if detection by the first sheet transport position detecting portion 171 is performed at a position close to the registration rollers R51 and R52 on the upstream side of the registration rollers R51 and R52 in the transport direction Y1, the writing of the image information onto the photosensitive drums 3 can be started before the first sheet transport position detecting portion 171 detects the paper transport position in the high speed correction mode, using the detection by the first sheet transport position detecting portion 171 regarding the preset number of sheets of paper P. Thus, the processing speed of image formation can be accordingly increased in the high speed correction mode.

For example, even in high speed transport that transports about two sheets of A4 landscape paper P per second in the high speed correction mode, the correction amount βa of the image writing position for the paper P temporarily stopped by the registration rollers R51 and R52 can be easily and reliably determined with time to spare.

Furthermore, since the switching between the high speed correction mode and the linear correction mode is determined using a difference value between the correction amount βa for the preset number of sheets of paper P and the correction amount βb for the paper P detected at the time of the image formation, switching to either one of the high speed correction mode and the linear correction mode can be easily performed with a simple calculation configuration that calculates the difference value Δβ, using the size (level) of the difference value Δβ as a trigger to perform switching between the high speed correction mode and the linear correction mode. Here, the reference range F may be set and changed in a setting mode for service simulation and the like. With this configuration, the level (degree) for switching between the high speed correction mode and the linear correction mode can be set according to the precision of positional matching required by a user.

Furthermore, the plurality of paper feed portions 80 that transport the paper P to the main transport path 76 are arranged on the upstream side of the registration rollers R51 and R52 in the transport direction Y1, and correction of the image writing position is performed for each of the plurality of paper feed portions 80 independently of each other, and, thus, the image writing position can be corrected for each of the plurality of paper feed portions 80 regardless of the function of the plurality of paper feed portions 80. As a result, an image can be properly formed on the paper P stored in the paper feed portions 80 regardless of which paper feed portion 80 the paper P is fed from.

Furthermore, the first sheet transport position detecting portion 171 performs detection of the paper transport position in a state where the paper P is stopped by the registration rollers R51 and R52, and, thus, the detection of the paper transport position can be performed in a state where displacement of transport of the paper P on the main transport path 76 has been eliminated, and displacement of the paper transport position due to the displacement of transport of the paper P can be suppressed.

Here, in Embodiment 1, in the linear correction mode, a detected value obtained by the first sheet transport position detecting portion 171 preferably used, but there is no limitation to this, and a detected value obtained by the second sheet transport position detecting portion 172 used for determining the switching between the high speed correction mode and the linear correction mode also may be used.

Control Example 1

Next, a control example 1 of an image writing position correcting process (automatic correction) according to Embodiment 1 will be described with reference to FIGS. 4 to 11. Here, in this control example 1, the displacement amount of the paper transport position of the paper P is an off-center amount of the paper transport position of the paper P in the width direction X orthogonal to the transport direction Y1. Furthermore, in this control example 1, a detected value obtained by the first sheet transport position detecting portion 171 is used in the linear correction mode.

At the time of production of the image forming apparatus 100, the image forming position is initialized as follows. At the beginning, the image writing position is set to an initial reference position (position that has not been adjusted immediately after production), and image formation (test printing) of image information 190*a* (see FIG. 4 described later) for a test pattern is performed on the paper P.

Figure 4:
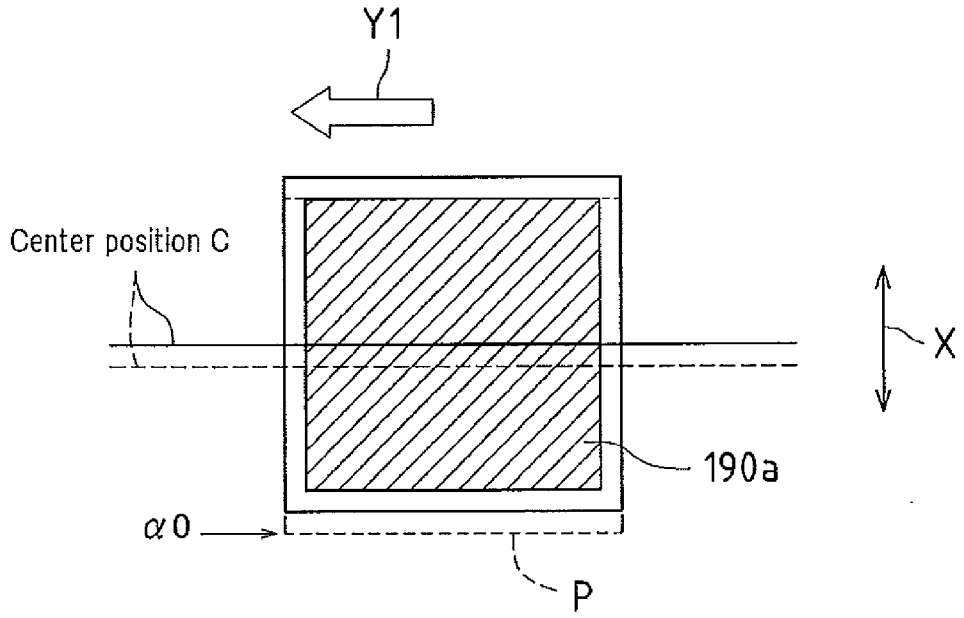
FIG. 4 is a schematic plan view showing image information for a test pattern formed on paper with the image writing position being set to an initial reference position when initializing the image forming position.

FIG. 4 is a schematic plan view showing the image information 190*a* for a test pattern formed on the paper P with the image writing position being set to an initial reference position when initializing the image forming position.

As shown in FIG. 4, if the paper P is transported in a state where a center position C of the paper P is displaced in one side in the width direction X (downward in FIG. 4) and the paper P is displaced in one side in the width direction X (see the broken line in FIG. 4) with respect to the preset paper transport position (see the solid line in FIG. 4), the operator measures a paper transport position α0 with the first sheet transport position detecting portion 171, and stores the position in the memory 104 (see FIG. 3).

Figure 5:
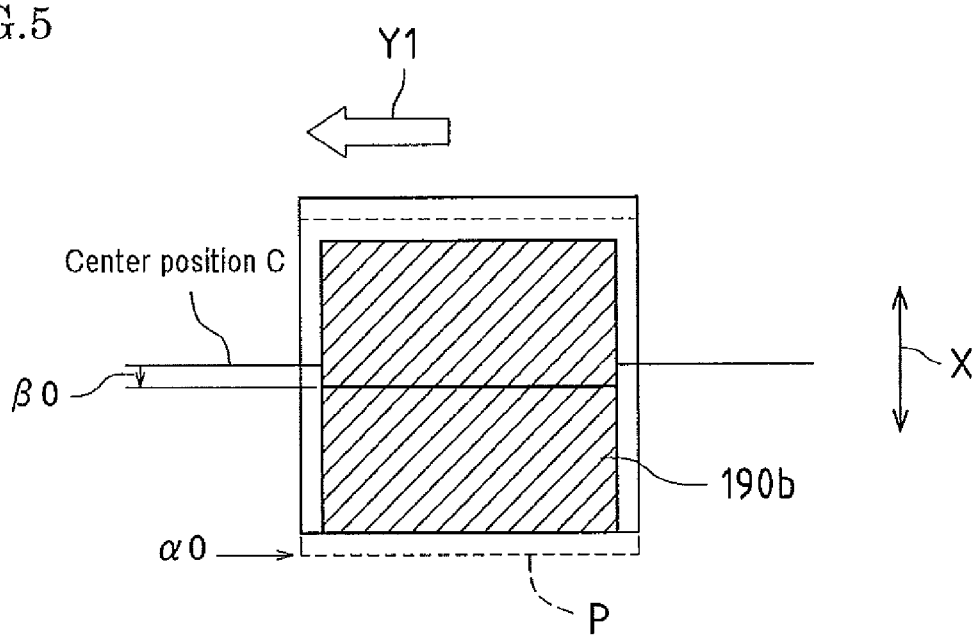
FIG. 5 is an explanatory view for illustrating a reference adjustment amount for the image writing position onto photosensitive drums, which is determined when initializing the image forming position.

FIG. 5 is an explanatory view for illustrating the reference adjustment amount β0 for the image writing position onto the photosensitive drums 3, which is determined when initializing the image forming position.

The operator who has stored the paper transport position α0 in the memory 104 visually observes the test printing adjusts the image writing position by determining the reference adjustment amount β0 for the image writing position onto the photosensitive drums 3 such that the image writing position of the image information 190*a* matches the image forming position at which an image is to be formed on the paper P (such that alignment is performed to the broken line in FIG. 5), and ends the initialization of the image forming position. Accordingly, the image writing position of adjusted image information 190*b* (see FIG. 5) is obtained. Here, the reference adjustment amount is the displacement amount from the initial reference position.

Note that the initialization of the image forming position can be performed for each of the plurality of paper feed portions 80 independently of each other.

As described above, the plurality of paper feed portions 80 include the paper feed trays 81 at a plurality of levels and the manual paper feed tray 82. The paper transport position α0 and the reference adjustment amount β0 are set for each of the plurality of paper feed portions 80 independently of each other through the above-described initialization. The image writing position correcting process at the time of image formation on the paper P is performed using the paper transport position α0 and the reference adjustment amount β0 that are set corresponding to a paper feed portion that feeds the paper P during the image forming process. Here, image formation (reprint) on the back face at the time of duplex image formation can be performed in a similar manner.

Next, the control example 1 of the image writing position correcting process according to Embodiment 1 will be described with reference to FIGS. 6 and 7.

Figure 6:
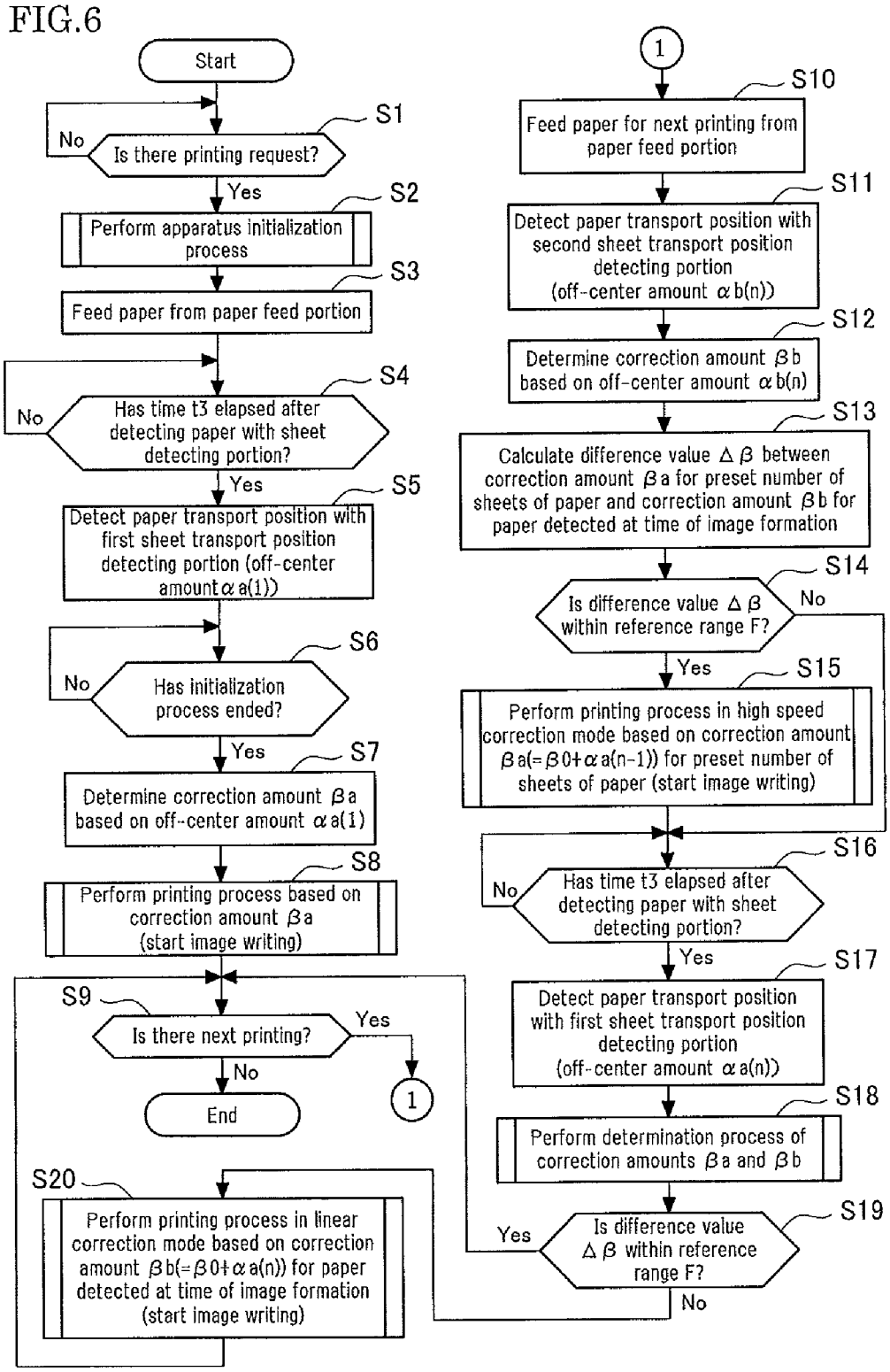
FIG. 6 is a flowchart showing a control example of the image writing position correcting process according to Embodiment 1.

FIG. 6 is a flowchart showing a control example of a correcting process of the image writing position according to Embodiment 1. Furthermore, FIG. 7 is a flowchart showing the sub routine of Step S18 "determination process of correction amounts βa and βb" in the flowchart shown in FIG. 6. Here, "n" indicating the number of sheets of paper P fed in the control example 1 shown in FIGS. 6 and 7 is an integer of 1 or more.

In the flowchart of the control example 1 shown in FIG. 6, first, if the image forming apparatus 100 is started, and an image forming (printing) request for a successive image forming process in a plurality of sheets of paper P is received through the operation of the operation portion 118 (Yes in Step S1), the control portion 101 starts an apparatus initialization process (initialization process regarding an image forming process) (Step S2). For example, in the photosensitive drums 3, an initialization process that adjusts the charge potential with the charging units 5, and removes toner dirt on the surface of the photosensitive drums 3 with the cleaning portions 4, for example, is started.

Next, the control portion 101 feeds a first sheet of paper P from one paper feed tray 81 (Step S3), sets the number n of sheets of paper to 1, transports the paper P along the main transport path 76 by the transport rollers R31 and R32 toward the transfer nip portion N1 between the transfer roller 10 and the intermediate transfer belt 61, detects the paper P transported toward the transfer nip portion N1 with the sheet detecting portion 180, and then temporarily stops the paper P in a state where the leading edge P1 is in contact with the registration rollers R51 and R52 and the trailing edge P2 is sandwiched by the pre-registration rollers R41 and R42. Then, a standby state is maintained until a time t3 has elapsed after the sheet detecting portion 180 detects the paper P (Step S4: No), and, if the time t3 has elapsed (Step S4: Yes), the paper transport position on the main transport path 76 for the first sheet (n=1) of paper P is detected by the first sheet transport position detecting portion 171 to measure the displacement amount from the initial position (off-center amount αa(n): n=1) (Step S5), and the off-center amount αa(n) (n=1) is stored in the memory 104. The off-center amount aa(n) is the distance between the paper transport position α0 at the time of initialization and a measured paper transport position ad (see FIG. 8A described later). Then, a standby state is maintained until the apparatus initialization process ends (Step S6: No), and, if the apparatus initialization process ends (Step S6: Yes), the procedure advances to Step S7.

Next, the control portion 101 determines the correction amount βa of the image writing position onto the photosensitive drums 3 at the first sheet transport position detecting portion 171 for the first sheet (n=1) of paper P, based on the displacement amount (off-center amount αa(n): n=1) from the initial position measured in Step S5 such that the of image information that is made visible on the photosensitive drums 3 image writing position (electrostatic latent image) matches the image forming position of the first sheet of paper P that is that is transported for the image formation (Step S7). More specifically, the correction amount βa is a value of [reference adjustment amount β0]+[off-center amount αa(n)] (n=1) (see FIG. 8B). At that time, the correction amount βa in the memory 104 is updated.

Here, the processes in Steps S5 and S7 will be further described with reference to FIGS. 8A and 8B.

Figure 8A:
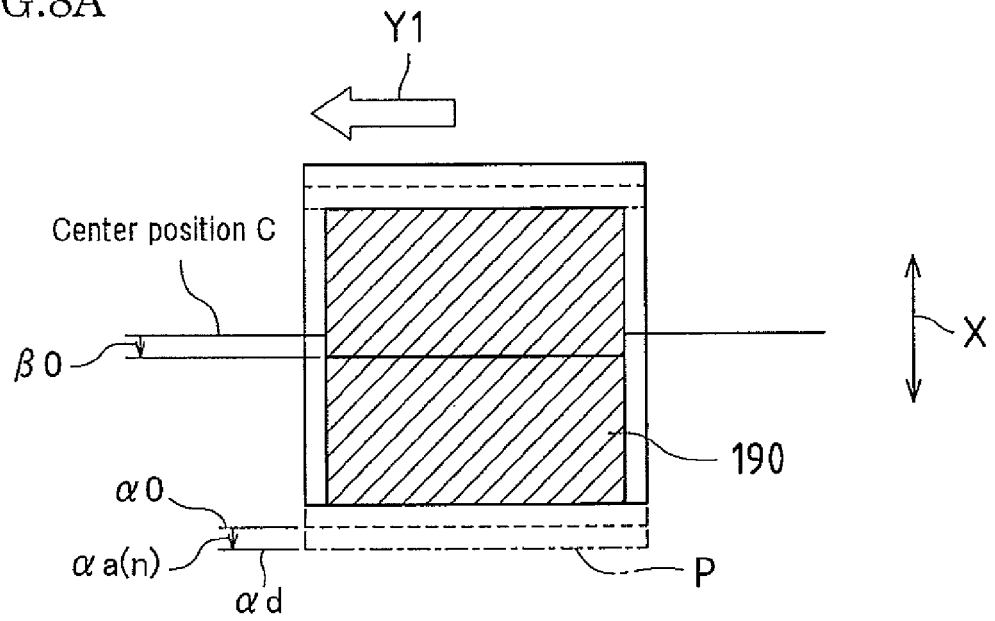
FIGS. 8A and 8B are schematic plan views showing image information detected by a first sheet transport position detecting portion in the control example 1, wherein FIG. 8A a view for illustrating an off-center amount of a measured paper transport position measured in the control example 1.
Figure 8B:
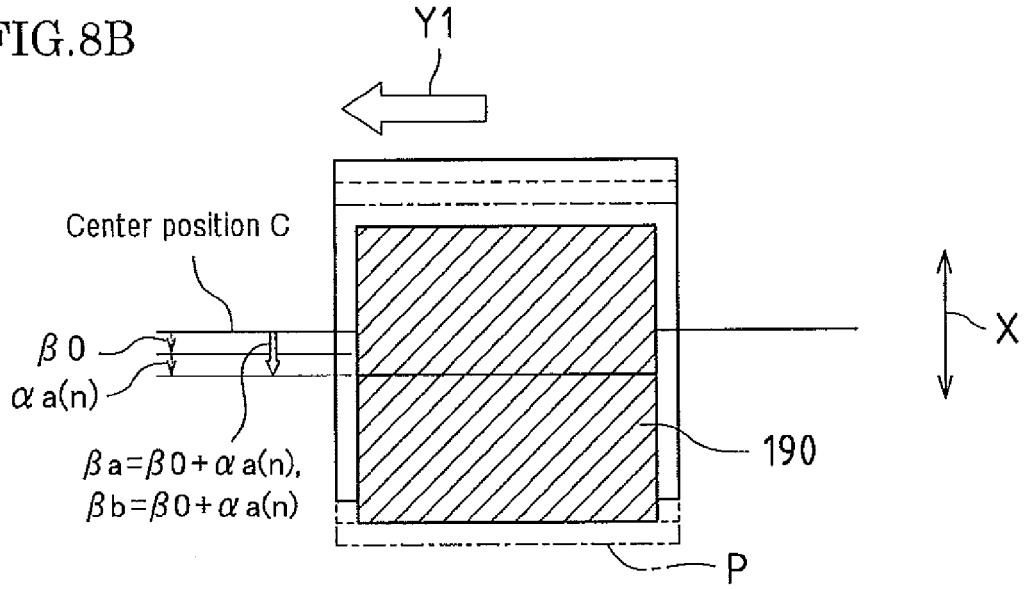

FIGS. 8A and 8B are schematic plan views showing image information 190 detected by the first sheet transport position detecting portion 171 in the control example 1. FIG. 8A is a view for illustrating the off-center amount αa(n) of the measured paper transport position measured in the control example 1, and FIG. 8B is a view for illustrating the correction amount βa of the image writing position onto the photosensitive drums 3 determined in the control example 1.

For example, as shown in FIG. 8A, if the paper P is transported in a state where the center position C of the paper P is displaced in one side in the width direction X (downward in FIG. 8A) with respect to the transport direction Y1 and the paper P is displaced in one side in the width direction X (see the dashed dotted line in FIG. 8A) with respect to the preset paper transport position (see the broken line in FIG. 8A), the displacement amount from the initial position is stored in the memory 104 as the off-center amount αa(n) (n=1). Then, as shown in FIG. 8B, a correction amount βa of the image writing position onto the photosensitive drums 3 (=β0+αa(n): n=1) is determined such that the image writing position of the image information 190 that is made visible on the photosensitive drums 3 matches the image forming position of the first sheet (n=1) of paper P that is transported for the image formation (such that alignment is performed to the dashed dotted line in FIG. 8B).

Then, the control portion 101 starts an image forming (printing) process based on the correction amount βa detected by the first sheet transport position detecting portion 171 (Step S8). That is to say, the image writing position is corrected based on the correction amount βa determined in Step S7, drive of the registration rollers R51 and R52 and the pre-registration rollers R41 and R42 is resumed to start transport of the first sheet (n=1) of paper P, and an image is formed on the first sheet (n=1) of paper P at the transfer nip portion N1 (printing process).

Next, the control portion 101 checks whether or not there is next image formation (printing) to be performed (Step S9). If there is next image formation (printing) to be performed, after the number n of sheets of paper is incremented (n←n+1), the next sheet, that is, a second sheet (n=2) of paper P is fed from the paper feed portions 80 (Step S10), and the fed paper P is transported toward along the main transport path 76 toward the transfer nip portion N1. Then, the paper transport position on the main transport path 76 for the second sheet (n=2) of paper P is detected by the second sheet transport position detecting portion 172 to measure the displacement amount from the initial position (off-center amount αb(n): n=2) (Step S11), and the off-center amount αb(n) (n=2) is stored in the memory 104. The off-center amount αb(n) is the distance between the paper transport position α0 at the time of initialization and the measured paper transport position αd (see FIG. 9A).

After Step S11, the control portion 101 determines the correction amount βb of the image writing position onto the photosensitive drums 3 at the second sheet transport position detecting portion 172 for the second sheet (n=2) of paper P, based on the displacement amount from the initial position (off-center amount αb(n): n=2) measured in Step S11 such that the image writing position of the image information that is made visible on the photosensitive drums 3 matches the image forming position of the second sheet (n=2) of paper P that is transported for the image formation (Step S12). More specifically, the correction amount βb is a value of [reference adjustment amount β0]+[off-center amount αb(n)](n=2) (see FIG. 9B). At that time, the correction amount βb in the memory 104 is updated.

Here, the processes in Steps S11 and S12 will be further described with reference to FIGS. 9A and 9B.

Figure 9A:
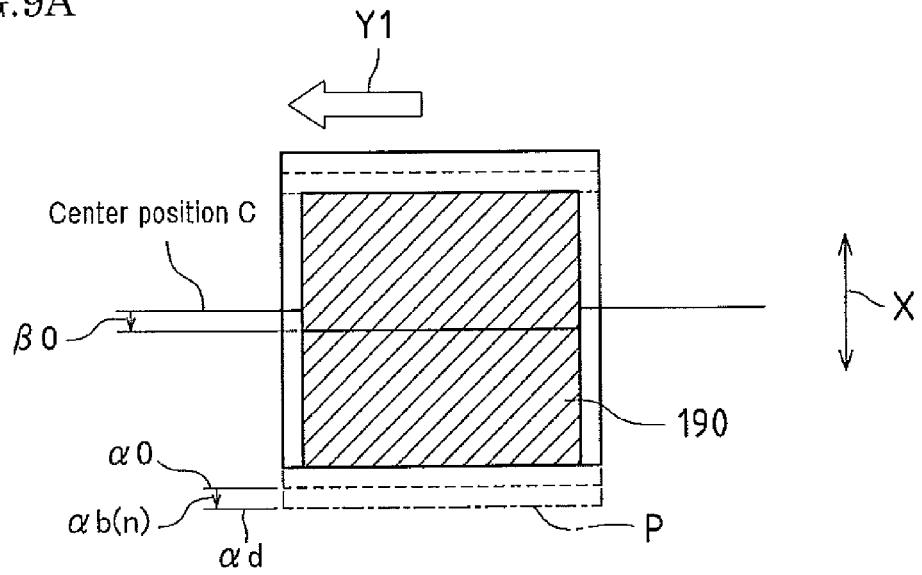
Figure 9B:
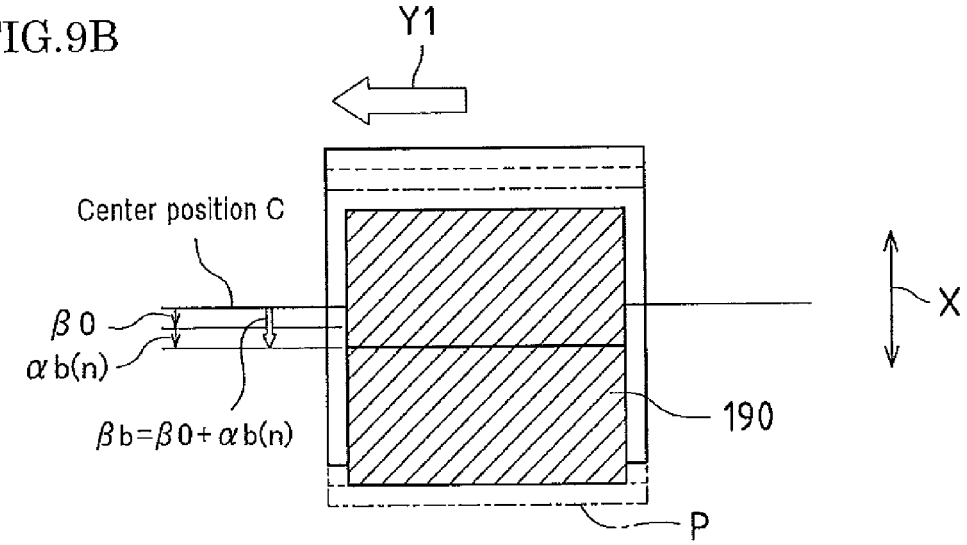

FIGS. 9A and 9B are schematic plan views showing the image information 190 detected by the second sheet transport position detecting portion 172 in the control example 1. FIG. 9A is a view for illustrating the off-center amount ab(n) measured paper transport position measured in the control example 1, and FIG. 9B is a view for illustrating the correction amount βb of the image writing position onto the photosensitive drums 3 determined in the control example 1.

For example, as shown in FIG. 9A, if the paper P is transported in a state where the center position C of the paper P is displaced in one side in the width direction X (downward in FIG. 9A) with respect to the transport direction Y1 and the paper P is displaced in one side in the width direction X (see the dashed dotted line in FIG. 9A) with respect to the preset paper transport position (see the broken line in FIG. 9A), the displacement amount from the initial position is stored in the memory 104 as the off-center amount αb(n). Then, as shown in FIG. 9B, a correction amount βb of the image writing position onto the photosensitive drums 3 is determined such that the image writing position of the image information 190 that is made visible on the photosensitive drums 3 matches the image forming position of the second sheet (n=2) of paper P that is transported for the image formation (such that alignment is performed to the dashed dotted line in FIG. 9B), Then, the difference value Δβ between the correction amount βa for the preset number of sheets of paper P and the correction amount βb for the paper P whose paper transport position has been detected by the second sheet transport position detecting portion 172 at the time of the image formation is calculated (Step S13), and it is determined whether or not the difference value Δβ is within the reference range F (Step S14).

If the difference value Δβ is not within the reference range F (Step S14: No), the procedure advances to Step S16. On the other hand, if the difference value Δβ is within the reference range F (Step S14: Yes), the image writing position is corrected in the high speed correction mode based on the correction amount βa (=β0 +αa(n−1): n=2) detected by the first sheet transport position detecting portion 171 at the previous sheet, that is, the first sheet (n−1: n=2) of paper P (a preset number of sheets of paper P) determined in Step S7, an image forming (printing) process is started for the second sheet (n=2) of paper based on the image writing position corrected in the high speed correction mode (Step S15), and the procedure advances to Step S16.

Next, a standby state is maintained until the time t3 has elapsed after the sheet detecting portion 180 detects the paper P (Step S16: No), and, if the time t3 has elapsed (Step S16: Yes), the paper transport position on the main transport path 76 for the second sheet (n=2) of paper P is detected by the first sheet transport position detecting portion 171 to measure the displacement amount from the initial position (the off-center amount αa(n): n=2) (Step S17), the off-center amount αa(n) (n=2) is stored in the memory 104.

Figure 7:
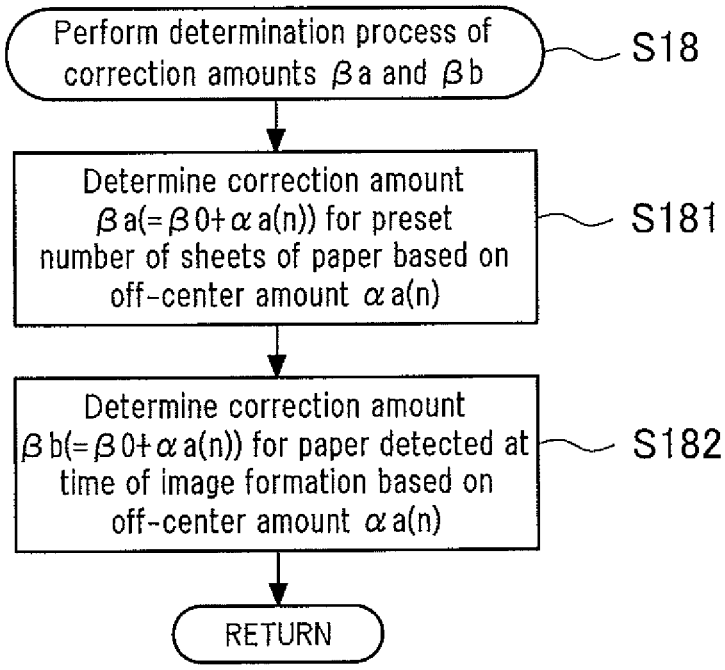
FIG. 7 is a flowchart showing the sub routine of Step "determination process of correction amounts" in the flowchart shown in FIG. 6.

After the process in Step S17, in the sub routine of Step S18 shown in FIG. 7, the control portion 101 determines the correction amount βa (=β0+αa(n): n=2) of the image writing position onto the photosensitive drums 3 at the preset number of sheets of paper P for the second sheet (n=2) of paper P, based on the displacement amount from the initial position (the off-center amount αa(n): n=2) measured in Step S17 such that the image writing position of the image information that is made visible on the photosensitive drums 3 matches the image forming position of the second sheet (n=2) of paper P that is transported for the image formation (Step S181), and determines the correction amount βb (=β0+αa(n): n=2) detected by the first sheet transport position detecting portion 171 at the paper P detected at the time of the image formation (Step S182) (see FIG. 8B). At that time, the correction amounts βa and βb in the memory 104 are updated. Then, the procedure returns to Step S19 in FIG. 6.

Next, it is determined whether or not the difference value Δβ is within the reference range F (Step S19). If the difference value Δβ is within the reference range F (Step S19: Yes), the procedure advances to Step S9. On the other hand, if the difference value Δβ is not within the reference range F (Step S19: No), the image writing position is corrected in the linear correction mode based on the correction amount βb (=β0+αa (n): n=2) detected by the first sheet transport position detecting portion 171 at the currently processed second sheet (n=2) of paper P (the paper P detected at the time of the image formation) determined in Step S18, an image forming (printing) process is started for the second sheet (n=2) of paper P based on the image writing position corrected in the linear correction mode (Step S20), and the procedure advances to Step S9.

Next, the control portion 101 checks whether or not there is next image formation (printing) to be performed (Step S9). If there is next image formation (printing) to be performed, after the number n of sheets of paper is incremented (n←n+1), the next sheet, that is, a next third sheet (n=3) of paper P is fed from the paper feed portions 80 (Step S10), and the fed paper P is transported toward along the main transport path 76 toward the transfer nip portion N1. Then, the paper transport position on the main transport path 76 for the third sheet (n=3) of paper P is detected by the second sheet transport position detecting portion 172 to measure the displacement amount from the initial position (off-center amount αb(n): n=3) (Step S11), and the off off-center amount αb(n) (n=3) is stored in the memory 104.

Next, the control portion 101 determines the correction amount βb (=β0+αb(n): n=3) of the image writing position onto the photosensitive drums 3 at the second sheet transport position detecting portion 172 for the third sheet (n=3) of paper P, based on the displacement amount from the initial position (off-center amount αb(n): n=3) measured in Step S11 such that the image writing position of the image information that is made visible on the photosensitive drums 3 matches the image forming position of the third sheet (n=3) of paper P that is transported for the image formation (Step S12). At that time, the correction amount βb in the memory 104 is updated.

Then, the difference value Δβ between the correction amount βa for the preset number of sheets of paper P and the correction amount βb for the paper P detected at the time of the image formation is calculated (Step S13), and it is determined whether or not the difference value Δβ is within the reference range F (Step S14).

If the difference value Δβ is not within the reference range F (Step S14: No), and the procedure advances to Step S16. On the other hand, if the difference value Δβ is within the reference range F (Step S14: Yes), the image writing position is corrected in the high speed correction mode based on the correction amount βa (=β0+αa(n−1): n=3) detected by the first sheet transport position detecting portion 171 at the previous sheet, that is, the second sheet (n−1: n=3) of paper P (a preset number of sheets of paper P) determined in Step S7, an image forming (printing) process is started for the third sheet (n=3) of paper based on the image writing position corrected in the high speed correction mode (Step S15), and the procedure advances to Step S16.

Next, a standby state is maintained until the time t3 has elapsed after the sheet detecting portion 180 detects the paper P (Step S16: No), and, if the time t3 has elapsed (Step S16: Yes), the paper transport position on the main transport path 76 for the third sheet (n=3) of paper P is detected by the first sheet transport position detecting portion 171 to measure the displacement amount from the initial position (the off-center amount αa(n): n=3) (Step S17), and the off-center amount αa(n) (n=3) is stored in the memory 104.

After the process in Step S17, in the sub routine of Step S18 shown in FIG. 7, the control portion 101 determines the correction amount βa (=β0+αa(n): n=3) of the image writing position onto the photosensitive drums 3 at the preset number of sheets of paper P is determined for the third sheet (n=3) of paper P, based on the displacement amount from the initial position (the off-center amount αa(n): n=3) measured in Step S17 such that the image writing position of the image information that is made visible on the photosensitive drums 3 matches the image forming position of the third sheet (n=3) of paper P that is transported for the image formation (Step S181), and determines the correction amount βb (=β0+αa(n): n=3) detected by the first sheet transport position detecting portion 171 at the paper P detected at the time of the image formation (Step S182) (see FIG. 8B). At that time, the correction amounts βa and βb in the memory 104 are updated. Then, the procedure returns to Step S19 in FIG. 6.

Next, it is determined whether or not the difference value Δβ is within the reference range F (Step S19). If the difference value Δβ is within the reference range F (Step S19: Yes), the procedure advances to Step S9. On the other hand, if the difference value Δβ is not within the reference range F (Step S19: No), the image writing position is corrected in the linear correction mode based on the correction amount βb (=β0+αa (n): n=3) detected by the first sheet transport position detecting portion 171 at the currently processed the third sheet (n=3) of paper P (the paper P detected at the time of the image formation) determined in Step S18, an image forming (printing) process is started for the third sheet (n=3) of paper P based on the image writing position corrected in the linear correction mode (Step S20), and the procedure advances to Step S9.

In a similar manner, the control portion 101 repeats the processes in Steps S9 to S20 also for the fourth and subsequent sheets of paper P, and controls the correction of the image writing position onto the photosensitive drums 3 with respect to the paper transport position of the paper P.

Here, in the flowchart shown in FIG. 6, the processes in Steps S19 and S20 and the process in Step S182 in FIG. 7 may be deleted, and a process may be added between the determination (No) of the process in Step S14 and the process in Step S16 that corrects the image writing position in the linear correction mode based on the correction amount βb (=β0+αb (n)) at the second sheet transport position detecting portion 172 determined in Step S12 and starts an image forming (printing) process for the paper P based on the image writing position corrected in the linear correction mode.

Figure 10:
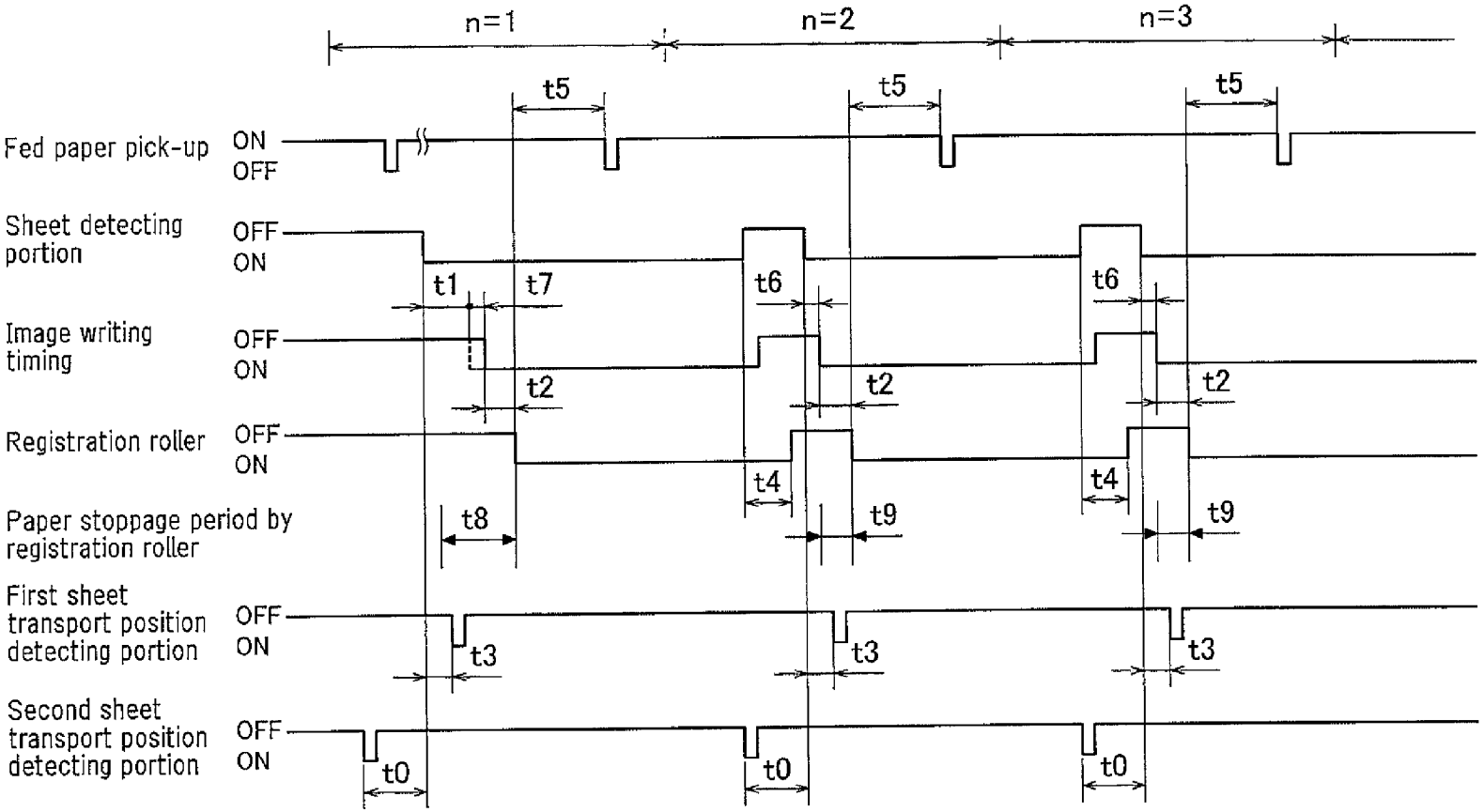
FIG. 10 is a timing chart showing detection timings of the respective detecting portions in a high speed correction mode in this control example 1.
Figure 11:
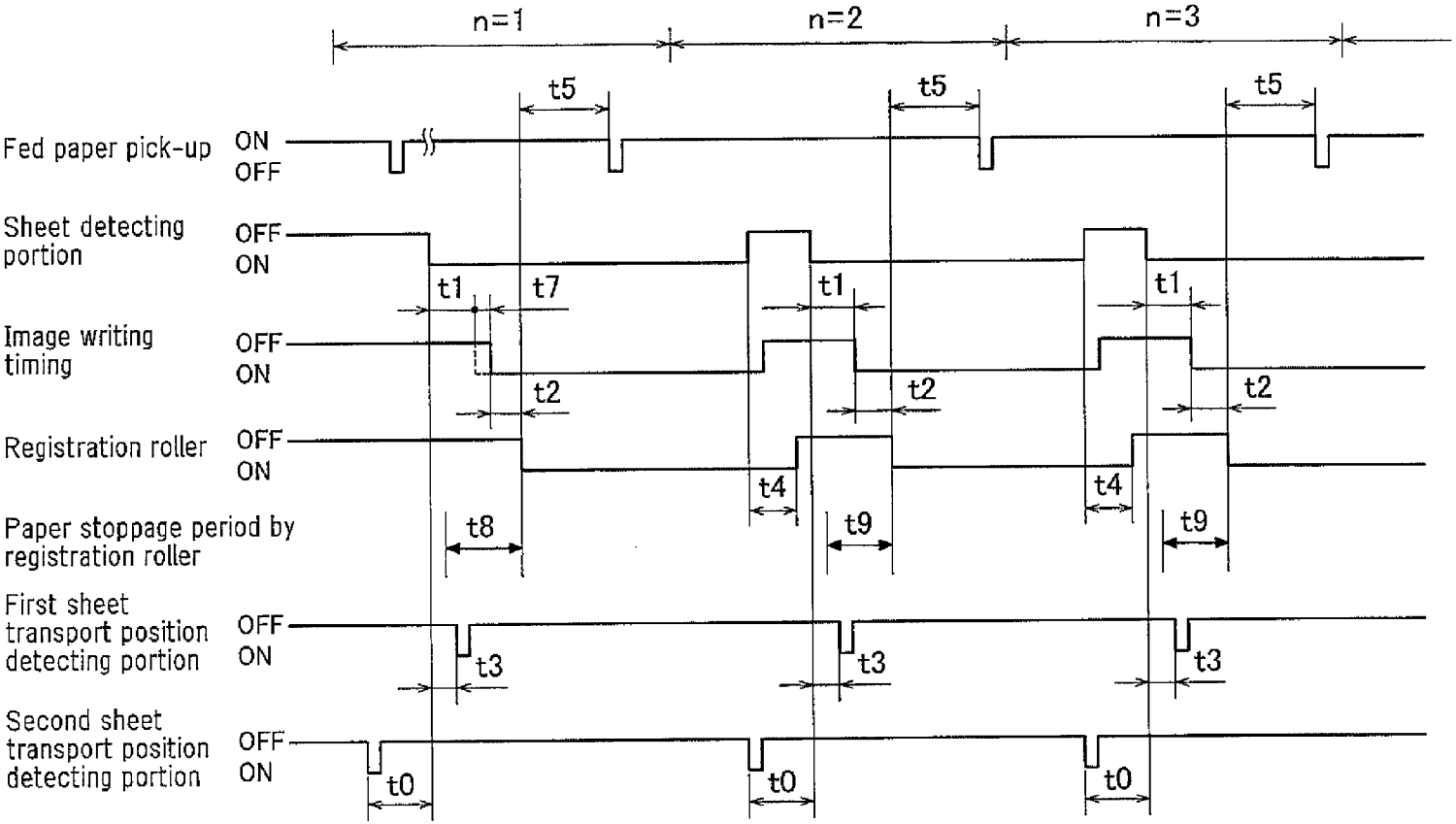
FIG. 11 is a timing chart showing detection timings of the respective detecting portions in a linear correction mode in this control example 1.

FIGS. 10 and 11 are timing charts showing relationship between ON/OFF of fed paper pick-up detection by the paper feed rollers 11*a*, ON/OFF of paper detection by the sheet detecting portion 180, ON/OFF timing of writing of the image information onto the photosensitive drums 3 using a laser, ON/OFF of drive of the registration rollers R51 and R52 for transport, ON/OFF of paper transport position detection by the first sheet transport position detecting portion 171, and ON/OFF of paper transport position detection by the second sheet transport position detecting portion 172, respectively in the high speed correction mode and the in the linear correction mode in this control example 1.

Times t0 to t9 shown in FIGS. 10 and 11 are as follows. That is to say, time t0 refers to a time from when a paper transport position is detected by the second sheet transport position detecting portion 172 to when paper is detected by the sheet detecting portion 180, time t1 refers to a time from when the paper is detected by the sheet detecting portion 180 to when an image is written, time t2 refers to a time from when the image is written to when the paper P is transported by the registration rollers R51 and R52, time t3 refers to a time from when the paper is detected by the sheet detecting portion 180 to when the paper transport position is detected by the first sheet transport position detecting portion 171, time t4 refers to a time from when the trailing edge P2 of a second or subsequent sheet of paper P is detected by the sheet detecting portion 180 to when the transport of the paper is stopped by the registration rollers R51 and R52, time t5 refers to a time from when the paper is transported by the registration rollers R51 and R52 to when pick up of the fed paper by the paper feed rollers 11*a* is started, time t6 refers to a time from when the second or subsequent sheet of paper is detected by the sheet detecting portion 180 to when an image is written, time t7 refers to a delay time with respect to the time t1 caused by initialization of the apparatus, time t8 refers to a period during which the registration rollers R51 and R52 are stopped for the first sheet of paper P, and time t9 refers to a period during which the registration rollers R51 and R52 are stopped for the second or subsequent sheet of paper P.

As shown in FIG. 10, according to this control example 1, a detected value for the first sheet of paper P is used in the high speed correction mode. Thus, contrary to the linear correction mode shown in FIG. 11, the image information is written using a laser onto the photosensitive drums 3 for the second or subsequent sheet of paper P earlier than the timing when the paper transport position is detected by the first sheet transport position detecting portion 171. Accordingly, regarding periods t8 and t9 during which the registration rollers R51 and R52 are stopped from when the paper transport position is detected by the first sheet transport position detecting portion 171 to when the registration rollers R51 and R52 are driven for transport, the stoppage period t9 for the second or subsequent sheet of paper P can be made shorter than the stoppage period t8 for the first sheet of paper P. Furthermore, the stoppage period t8 for the first sheet of paper P can be overlapped with the initialization process (start-up time) of the apparatus itself or the like, and the stoppage period t8 for the first sheet of paper P can be effectively used. Furthermore, a detected value for the first sheet of paper P is used for the second or subsequent sheet of paper P, and, thus, the stoppage period t9 does not have to be long, and a configuration suitable for a high speed apparatus can be achieved.

On the other hand, in the linear correction mode shown in FIG. 11, contrary to the high speed correction mode, the image information is written using a laser onto the photosensitive drums 3 after the paper transport position is detected by the first sheet transport position detecting portion 171. Thus, the necessary time becomes accordingly longer, but the image forming position of the paper P matches the proper image writing position (based on the actually detected paper transport position), and, thus, the precision of positional matching of the image forming position on the paper P and the image writing position onto the photosensitive drums 3 can be substantially the reading precision of the first sheet transport position detecting portion 171 (e.g., an error of 0.127 mm at the 200 dpi reading precision).

Then, with the switching between the high speed correction mode and the linear correction mode according to the correction amount βb for the paper P detected at the time of the image formation with respect to the correction amount βa for the preset number of sheets of paper P, even when the paper transport position of the paper P is suddenly significantly displaced, precise positional matching of the image forming position on the paper P and the image writing position onto the photosensitive drums 3 can be obtained.

Here, in this control example 1, as shown in FIGS. 10 and 11, the paper transport position is detected by the first sheet transport position detecting portion 171 for all sheets of paper P, but there is no limitation to this, and the paper transport position is detected by the first sheet transport position detecting portion 171 may be performed only for any necessary sheets of paper P.

(Embodiment 2)

Incidentally, the paper transport position of the paper P that has been temporarily stopped by the registration rollers R51 and R52 is not necessarily the same between a previously transported sheet and its subsequent sheet of paper P, and slight displacement may occur. In Embodiment 2, in consideration of this aspect, an average value is obtained by averaging detected values of the paper transport position of successively transported sheets of paper P, thereby absorbing such slight displacement between sheets of paper P, and determining a more precise correction amount of the image writing position.

In Embodiment 2, the control portion 101 is configured so as to use, as a correction amount βa of the image writing position, a calculated value obtained based on an average value αav obtained by averaging displacement amounts of the paper transport position of a preset number of sheets of paper P that are transported from the same paper feed portion 80 (e.g., the paper feed tray 81 at the same level, etc.) in the high speed correction mode in the configuration of Embodiment 1.

According to Embodiment 2, a calculated value obtained based on the average value αav obtained by averaging displacement amounts a preset number of sheets of paper P that are transported from the same paper feed portion 80 (e.g., the paper feed tray 81 at the same level, etc.) in the high speed correction mode is used as the correction amount βa of the image writing position, and, thus, the precision of the positional matching of the image forming position on the paper P and the image writing position onto the photosensitive drums 3 can be improved with a simple calculation configuration.

Control Example 2

Next a control example 2 of an image writing position correcting process according to Embodiment 2 will be described with reference to FIGS. 6 and 12.

This control example 2 is provided with the sub routine shown in FIG. 12 instead of the sub routine shown in FIG. 7 in the flowchart shown in FIG. 6.

FIG. 12 is a flowchart showing the sub routine of "determination process of correction amounts βa and βb" of the control example 2 of the correcting process according to Embodiment 2.

Here, in this control example 2, aspects different from those in the flowchart shown in FIG. 6 will be mainly described.

In the sub routine of "determination process of correction amounts βa and βb" shown in FIG. 12, after the process in Step S17, the control portion 101 calculates αav=(αa(1)+αa(2)+ . . . +αa(n))/n using the off-center amount αa(n) (Step S181*a*), determines the correction amount βa (=β0+αav) of the image writing position onto the photosensitive drums 3 at the preset number of sheets of paper P for an nth sheet of paper P based on the average value αav, which is the result of the calculation (Step S182*a*), and determines the correction amount βb (=β0+αa(n)) at the paper P detected at the time of the image formation based on the off-center amount αa(n) (Step S183*a*). At that time, the correction amounts βa and βb in the memory 104 are updated. Then, the procedure returns to Step S19 in FIG. 6.

Here, the preset number of sheets of paper P that are to be used for the process is not limited to sheets of paper P successively transported as shown in this control example 2, and the number may be feely set, for example, to every other sheet (odd-numbered sheets or even-numbered sheets) of paper P, one sheet to 10 to 30 sheets of paper P (see a control example 3 described later), two to eight sheets of paper P, any set number of sheets of paper P.

(Embodiment 3)

Incidentally, the paper transport position of the paper P that has been temporarily stopped by the registration rollers R51 and R52 is highly likely to be gradually displaced over time. This displacement does not cause or seldom causes extreme difference between the paper transport positions of a previously transported sheet of paper P and its subsequent sheet of paper P, but, for example, considerable degree of displacement may occur between the first sheet and the 31st sheet. More specifically, in successive image formation for a large number of sheets (i.e., large volume printing for more than 500 sheets), the registration rollers R51 and R52 may be thermally expanded by heat generated by friction with the paper P, and this thermal expansion or the like may gradually change the paper transport position, and, thus, when continuing to use a value obtained in an early stage for calculating the average value, the precision may become poor. In Embodiment 3, in consideration of this aspect, the calculation process of average value is initialized for every constant number of sheets.

In Embodiment 3, the control portion 101 is configured so as to initialize the average value αav for every group of a preset number H (e.g., 30 sheets) of sheets for initialization in the configuration of Embodiment 2.

According to Embodiment 3, even when the paper transport position is gradually changed by thermal expansion or the like, the precision of the average value αav can be effectively prevented from deteriorating.

Control Example 3

Next, a control example 3 of an image writing position correcting process according to Embodiment 3 will be described with reference to FIGS. 6 and 13.

This control example 3 is provided with the sub routine shown in FIG. 13 instead of the sub routine shown in FIG. 7 in the flowchart shown in FIG. 6.

FIG. 13 is a flowchart showing the sub routine of "determination process of correction amounts βa and βb" of the control example 3 of the correcting process according to Embodiment 3.

Here, in this control example 3, aspects different from those in the flowchart shown in FIG. 6 will be mainly described.

In this control example 3, the number H of sheets for initialization (e.g., 30 sheets) is stored in the memory 104 in advance (see FIG. 3). Here, the number H of sheets for initialization may be set and changed in a setting mode for service simulation and the like.

In this control example 3, the number H of sheets for initialization is set to 30 sheets. That is to say, in this control example 3, sheets for image formation, on which an image forming request has been given, are grouped into every H sheets (=30 sheets), and the calculation process of the average value αav is initialized for every H sheets (=30 sheets).

In the sub routine of "determination process of correction amounts βa and βb" shown in FIG. 13, after the process in Step S17, the control portion 101 determines whether or not the number n of sheets of paper exceeds H sheets (=30 sheets), which is the number for one group (Step S181*b*). If the number n of sheets of paper does not exceed H sheets (Step S181*b*: No), the control portion 101 calculates αav=(αa(1)+αa(2)+ . . . +αa(n))/n using the off-center amount αa(n) (Step S182*b*), determines the correction amount βa (=β0+αa(n)) of the image writing position onto the photosensitive drums 3 at the preset number of sheets of paper P for an nth sheet of paper P based on the average value αav, which is the result of the calculation (Step S183*b*), and determines the correction amount βb (=β0+αa(n)) at the paper P detected at the time of the image formation based on the off-center amount aa(n) (Step S184*b*). At that time, the correction amounts βa and βb in the memory 104 are updated. Then, the procedure returns to Step S19 in FIG. 6.

On the other hand, if the number n of sheets of paper exceeds H sheets (=30 sheets), which is the number for one group in Step S181*b*, (if the paper is the {(multiple of H)+1}th sheet) (Step S181*b*: Yes), after the initialization process that sets the number n of sheets of paper to 1, and substitutes αa (H) (H=30), which is a detected value for the immediately preceding sheet (the Hth sheet) of paper P, for αa(n) (n=1) (Step S185*b*), αa (1) to αa (H), which represent a previous history stored in the memory 104, are erased (set to 0), and the off-center amount αa (1) is stored in the memory 104. Then, the correction amount βa (=β0+αa (1)) of the image writing position onto the photosensitive drums 3 at the preset number of sheets of paper P is determined for the {(multiple of H)+1}th sheet first sheet of paper P based on the off-center amount αa (1) (=αa (H)) (Step S186*b*), and the procedure advances to Step S184*b*. At that time, the correction amount βa in the memory 104 is updated. Then, after the process in Step S184*b*, the procedure returns to Step S19 in FIG. 6. That is to say, the process in Step S186*b* is a process that substantially regards a (multiple of H)th sheet as a first sheet of a new group.

Here, in Embodiments 2 and 3, all off-center amounts αa (1), αa (2), . . . , αa(n) detected by the first sheet transport position detecting portion 171 are used to calculate the average value αav of all of these detected values. However, for example, if sheets of paper are fed with only one of the sheets significantly displaced due to the paper feed state to the paper feed trays 81, or if a currently transported sheet of paper P is displaced during transport on the main transport path 76, a detection value for that paper P by the first sheet transport position detecting portion 171 is highly likely to be significantly different from other detected values. Accordingly, if this detected value significantly different from other detected values is used to measure the average value αav of all detected values, the average value αav shifts toward the significantly different detected value, and the precision of the correction amount of the image writing position becomes poor.

Thus, in Embodiments 2 and 3, the control portion 101 is preferably configured so as to, if the difference value Δβ between the correction amount βa for the preset number of sheets of paper P and the correction amount βb for the paper P whose paper transport position has been detected by the second sheet transport position detecting portion 172 at the time of the image formation is not within the preset reference range F, exclude, from data for the average value, the displacement amount of the paper transport position corresponding to the correction amount βa that causes the difference value Δβ not to be within the reference range F.

Figure 14:
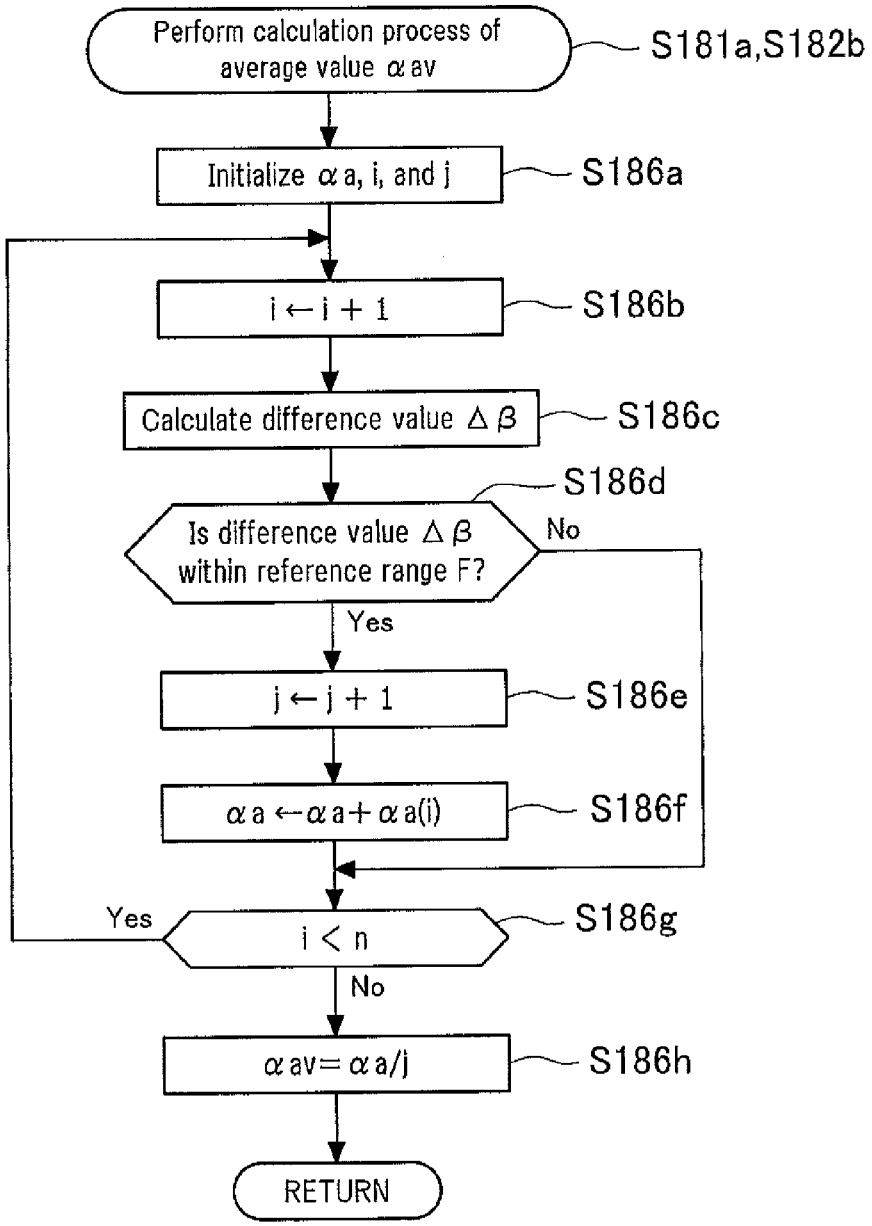
FIG. 14 is a flowchart for excluding, from data for the average value, displacement amounts of the paper transport position corresponding to a correction amount that causes the difference value not to be within the preset reference range if the difference value is not within the preset reference range in the sub routine of "calculation process of average value" of the control examples 2 and 3.

FIG. 14 is a flowchart for excluding, from data for the average value, the displacement amount of the paper transport position corresponding to the correction amount βa that causes the difference value Δβ not to be within the reference range F if the difference value Δβ is not within the preset reference range F in the sub routine of "calculation process of average value αav" of the control examples 2 and 3.

As shown in FIG. 14, in Steps S181*a* and S182*b* "calculation process of average value αav", first, an initialization process is performed that substitutes the off-center amount αa (1) for a total value αa, which is a total calculated value, and substitutes "1" for variables I and j (Step S186*a*).

Next, after the variable i is incremented (i←i+1) (Step S186*b*), the difference value Δβ between the correction amount βa (=β0+αa (i−1)) at the preset number of sheets of paper P and the correction amount Pb (=β0+αa (i)) at the paper P whose paper transport position has been detected by the second sheet transport position detecting portion 172 at the time of the image formation is calculated (Step S186*c*), and it is determined whether or not the difference value Δβ is within the reference range F (Step S186*d*).

If the difference value Δβ is not within the reference range F (Step S186*d*: No), the procedure advances to Step S186*g*. On the other hand, if the difference value Δβ is within the reference range F (Step S186*d*: Yes), after the variable j is incremented (Step S186*e*), the off-center amount αa (i) is added to the total value αa (Step S1860.

Next, it is determined whether or not the variable i is smaller than the number n of sheets of paper (Step S186*g*). If the variable i is smaller than the number n of sheets of paper (Step S186*g*: Yes), the procedure advances to Step S186*b*. On the other hand, if the variable i reaches the number n of sheets of paper (Step S186*g*: No), the average value αav=(total value αa)/j is calculated (Step S186*h*).

With this configuration, the displacement amount of the paper transport position corresponding to the correction amount βa that causes the difference value Δβ not to be within the reference range F is excluded from data for the average value, and the unreliable data is not used as data for the average value, and, thus, the precision of data for the average value can be improved, accordingly, the precision of the image writing position onto the photosensitive drums 3 can be improved.

(Embodiment 4)

Incidentally, in the case where a plurality of paper feed portions 80 are provided as in this embodiment, if the difference value Δβ between the correction amount βa for the preset number of sheets of paper P and the correction amount βb for the paper P detected at the time of the image formation is successively not within the reference range F, it is highly likely that the paper feed portion 80 that is feeding the paper P is out of order regarding the paper transport position.

Thus, in Embodiment 4, the control portion 101 is configured so as to, if the difference value Δβ between the correction amount βa for the preset number of sheets of paper P and the correction amount βb for the paper P whose paper transport position has been detected by the second sheet transport position detecting portion 172 at the time of the image formation is successively not within the reference range F for a prescribed number K of sheets (e.g., three sheets), feeds the paper P from another paper feed portion 80 for the same size (also including the portrait or landscape direction of the paper size) (e.g., in the case of a paper feed portion that feeds the paper P in A4 sideways transport, from another paper feed portion that feeds the paper P in A4 sideways transport), and resets the count of the number K of successive sheets in which the difference value Δβ is successively not within the reference range F.

According to Embodiment 4, among the plurality of paper feed portions 80, feeding of paper from a paper feed portion 80 in which the difference value Δβ is successively not within the reference range F for the prescribed number K of sheets (e.g., three sheets) is changed to feeding of paper from another paper feed portion 80 for the same direction of the paper size and the same size, and, thus, even when any of the plurality of paper feed portions 80 is out of order regarding the paper transport position, precise positional matching of the image forming position on the paper P and the image writing position onto the photosensitive drums 3 can be obtained. Moreover, if the difference value Δβ is successively out of the reference range F for the prescribed number K of sheets (e.g., three sheets), the count of the number K of successive sheets is reset, and, thus, the speed can be retuned to the processing speed of image formation (printing) in the high speed correction mode.

Furthermore, in Embodiment 4, in the case where the paper P is fed from another paper feed portion 80, as a notifier that gives notice to the effect that it is necessary to check the paper feed portion 80 that was feeding the paper P before the other paper feed portion 80 feeds the paper P, and the control portion 101 includes display means for causing the display portion 119 disposed in the image forming apparatus 100 to display a message indicating that it is necessary to check the paper feed portion 80. With this configuration, it is easy for a user to recognize that it is necessary to check the paper feed portion 80 when the difference value Δβ is successively not within the reference range F for the prescribed number K of sheets (e.g., three sheets).

Control Example 4

Next, a control example 4 of an image writing position correcting process according to Embodiment 4 will be described with reference to FIGS. 15 and 16.

Figure 15:
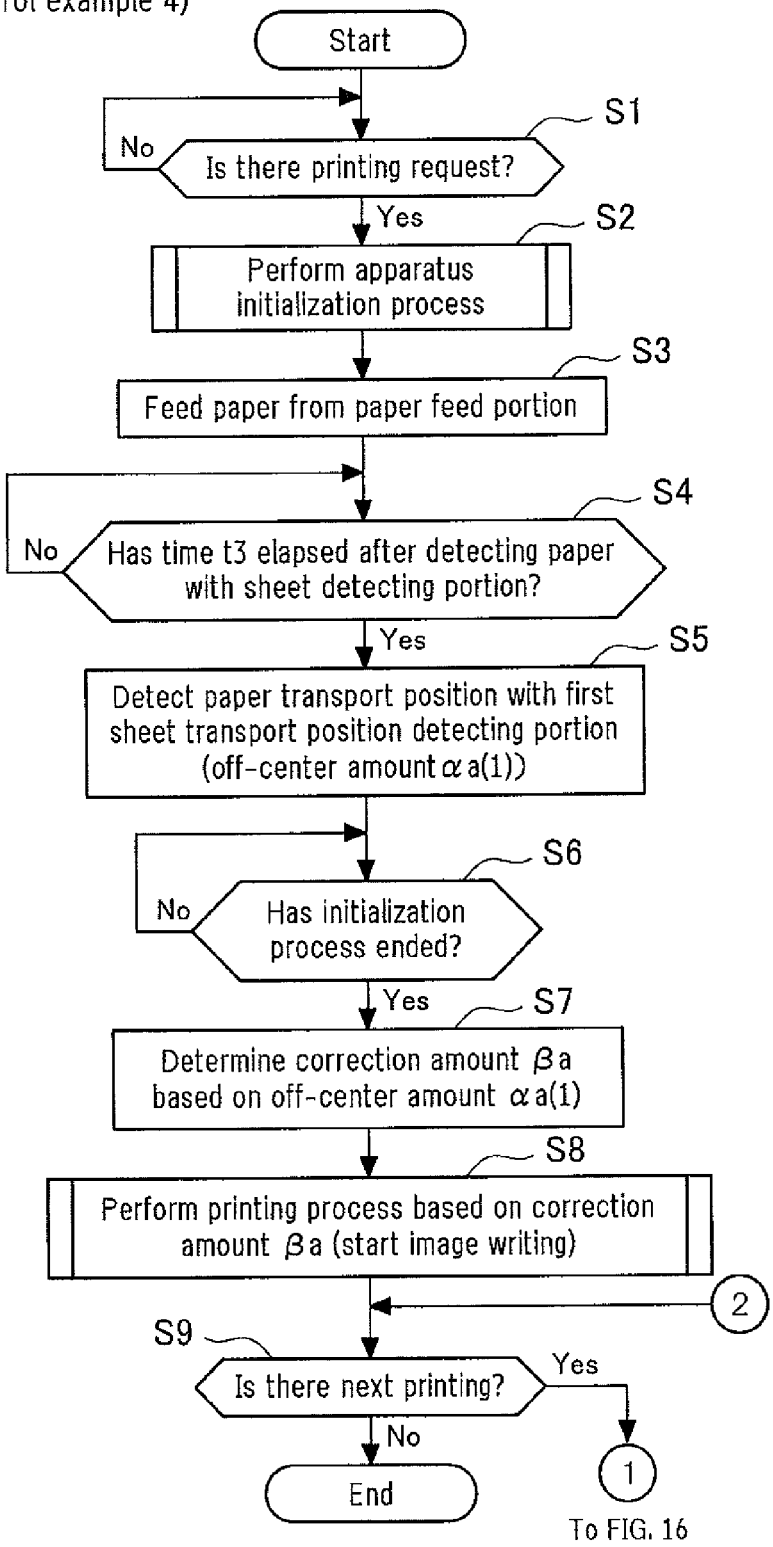
FIG. 15 is a flowchart showing a first half of a control example 4 of the image writing position correcting process according to Embodiment 4.
Figure 16:
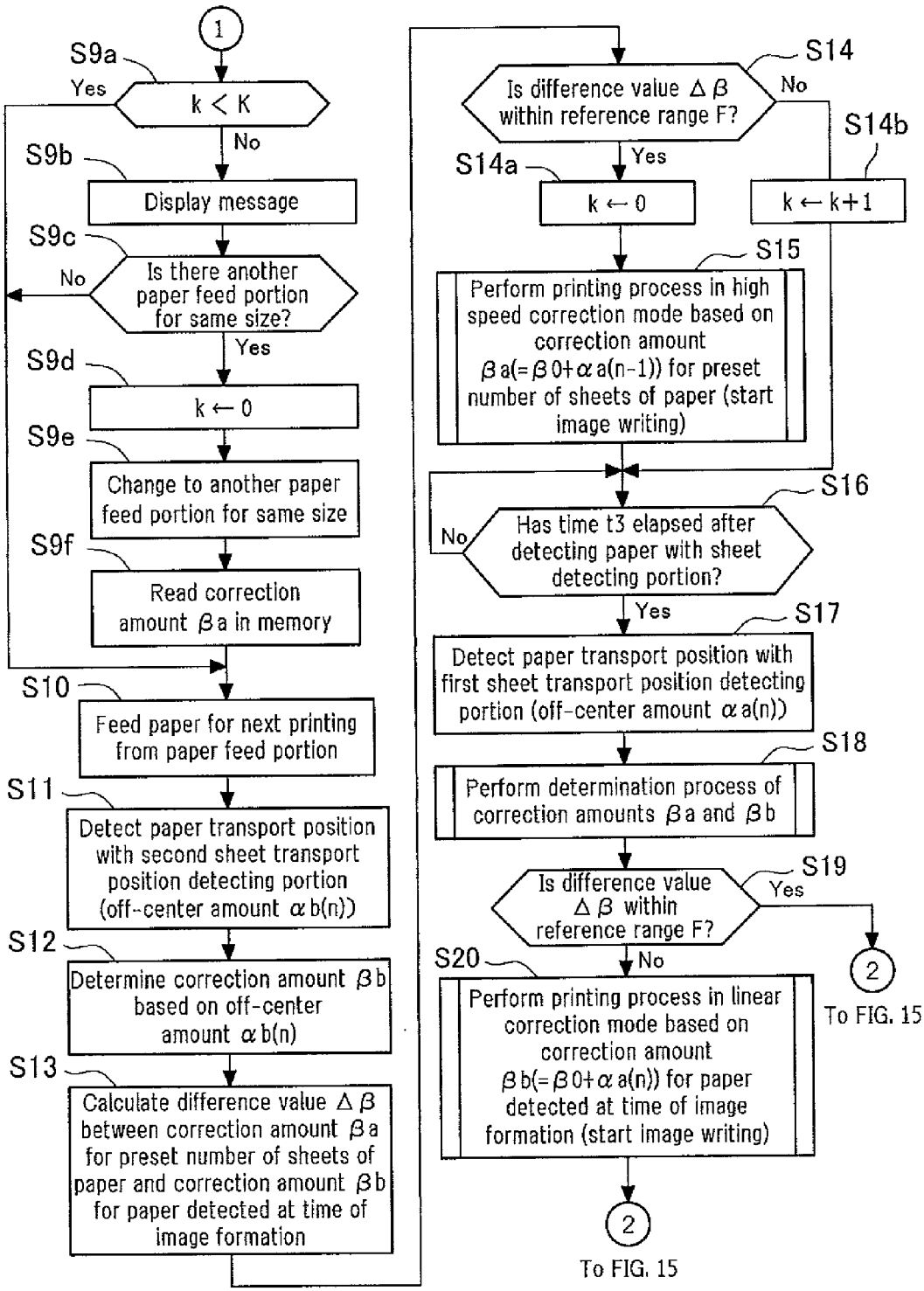
FIG. 16 is a flowchart showing a second half of the control example 4 of the image writing position correcting process according to Embodiment 4.

FIGS. 15 and 16 are flowcharts respectively showing a first half and a second half of the control example 4 of the mage writing position correcting process according to Embodiment 4.

The flowcharts of this control example 4 are provided with Steps S9*a* to S9*f* between the determination (Yes) of Step S9 and Step S10, Step S14*a* between the determination (Yes) of Step S14 and Step S15, and Step S14*b* between the determination (No) of Step S14 and Step S16, in the flowchart shown in FIG. 6 (the control examples 1 to 3).

Here, in the flowcharts of the control example 4 shown in FIGS. 15 and 16, processes substantially the same as those in the flowchart shown in FIG. 6 (the control examples 1 to 3) are denoted by the same reference numerals, and aspects different from those in will be mainly described.

In this control example 4, the prescribed number K of sheets (e.g., three sheets) is stored in the memory 104 in advance (see FIG. 3). Here, the prescribed number K of sheets may be set and changed in a setting mode for service simulation and the like. With this configuration, the degree of necessity to check the paper transport position of the paper feed portions 80 can be changed.

In the control example 4 shown in FIGS. 15 and 16, in the initialization process in Step S2, a variable k for counting the number of successive sheets in which the difference value Δβ is successively not within the reference range F is reset ("0" is substituted for the variable k).

Then, in Step S9*a*, it is determined whether or not the variable k is smaller than the prescribed number K of sheets. If the variable k is smaller than the prescribed number K of sheets (Step S9*a*: Yes), the procedure advances to Step S10. On the other hand, if the variable k is equal to or larger than the prescribed number K of sheets (Step S9*a*: No), currently processed, a message indicating that it is necessary to check the currently paper-feeding paper feed portion 80 (e.g., the message "Please check paper feed portion") is displayed on the display portion 119 in the operation portion 118 (see FIG. 17, the message not shown) (Step S9*b*), and it is determined whether or not there is another paper feed portion 80 for the same size (also including the direction of the paper size) as the currently paper-feeding the paper feed portion 80 among the plurality of paper feed portions 80 (Step S9*c*).

If there is not another paper feed portion for the same size (Step S9*c*: No), the procedure advances to Step S10. On the other hand, if there is another paper feed portion for the same size (Step S9*c*: Yes), the variable k is reset ("0" is substituted for the variable k) (Step S9*d*), switching is performed to another paper feed portion for the same size (Step S9*e*). Then, the correction amount βa is read from the memory 104 corresponding to the other paper feed portion (Step S90, and the procedure advances to Step S10.

Furthermore, in Step S14*a* the variable k is reset ("0" is substituted for the variable k) and, in Step S14*b*, the variable k is incremented (k←k+1).

(Embodiment 5)

Incidentally, there may be a user who requests to give priority to the linear correction mode in which the image writing position onto the photosensitive drums 3 matches the proper image writing position even if the processing speed of image formation in the high speed correction mode cannot be achieved.

Accordingly, in Embodiment 5, the control portion 101 can select either one of a mode switching operation that performs switching to one of the high speed correction mode and the linear correction mode according to the correction amount βb for the paper P whose paper transport position has been detected by the second sheet transport position detecting portion 172 at the time of the image formation with respect to the correction amount βa for the preset number of sheets of paper P, and a linear correction mode prioritizing operation that performs switching to the linear correction mode regardless of a value corresponding to the correction amount βb for the paper P whose paper transport position has been detected by the second sheet transport position detecting portion 172 at the time of the image formation with respect to the correction amount βa for the preset number of sheets of paper P.

According to Embodiment 5, if there is a request to give priority to the linear correction mode in which the image writing position onto the photosensitive drums 3 matches the proper image writing position, the user selects the linear correction mode prioritizing operation, so that the image writing position onto the photosensitive drums 3 can match the proper image writing position regardless of a value corresponding to the correction amount βb for the paper P detected at the time of the image formation with respect to the correction amount βa for the preset number of sheets of paper P. Accordingly, even if the processing speed of image formation in the high speed correction mode cannot be achieved, a request to give priority to the linear correction mode can be met.

Here, the image forming apparatus 100 according to this embodiment may have a configuration in which Embodiments 4 and 5 are combined.

Control Example 5

Next, a control example 5 of an image writing position correcting process according to Embodiment 5 will be described with reference to FIGS. 17 to 19.

The control portion 101 is configured so as to recognize which operation has been selected from among the mode switching operation and the linear correction mode prioritizing operation according to the state of an operation switching memory flag FL stored in the memory 104 (see FIG. 3).

Figure 17:
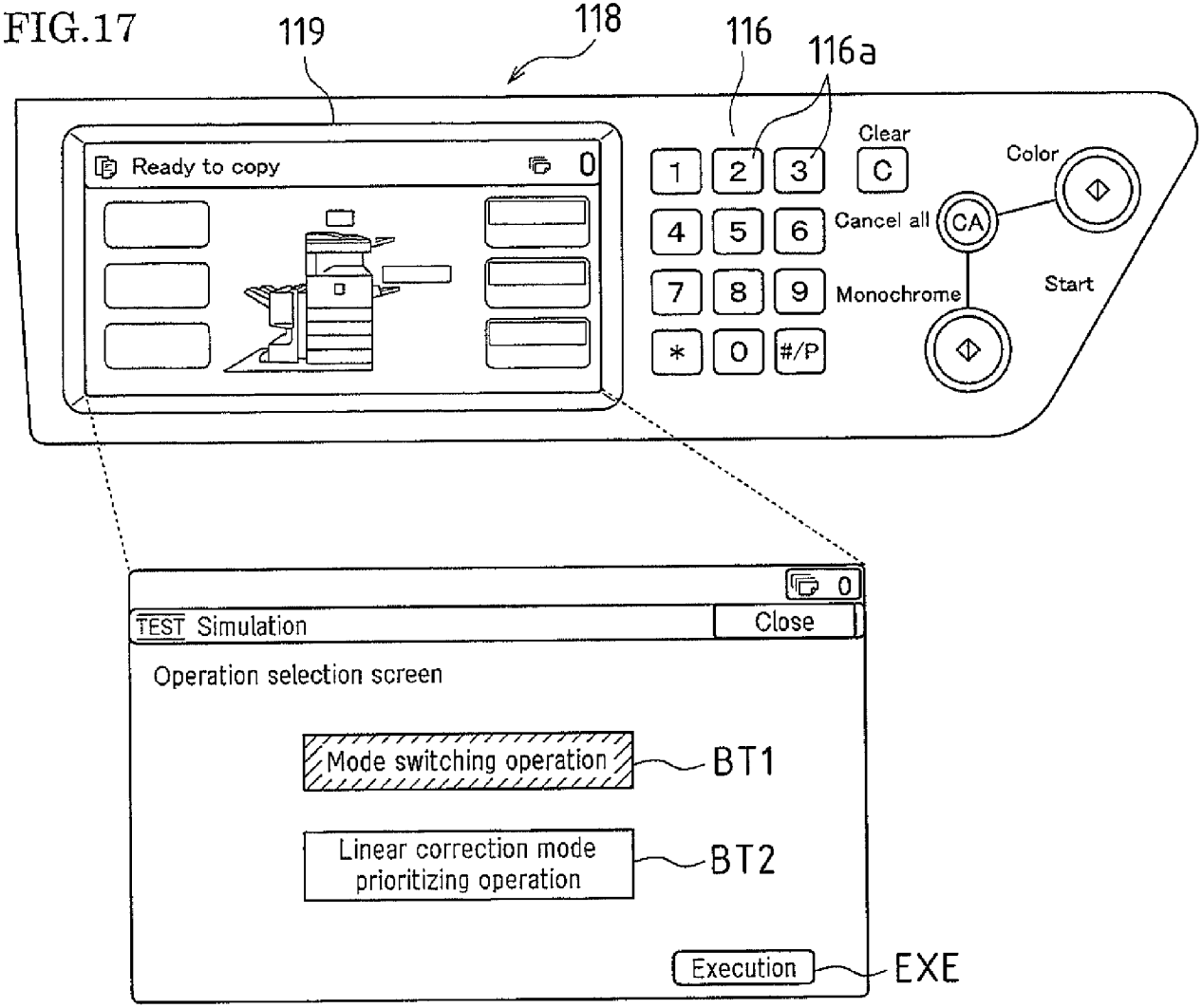
FIG. 17 is a plan view showing an operation selection screen that receives selection from among a mode switching operation and a linear correction mode prioritizing operation in a display portion in an operation portion of the image forming apparatus shown in FIG. 1.

FIG. 17 is a plan view showing an operation selection screen that receives selection from among the mode switching operation and the linear correction mode prioritizing operation in the display portion 119 in the operation portion 118 of the image forming apparatus 100 shown in FIG. 1.

As shown in FIG. 17, in this example, selection from among the mode switching operation and the linear correction mode prioritizing operation is performed in a service simulation mode in which service personnel performs desired setting or selection. That is to say, in an operation selection screen displayed in the display portion 119, a first selection button BT1 that sets the operation switching memory flag FL to a state for switching to the mode switching operation (e.g., "0") or a second selection button BT2 that sets the operation switching memory flag FL to a state for switching to the linear correction mode prioritizing operation (e.g., "1") is selected by a user performing a touch operation on the screen. Then, an execution key EXE is operated to fix the operation selection of a highlighted button from among the first selection button BT1 and the second selection button BT2. Here, the operation switching memory flag FL is initially in a state for switching to the mode switching operation (e.g., "0"), and FIG. 17 shows a state in which the first selection button BT1 has been selected.

Figure 18:
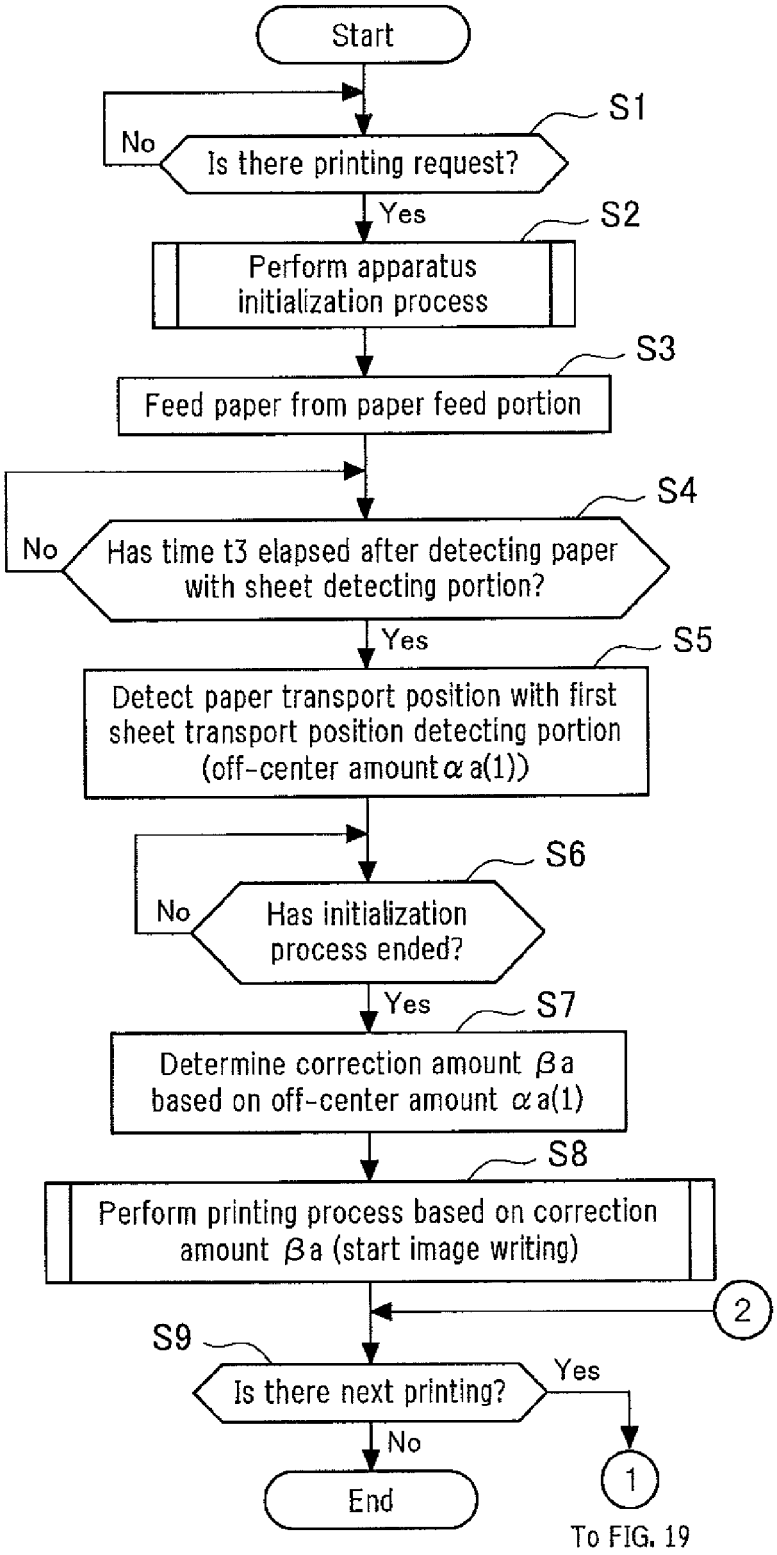
FIG. 18 is a flowchart showing a first half of a control example 5 of the image writing position correcting process according to Embodiment 5.
Figure 19:
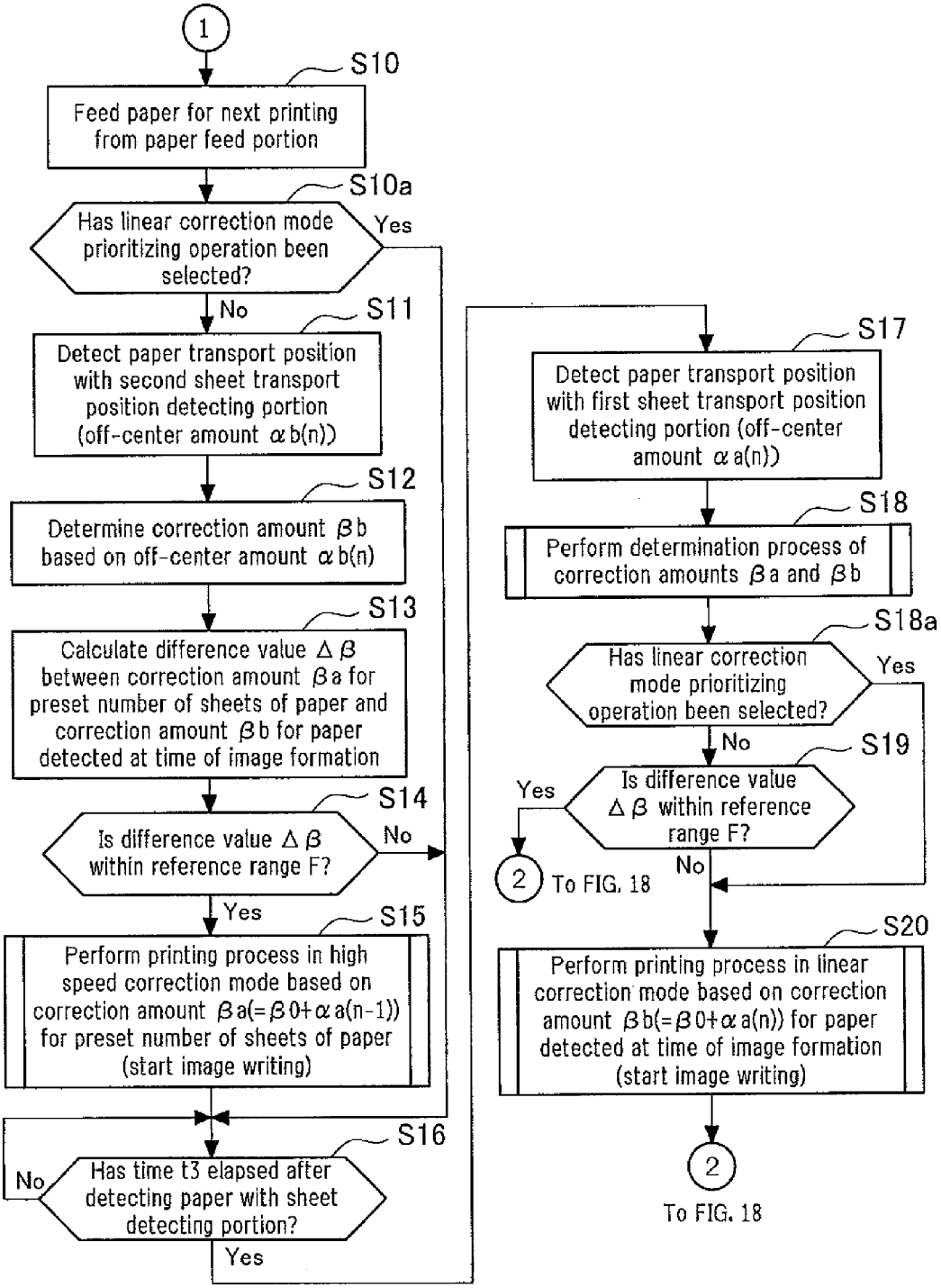
FIG. 19 is a flowchart showing a second half of the control example 5 of the image writing position correcting process according to Embodiment 5.

FIGS. 18 and 19 are flowcharts respectively showing a first half and a second half of the control example 5 of the image writing position correcting process according to Embodiment 5.

The flowcharts of this control example 5 are provided with Step S10*a* between Step S10 and Step S11, and Step S18*a* between Step S18 and Step S19, in the flowchart shown in FIG. 6 (the control examples 1 to 3).

Here, in the flowcharts of the control example 5 shown in FIGS. 18 and 19, processes substantially the same as those in the flowchart shown in FIG. 6 (the control examples 1 to 3) are denoted by the same reference numerals, and a description thereof has been omitted.

In the control example 5 shown in FIGS. 18 and 19, in Step S10*a*, it is determined whether or not the linear correction mode prioritizing operation has been selected. If the linear correction mode prioritizing operation has not been selected, that is, if the mode switching operation has been selected (Step S10*a*: No), the procedure advances to Step S11. On the other hand, if the linear correction mode prioritizing operation has been selected (Step S10*a*: Yes), the procedure advances to Step S16.

Furthermore, in Step S18*a*, it is determined whether or not the linear correction mode prioritizing operation has been selected. If the linear correction mode prioritizing operation has not been selected, that is, if the mode switching operation has been selected (Step S18*a*: No), and the procedure advances to Step S19. On the other hand, if the linear correction mode prioritizing operation has been selected (Step S18*a*: Yes), the procedure advances to Step S20.

(Embodiment 6)

In Embodiments 1 to 5 above, the sheet transport position detecting portion 170 is configured from two detecting portions namely the first and the second sheet transport position detecting portions 171 and 172, but it may be configured from one detecting portion that detects a paper transport position of the paper P on the upstream side of the pre-registration rollers R41 and R42 in the transport direction Y1.

Figure 20A:
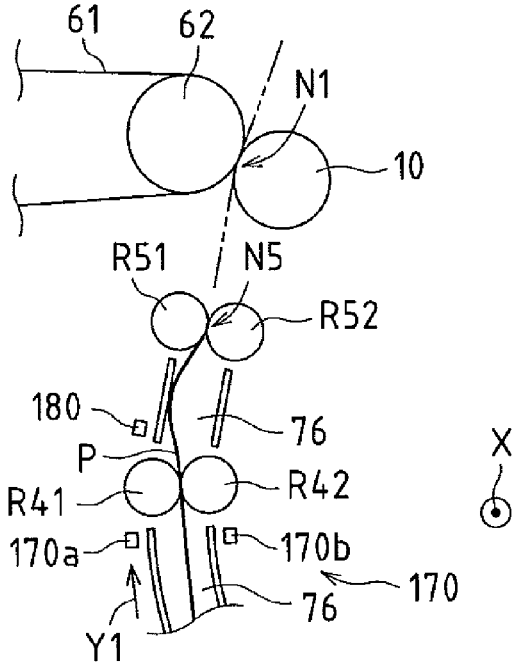
Figure 20B:
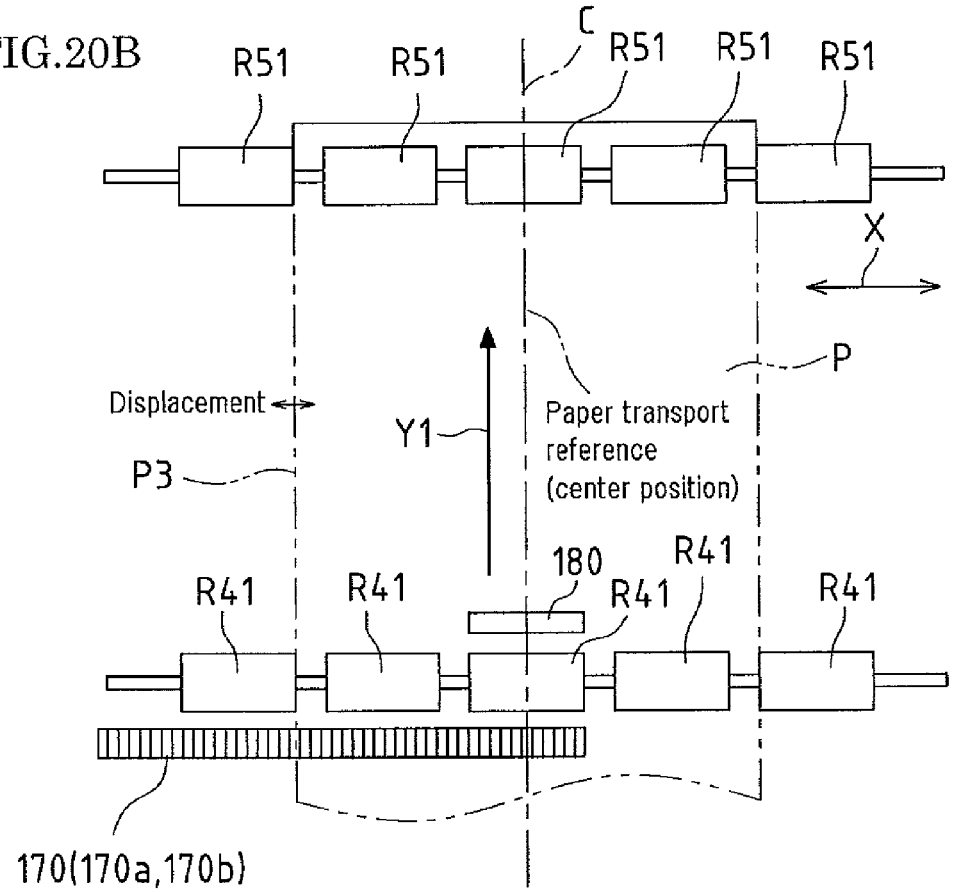

FIGS. 20A and 20B are explanatory views for illustrating a configuration for detecting paper P on the main transport path 76. FIG. 20A is a side view schematically showing another exemplary configuration of the sheet transport position detecting portion 170 and the sheet detecting portion 180, and FIG. 20B is a plan view schematically showing another exemplary configuration of the sheet transport position detecting portion 170 and the sheet detecting portion 180.

Here, in FIGS. 20A and 20B, the same constituent members as those in the configuration shown in FIG. 2 are denoted by the same reference numerals, and aspects different from those in will be mainly described.

As shown in FIGS. 20A and 20B, the sheet transport position detecting portion 170 is disposed close to the pre-registration rollers R41 and R42 on the upstream side of the pre-registration rollers R41 and R42 in the transport direction Y1, and detects a sheet transport position.

The sheet transport position detecting portion 170 is configured so as to detect a paper transport position of the paper P that is being transported by the pre-registration rollers R41 and R42. The sheet transport position detecting portion 170 is disposed close to the pre-registration rollers R41 and R42 on the upstream side of the pre-registration rollers R41 and R42 in the transport direction Y1. In this example, the sheet transport position detecting portion 170 detects a displacement amount (off-center amount) from a preset paper transport reference (center position) C the width direction X along the section of the diagram orthogonal to the transport direction Y1.

More specifically, the sheet transport position detecting portion 170 includes a light-emitting section 170*a* and a light-receiving section 170*b*. In this example, the sheet transport position detecting portion 170 forms a line sensor that is a CIS (contact image sensor) configured from the light-emitting section (i.e., a light-emitting line sensor) 170*a* and the light-receiving section (i.e., a light-receiving line sensor) 170*b* of a line sensor that employs a method of coupling using an array of equal magnification lenses that correspond to pixels lined up in a single line. The light-emitting section 170*a* and light-receiving section 170*b* face each other with the main transport path 76 interposed therebetween (see FIG. 20A), and are arranged in the width direction X as to be along the pre-registration rollers R41 and R42 (see FIG. 20B). The thus arranged the sheet transport position detecting portion 170 is formed so as to have a length that allows one side edge P3 in the width direction X of the paper P to be detected for minimum (e.g., postcard size) to maximum (e.g., A3 portrait size) widths of the transported paper P. Here, the sheet transport position detecting portion 170 may be a CCD sensor.

Also in the configuration shown in FIGS. 20A and 20B, in the case where switching is performed to the high speed correction mode, detection by the sheet transport position detecting portion 170 regarding the preset number of sheets of paper P is used regarding the image forming position at which an image is to be formed on the other sheets of paper P, and, thus, it is possible to perform positional matching of the image forming position on the paper P and the image writing position onto the photosensitive drums 3 precisely at high speed even in a high speed apparatus.

[Other Embodiments]

(Embodiment 7)

In Embodiments 1 to 6, the process is performed within one image forming (printing) request, that is, one job, but, in Embodiment 7, successive printing requests, that is, a plurality of jobs are successively executed. That is to say, usually, if printing requests are different from each other, the size of the paper P or the paper feed tray to be used may differ therebetween. Accordingly, in consideration of such a case, the process completes for each one printing request in Embodiments 1 to 6.

However, even in the case of a plurality of printing request, no problem occurs when the plurality of printing requests are successively processed without stopping the operation of the apparatus, and when successive printing requests are continuously performed as is in the processes of Embodiments 1 to 6 if the paper feed tray to be used is the same.

Accordingly, in Embodiment 7, in consideration of this aspect, the control portion 101 is configured so as to successively process the plurality of printing requests without stopping the operation of the apparatus, and, if the paper feed tray to be used is the same, to continuously perform successive printing requests as is. With this configuration, the printing processing speed can be improved also in a plurality of printing requests.

Control Example 7

Next, a control example 7 of an image writing position correcting process according to Embodiment 7 will be described with reference to FIG. 21.

Figure 21:
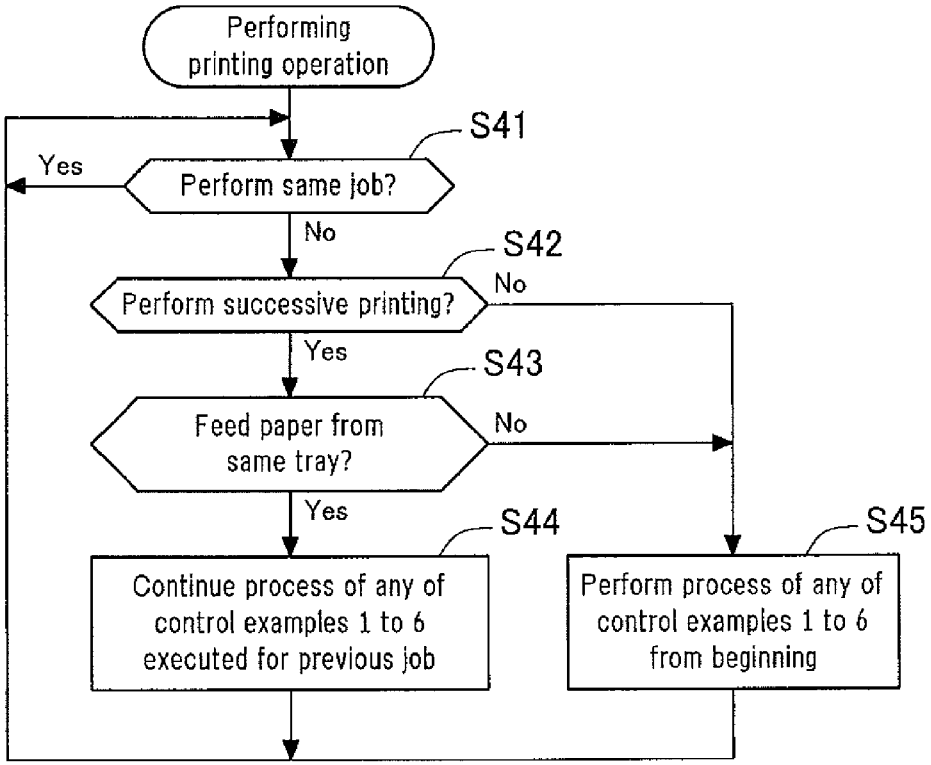
FIG. 21 is a flowchart for performing the control example 7 in the control examples 1 to 6 of the image writing position correcting process according to Embodiments 1 to 6.

FIG. 21 is a flowchart for performing the control example 7 in the control examples 1 to 6 of the image writing position correcting process according to Embodiments 1 to 6.

In the flowchart shown in FIG. 21, if a plurality of printing requests are given, the control portion 101 always monitors whether or not the currently processed printing process is the same one printing request, that is, a printing process for the same job (Step S41: Yes). On the other hand, if a printing process for one job is ended, and a printing process for the next job is about to be executed (Step S41: No), it is determined whether or not successive printing is being performed in which the process for the next job is successively performed after the end of the process for the previous job without stopping the apparatus (Step S42). If successive printing is being performed (Step S42: Yes), it is determined whether or not the paper feed tray from which paper is to be fed next is the same as the paper feed tray used in the immediately preceding job (Step S43).

Then, if the same paper feed tray is used (Step S43: Yes), the control portion 101 continuously performs a process of any one of the control examples 1 to 6, which has been executed for the immediately preceding job, as is also for the next job (Step S44).

On the other hand, if it is determined in Step S42 that successive printing is not being performed (Step S42: No), and in Step S43 that the same paper feed tray is not used (Step S43: No), a process of any one of the control examples 1 to 6 is performed from the initial state for the next printing request (Step S45). That is to say, in Step S45, the printing process by the image forming apparatus 100 is initialized.

(Embodiment 8)

Although not particularly specified, the control examples 1 to 7 of the image writing position correcting process according to Embodiments 1 to 7 are control examples in the case where the print mode is simplex print mode. However, print modes include not only simplex print mode but also duplex print mode. Even in the case of the same paper P, the paper P in the initial state in which no face has been printed and the paper P in a state where one face has been printed have mutually different contact state when being sandwiched by the registration rollers R51 and R52, and, thus, may have mutually different paper transport positions when being stopped by making contact with the registration rollers R51 and R52.

Accordingly, in Embodiment 8, in consideration of this aspect, the control portion 101 determines correction of the image writing position for each print face (front face or back face) of the paper P if the print mode is duplex printing. Accordingly, even in the case of duplex printing, correction of the image writing position can be precisely determined according to the print state onto the paper P (either printing on the front face or printing on the back face).

That is to say, in the case of printing on the front face, the control portion 101 causes the sheet transport position detecting portion 170 to perform detection when printing the front face, and performs a correcting process using only a detected value at the time of printing on the front face stored in the memory 104, and, in the case of printing on the back face, it causes the sheet transport position detecting portion 170 to perform detection when printing the back face, and performs a correcting process using only a detected value at the time of printing on the back face stored in the memory 104.

(Embodiment 9)

Incidentally, in the image writing position correcting process according to Embodiments 1 to 8, in a successive printing process onto a plurality of sheets of paper P, the paper P is transported from the paper feed portion 80 to the registration rollers R51 and R52 after starting the successive printing process, but there is no limitation to this, and the paper P may be transported to the registration rollers R51 and R52 before the successive printing process.

Accordingly, in Embodiment 9, the control portion 101 is configured so as to, in a successive printing process onto a plurality of sheets of paper P, select a paper feed portion for performing image formation from among the plurality of paper feed portions 80, and transport the paper P from the selected paper feed portion 80 to the registration rollers R51 and R52 before the successive printing process.

According to Embodiment 9, in a state where a first sheet of paper is fed earlier in a successive printing process onto a plurality of sheets of paper P, unwanted printing onto the paper P can be avoided, and unnecessary discharge of the paper P can be suppressed.

More specifically, before a successive printing process, that is, before image writing, the control portion 101 causes the paper P to be picked up by the paper feed rollers 11*a* from a selected paper feed portion (e.g., from the paper feed tray 81 at the uppermost level shown in FIG. 1), be transported via the main transport path 76 to the registration rollers R51 and R52, make contact with the nip portion N5 between the registration rollers R51 and R52, and be stopped in a state where the paper P is sandwiched by the pre-registration rollers R41 and R42 (put on standby).

Here, selection of a paper feed portion from among the plurality of paper feed portions 80 is performed based on the size of an original whose image is to be written, and the magnification settings thereof. Alternatively, the image forming apparatus 100 is connected via a LAN or the like with an external device such as a PC, and the selection is performed based on instruction contents input through remote operation from this external apparatus. Alternatively, the selection is performed based on instruction contents input by the user using operation means (the operation portion 118 shown in FIG. 17, etc.) for performing input from the outside. The selection of the paper feed portion 80 include selection of an updated paper feed portion 80 in the case where the paper feed portion 80 is updated. Here, the update of the paper feed portion 80 refers to an operation that changes (resets) the settings the paper feed portion 80 in the case where information on the paper P stored in the paper feed portion 80 is changed, for example, the paper P stored in the paper feed portion 80 is changed or replenished. For example, the update refers to an operation that, when the paper P stored in the paper feed portion 80 is used up, attaches and detaches the paper feed portion 80 in order to replenish the paper P to the paper feed portion 80.

Control Example 9

Next, a control example 9 of a correcting process according to Embodiment 9 will be described with reference to FIGS. 22 to 25.

Figure 22:
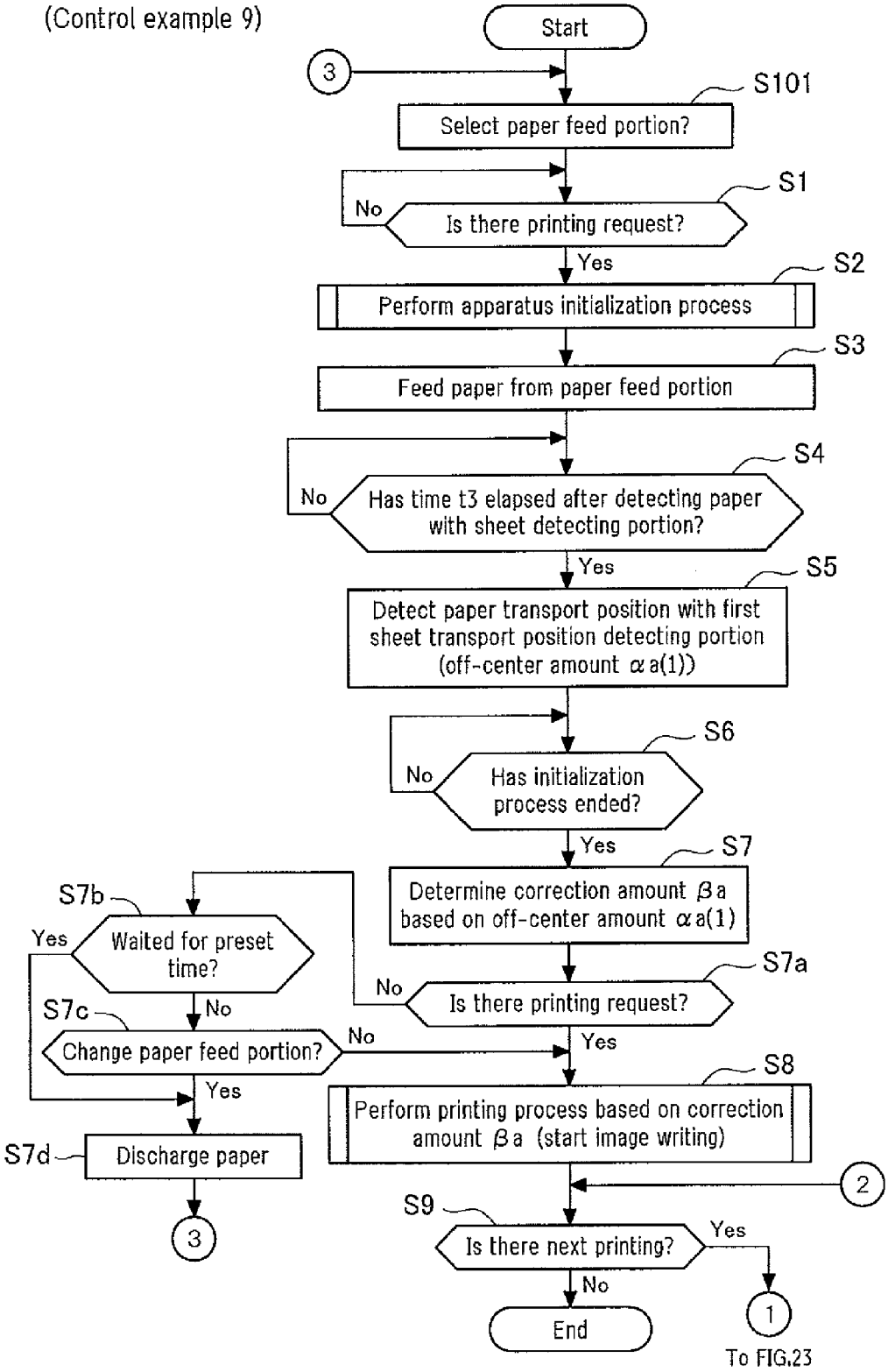
FIG. 22 is a flowchart showing a first half of a control example 9 of the image writing position correcting process according to Embodiment 9.
Figure 23:
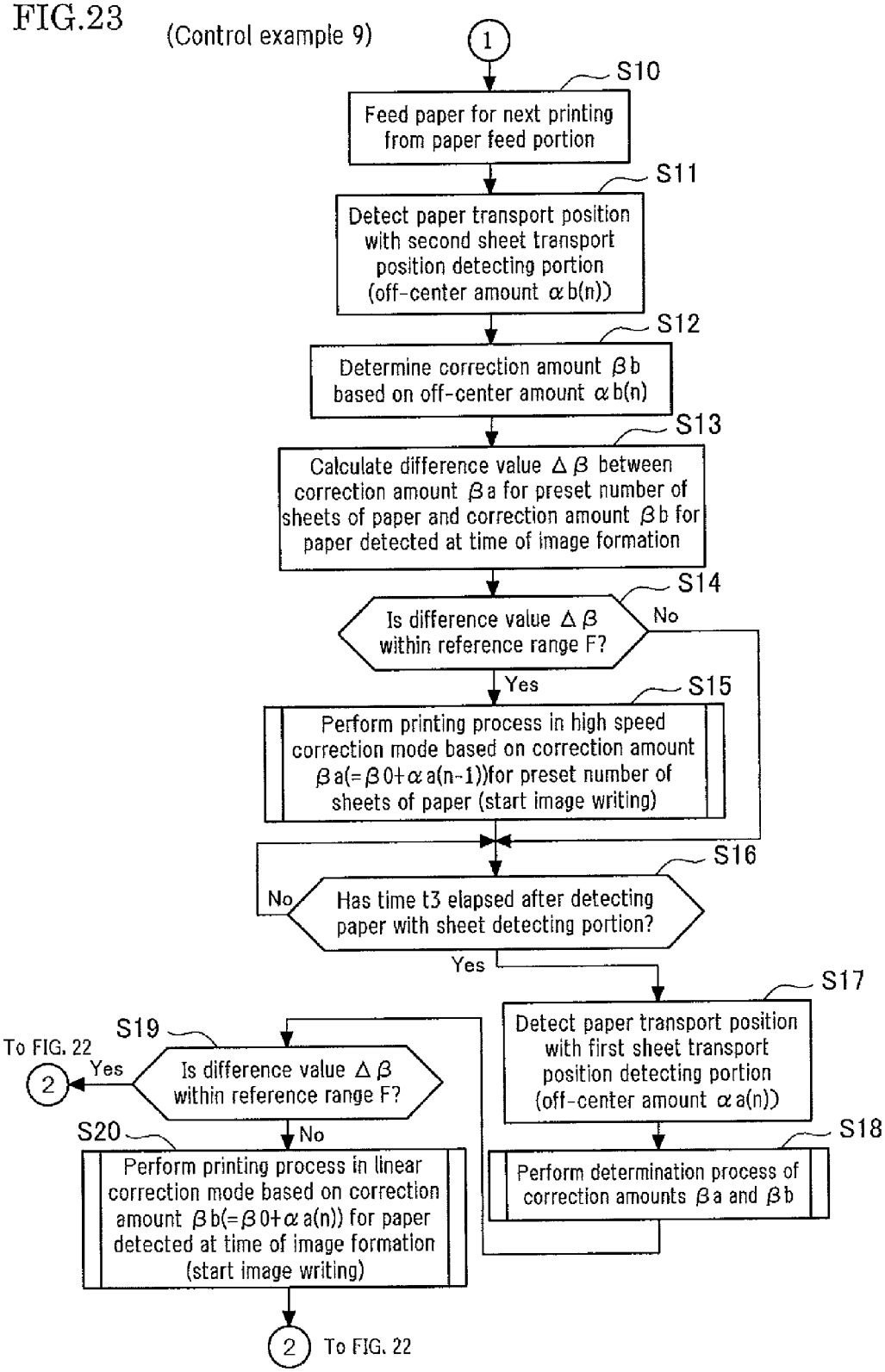
FIG. 23 is a flowchart showing a second half of the control example 9 of the image writing position correcting process according to Embodiment 9.

FIGS. 22 and 23 are flowcharts respectively showing a first half and a second half of the control example 9 of the image writing position correcting process according to Embodiment 9.

The flowcharts of this control example 9 are provided with Step S101 before Step S1, and Steps S7*a* to S7*d* between Step S7 and Step S8, in the flowchart shown in FIG. 6 (the control examples 1 to 3).

Here, in the flowcharts of the control example 9 shown in FIGS. 22 and 23, the same processes as those in the flowchart shown in FIG. 6 (the control examples 1 to 3) are denoted by the same reference numerals, and aspects different from those in will be mainly described.

The initialization of the image forming position on the paper P has to be individually performed for each of the plurality of paper feed portions 80. Thus, the paper transport position $\alpha$0 and the reference adjustment amount $\beta$0 are set for each of the plurality of paper feed portions 80 independently of each other through the above-described initialization. Then, the image writing position correcting process on the paper P is performed using the paper transport position $\alpha$0 and the reference adjustment amount $\beta$0 set corresponding to the paper feed portion 80 that feeds the paper P at the time of printing process.

In the flowchart shown in FIG. 22, when the image forming apparatus 100 is started in order to perform image formation, the user selects the paper feed portion 80 (Step S101), and the control portion 101 starts an apparatus initialization process (regarding printing process) (Step S2). Alternatively, the user updates the paper feed portion 80 (Step S101), and the control portion 101 starts an apparatus initialization process (regarding printing process) (Step S2). In this example, it is assumed that the paper feed tray 81 at the uppermost level shown in FIG. 1 is selected in Step S101.

In Step S7*a*, in a state where a printing request to perform a successive printing process onto a plurality of sheets of paper P is being waited for, if there is no printing request to perform a successive printing process onto a plurality of sheets of paper P (Step S7*a*: No), a printing request is waited for continuously for a preset time (a time t10 shown in FIG. 24 described later) (Step S7*b*). Then, if the set time t10 has elapsed without a printing request (Step S7*b*: Yes), the paper P on standby at the registration rollers R51 and R52 is transported (discharged) to the discharge tray 91 (Step S7*d*), and the procedure advances to Step S101. On the other hand, if there is a printing request before the set time t10 has elapsed in Step S7*b* (a time t11 shown in FIG. 25 described later) (Step S7*b*: No) and the selected paper feed portion 80 is changed to another paper feed portion 80 (Step S7*c*: Yes), the paper P on standby at the registration rollers R51 and R52 is transported (discharged) to the discharge tray 91 (Step S7*d*), and the procedure advances to Step S101. Meanwhile, if the paper feed portion 80 is not changed in Step S7*c* (Step S7*c*: No), the procedure advances to Step S8.

On the other hand, if there is a printing request to perform a successive printing process onto a plurality of sheets of paper P in Step S7*a* (Step S7*a*: Yes), the procedure advances as is to Step S8.

Figure 24:
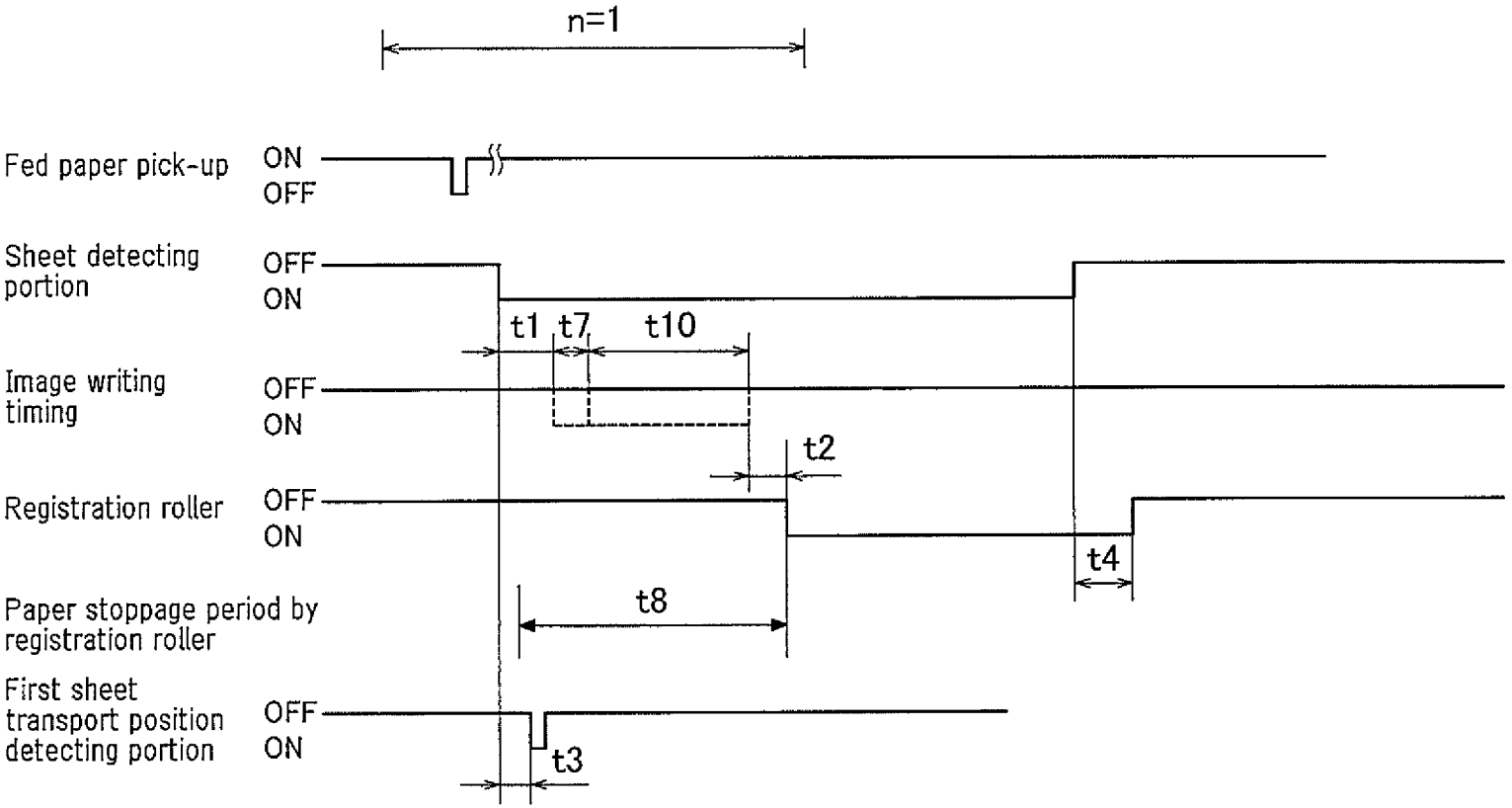
FIG. 24 is a timing chart showing detection timings of the respective detecting portions according to the control example 9.
Figure 25:
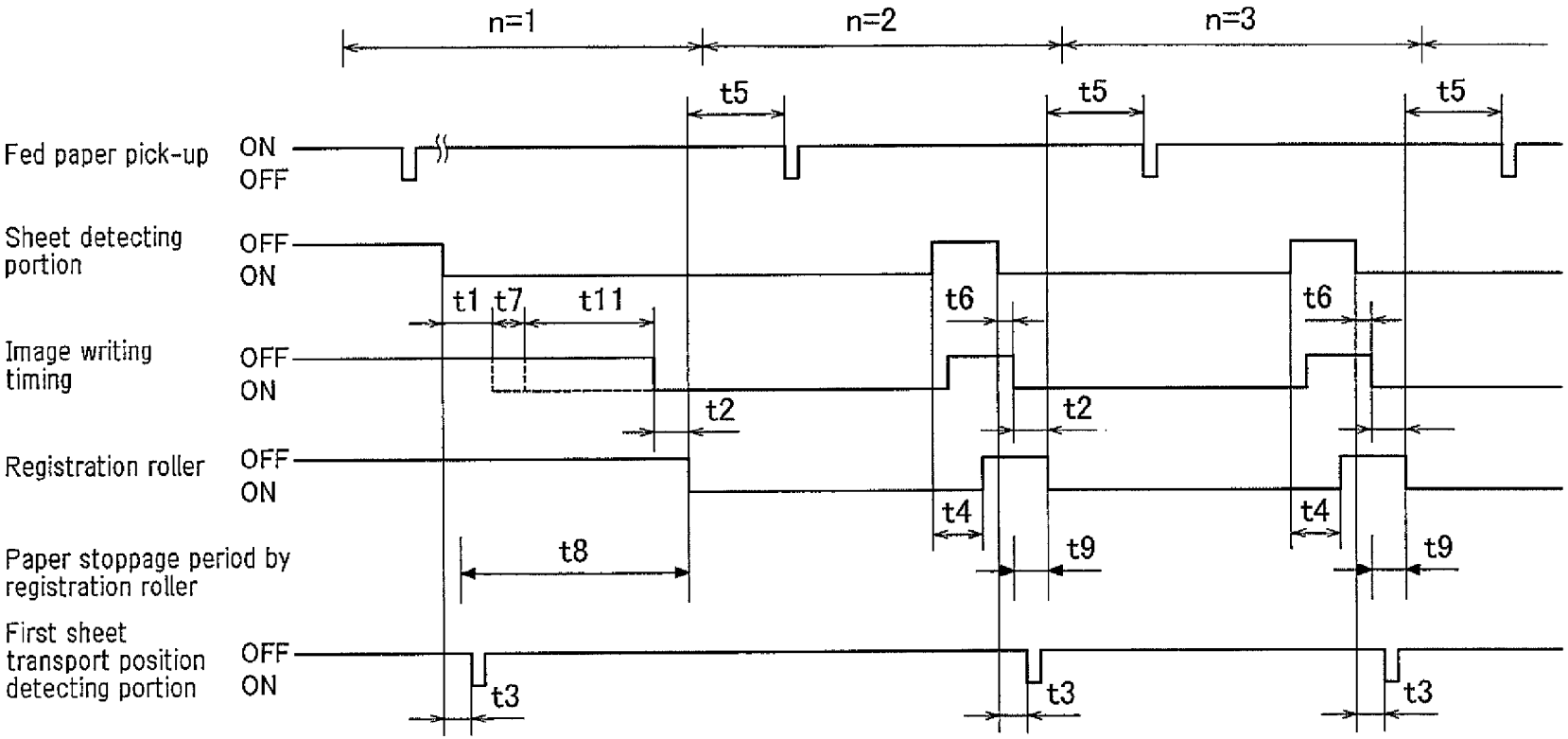
FIG. 25 is a timing chart showing detection timings of the respective detecting portions according to the control example 9.

FIGS. 24 and 25 are timing charts showing relationship between ON/OFF of fed paper pick-up detection by the paper feed rollers 11*a*, ON/OFF of paper detection by the sheet detecting portion 180, ON/OFF timing of writing of the image information onto the photosensitive drums 3 using a laser, ON/OFF of drive of the registration rollers R51 and R52 for transport, and ON/OFF of paper transport position detection by the first sheet transport position detecting portion 171.

More specifically, FIG. 24 is a timing chart in the case where the preset time t10 has elapsed without a printing request in Step S7*b*. FIG. 25 is a timing chart in the case where, within the time t11 where the preset time t10 has not elapsed without a printing request in Step S7*b*, the paper feed portion 80 is not changed in Step S7*c*.

The time t10 shown in FIG. 24 refers to the maximum time (upper limit time) during which a printing request is waited for. The time t11 shown in FIG. 25 refers to a delay time with respect to the time t1 until a printing request is detected. Here, the times t1 to t9 refer to the same periods as those in the timing charts shown in FIGS. 10 and 11.

In this control example 9, before successive printing process onto a plurality of sheets of paper P that is to be transported to the registration rollers R51 and R52 from the selected paper feed portion 80 (the selected paper feed tray 81 at the uppermost level in this control example 9) in order to perform image writing, from among the plurality of paper feed portions 80 that are arranged on the upstream side of the registration rollers R51 and R52 in the transport direction Y1 and transport the paper P to the registration rollers R51 and R52, the paper P is transported to the registration rollers R51 and R52 from the selected paper feed portion 80 (the selected paper feed tray 81 at the uppermost level in this control example 9). Accordingly, a first sheet of paper can be fed earlier at the time of a successive printing process onto a plurality of sheets of paper P than in the case where the first sheet of paper P is fed after a printing request.

Furthermore, in this control example 9, if the paper feed portions 80 is updated, the paper P is transported from the updated paper feed portion 80 to the registration rollers R51 and R52 before a successive printing process, and, thus, a first sheet of paper can be fed earlier at the time of a successive printing process onto a plurality of sheets of paper P with respect to the updated paper feed portion 80.

Furthermore, in this control example 9, if the paper feed portion 80 is changed, the paper P transported to the registration rollers R51 and R52 before a successive printing process is discharged to the discharge tray 91, and, thus, unwanted printing onto the paper P can be avoided in a state where a first sheet of paper is fed earlier at the time of a successive printing process onto a plurality of sheets of paper P.

Furthermore, in this control example 9, after the elapse of the preset time t10, the paper P transported to the registration rollers R51 and R52 before a successive printing process is discharged to the discharge tray 91, and, thus, unwanted printing onto the paper P can be avoided in a state where a first sheet of paper is fed earlier at the time of a successive printing process onto a plurality of sheets of paper P.

Furthermore, in this control example 9, the paper P transported to the registration rollers R51 and R52 before a successive printing process is transported to the downstream side of the registration rollers R51 and R52 in the transport direction Y1 before a successive printing process and discharged to the discharge tray 91, and, thus, unwanted printing onto the paper P can be avoided in a state where a first sheet of paper is fed earlier at the time of a successive printing process onto a plurality of sheets of paper P.

Here, in this control example 9, if the selected paper feed portion 80 is changed or if the set time t10 has elapsed in Step S7*b*, the paper P transported to the registration rollers R51 and R52 is discharged to the discharge tray 91, but there is no limitation to this, and configurations shown below may be used as long as the paper P is transported to a position other than the registration rollers R51 and R52.

That is to say, the paper P transported to the registration rollers R51 and R52 before a successive printing process may be discharged to the upstream side of the registration rollers R51 and R52 in the transport direction Y1, and returned to the paper feed portion 80 from which the paper P has been transported. Furthermore, the paper P transported to the registration rollers R51 and R52 before a successive printing process may be transported to another paper feed portion other than the paper feed portion that has fed the paper. Furthermore, the paper P transported to the registration rollers R51 and R52 before a successive printing process may be transported to a paper re-feed portion for printing an image onto both faces of the paper P.

Here, the image forming apparatus 100 according to this embodiment may have a configuration obtained by combining at least two of Embodiments 4 to 9.

(Regarding Direct Transfer-Type Image Forming Apparatus)

In Embodiments 1 to 9 described above, a color tandem-type (intermediate transfer-type) image forming apparatus 100, which forms a multicolor or monochrome image onto the paper P using a plurality of photosensitive drums, but there is no limitation to this, and a direct transfer-type image forming apparatus also may be used.

Figure 26:
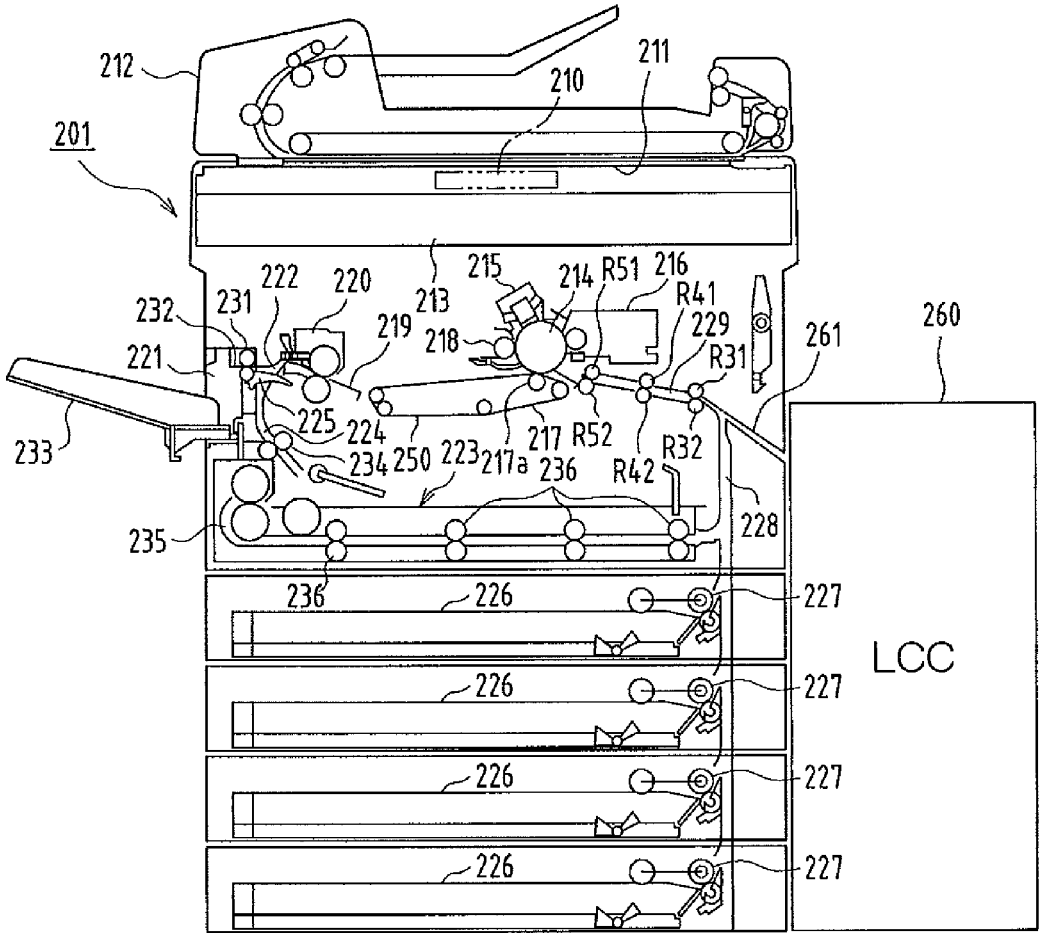
FIG. 26 is a side view showing the overall configuration of a direct transfer-type image forming apparatus according to this embodiment.

FIG. 26 is a side view showing the overall configuration of a direct transfer-type image forming apparatus 201 according to this embodiment.

The image forming apparatus 201 shown in FIG. 26 is, for example, a digital image forming apparatus having copier, printer, scammer, and facsimile modes, and includes an operation panel 210 on the front side of image forming apparatus 201.

An original stage 211 made of hard transparent glass is disposed on the upper face of the image forming apparatus 201. An automatic original feeding apparatus 212 is disposed above the original stage 211, and an optical unit 213 is disposed below the original stage 211.

An image forming system for forming an image on paper is disposed below the optical unit 213, and, in this image forming system, a photosensitive drum 214 (exemplary image bearing member) rotatably supported that functions as an electrostatic latent image bearing member whose surface is made of an photoconductive material. A charging unit 215, a development units 216, a transfer unit 217, and a cleaner 218 are arranged around the photosensitive drum 214 so as to face the circumferential face of the photosensitive drum 214.

In the thus configured image forming apparatus 201, when start of an image forming process is instructed by operation of the operation panel 210, the optical unit 213 scans an image face of an original that has been placed on the original stage 211, and light transmitted from a copy lamp in the optical unit 213 and reflected at the original image face is irradiated to the surface of the photosensitive drum 214.

The surface of the photosensitive drum 214 is uniformly charged to a charge of a single polarity by the charging unit 215 prior to irradiation of reflected light from the original, and an electrostatic latent image is formed on the surface of the photosensitive drum 214 by a photoconductive action provided by the irradiation of the reflected light from the original. Toner is supplied from the development units 216 to the surface of the photosensitive drum 214 on which the electrostatic latent image has been formed, thus the electrostatic latent image is made visible to a visible toner image.

A fixing unit 220 configured from a heat roller and a pressure roller is disposed on the downstream side of the photosensitive drum 214. A transfer belt 250 and a paper guide 219 of the transfer unit 217 are arranged between the fixing unit 220 and the photosensitive drum 214, and a paper fixing transport path from the photosensitive drum 214 to the fixing unit 220 is formed along the transfer belt 250 and the paper guide 219.

A paper discharge tray 233 is disposed on a side face of the image forming apparatus 201, and a paper discharge transport path 222 is formed between the fixing unit 220 and the paper discharge tray 233. Part of the paper discharge transport path 222 branches to a re-transport path 224 that continues to an automatic duplex paper feed apparatus 223 disposed below the photosensitive drum 214 via a branching gate 225.

A plurality of (four, in this example) paper feed cassettes 226 (exemplary sheet feed portions) detachably attached from the front side of the image forming apparatus 201 is disposed below the image forming apparatus 201. Each of the paper feed cassettes 226 stores paper of a different size, and prior to rotation of the photosensitive drum 214, paper from any one of the plurality of paper feed cassettes 226 is fed via a paper feed roller 227. The fed paper is transported in the direction of the photosensitive drum 214 by the transport rollers R31 and R32 along a shared transport path 228, and stopped in a state where the trailing edge is sandwiched by the pre-registration rollers R41 and R42 and the leading edge is in contact with the registration rollers R51 and R52. The configuration of this portion is the same as that shown in FIGS. 27A and 27B. Furthermore, the operation timing of the registration rollers R51 and R52 and the pre-registration rollers R41 and R42 is the same as that shown in FIG. 28, and transport of the paper on the paper transport path, in which the paper is transported to an image forming region (transfer nip portion, described later) by the photosensitive drum 214, and transport stoppage are performed by the registration rollers R51 and R52.

Furthermore, the image forming apparatus 201 includes a large capacity cabinet (LCC) 260 (exemplary sheet feed portion). detailed description of the structure of the LCC 260 is omitted, but paper fed from the LCC 260 via a cabinet side transport path 261 that merges with the shared transport path 228 at the front side of the transport rollers R31 and R32 is transported in the direction of the photosensitive drum 214 by the transport rollers R31 and R32, and is stopped in a state where the trailing edge is sandwiched by the pre-registration rollers R41 and R42 and the leading edge is in contact with the registration rollers R51 and R52.

Furthermore, the paper transport path in the image forming apparatus 201 is configured from a paper discharge transport path 221, a paper fixing transport path 222, the re-transport path 224, the shared transport path 228, main transport path 229, and the cabinet side transport path 261.

The registration rollers R51 and R52 rotate in synchronization with rotation of the photosensitive drum 214, thus guiding paper to the transfer nip portion between the photosensitive drum and the transfer unit 217. Paper that has been guided to the transfer nip portion receives a corona discharge of the transfer unit 217, and a toner image carried on the surface of the photosensitive drum 214 is transferred to the surface of the paper.

The paper onto which a toner image has been transferred is transported along the transfer belt 250 and the paper guide 219 to the fixing unit 220, and receives heat and pressure in the fixing unit 220. Thus, the developer image is fixed by melting onto the surface of the paper.

In a simplex printing mode in which an image is printed on one face of paper, paper that has passed through the fixing unit 220 is discharged onto the paper discharge tray 233 from a paper discharge opening 232 by a paper discharge roller 231 via the paper discharge transport path 222. At that time, the paper discharge roller 231 is driven back and forth in the paper transport direction by a paper discharge roller drive portion (not shown).

In a duplex printing mode in which an image is printed on both faces of paper, the branching gate 225 is exposed in part of the paper discharge transport path 222, and paper that has passed through the fixing unit 220 is transported via the re-transport path 224 including a transport roller 234 to the automatic duplex paper feed apparatus 223. Paper that has been transported to the automatic duplex paper feed apparatus 223 is fed in a state where the leading and trailing edges of the paper have been reversed by a re-paper feed roller 235, and is again transported by re-transport rollers 236 via the shared transport path 228 in the direction of the photosensitive drum 214 in a state where the front and back faces of the paper have been reversed. That paper is stopped in a state where the leading edge is in contact with the registration rollers R51 and R52 and the trailing edge is sandwiched by the pre-registration rollers R41 and R42.

Also in the direct transfer-type image forming apparatus 201 as described above, if the sheet transport position detecting portion 170 and the sheet detecting portion 180 have configurations as in FIGS. 2, 20A, and 20B, the configuration of Embodiments 1 to 9 described above can be applied.

All patents, published patent applications and other references disclosed herein are hereby expressly incorporated in their entireties by reference. The present technology can be embodied and practiced in other different forms without departing from the gist and essential characteristics thereof. Therefore, the above-described embodiments are considered in all respects as illustrative and not restrictive. The scope of the technology is indicated by the appended claims rather than by the foregoing description. All variations and modifications falling within the equivalency range of the appended claims are intended to be embraced therein.

What is claimed is:

1. An image forming apparatus, comprising:

an image bearing member on which an image is to be formed;

a registration roller that is disposed on upstream side in a recording sheet transport direction of an image forming region, which is disposed on a sheet transport path for transporting a recording sheet, that performs transport and transport stoppage of the recording sheet, and that corrects a sheet transport state; and a sheet transport position detecting portion that detects a sheet transport position of a recording sheet on the sheet transport path on upstream side of the registration roller in the transport direction;

wherein the image forming apparatus is provided with:

a high speed correction mode in which, at time of a successive image forming process on a plurality of recording sheets, the sheet transport position is detected by the sheet transport position detecting portion for a preset number of recording sheets among the plurality of recording sheets, a correction amount of an image writing position onto the image bearing member is determined based on the detected sheet transport position, the image writing position is corrected based on the determined correction amount, and the preset number of recording sheets are subjected to image formation at the image forming region based on the corrected image writing position, and one or more other recording sheets, on which image formation is to be performed after the preset number of recording sheets, are subjected to image formation at the image forming region based on the corrected image writing position; and a linear correction mode in which, at time of the successive image forming process, the sheet transport position is detected by the sheet transport position detecting portion for the plurality of recording sheets, a correction amount of an image writing position onto the image bearing member is determined based on the detected sheet transport position, the image writing position is corrected based on the determined correction amount, and the recording sheets are subjected to image formation at the image forming region based on the corrected image writing position; and switching is performed to either one of the high speed correction mode and the linear correction mode according to the correction amount for a recording sheet detected at time of image formation with respect to the correction amount for the preset number of recording sheets.

2. The image forming apparatus according to claim 1, wherein the sheet transport position detecting portion includes:

a first sheet transport position detecting portion that detects the sheet transport position at a position close to the registration roller on upstream side of the registration roller in the recording sheet transport direction; and a second sheet transport position detecting portion that detects the sheet transport position on upstream side of the first sheet transport position detecting portion in the recording sheet transport direction.

3. The image forming apparatus according to claim 1, wherein switching is performed to the high speed correction mode in a case where a difference value between the correction amount for the preset number of recording sheets and the correction amount for a recording sheet detected at time of the image formation is within a preset reference range, and switching is performed to the linear correction mode in a case where the difference value is not within the reference range.

4. The image forming apparatus according to claim 3, wherein a plurality of sheet feed portions that feed a recording sheet to the sheet transport path are arranged on upstream side of the registration roller in the recording sheet transport direction, and in a case where a difference value between the correction amount for the preset number of recording sheets and the correction amount for a recording sheet detected at time of the image formation is successively not within the reference range for a prescribed number of sheets, a recording sheet is fed from another sheet feed portion for the same size, and the count of a number of successive sheets in which the difference value is successively not within the reference range is reset.

5. The image forming apparatus according to claim 4, further comprising a notifier that gives notice to effect that it is necessary to check a sheet feed portion that was feeding a recording sheet before the other sheet feed portion feeds a recording sheet in a case where a recording sheet is fed from the other sheet feed portion.

6. The image forming apparatus according to claim 1, wherein an average value obtained by measuring the correction amount of the image writing position for the preset number of recording sheets in the high speed correction mode and averaging the correction amounts of the number of recording sheets is used as the correction amount of the image writing position.

7. The image forming apparatus according to claim 6, wherein, in a case where a difference value between the correction amount for the preset number of recording sheets and the correction amount for a recording sheet detected at time of the image formation is not within the preset reference range, the correction amount in which the difference value is not within the reference range is excluded from data for the average value.

8. The image forming apparatus according to claim 1, wherein it is possible to select one of :

a mode switching operation that performs switching to either one of the high speed correction mode and the linear correction mode according to the correction amount for the recording sheet detected at time of the image formation with respect to the correction amount for the preset number of recording sheets; and a linear correction mode prioritizing operation that performs switching to the linear correction mode regardless of a value corresponding to the correction amount for the recording sheet detected at time of the image formation with respect to the correction amount for the preset number of recording sheets.

9. An image forming apparatus, comprising:

an image bearing member on which an image is to be formed;

a registration roller that is disposed on upstream side in a recording sheet transport direction of an image forming region, which is disposed on a sheet transport path for transporting a recording sheet, that performs transport and transport stoppage of the recording sheet, and that corrects a sheet transport state;

a sheet transport position detecting portion that detects a sheet transport position of a recording sheet on the sheet transport path on upstream side of the registration roller in the transport direction; and a control portion in communication with the sheet transport position detection portion, the control portion including:

a high speed correction mode in which, at time of a successive image forming process on a plurality of recording sheets, the sheet transport position is detected by the sheet transport position detecting portion for a preset number of recording sheets among the plurality of recording sheets, a correction amount of an image writing position onto the image bearing member is determined based on the detected sheet transport position, the image writing position is corrected based on the determined correction amount, and the preset number of recording sheets are subjected to image formation at the image forming region based on the corrected image writing position, and one or more other recording sheets, on which image formation is to be performed after the preset number of recording sheets, are subjected to image formation at the image forming region based on the corrected image writing position; and a linear correction mode in which, at time of the successive image forming process, the sheet transport position is detected by the sheet transport position detecting portion for the plurality of recording sheets, a correction amount of an image writing position onto the image bearing member is determined based on the detected sheet transport position, the image writing position is corrected based on the determined correction amount, and the recording sheets are subjected to image formation at the image forming region based on the corrected image writing position, wherein switching is performed to either one of the high speed correction mode and the linear correction mode according to the correction amount for a recording sheet detected at time of image formation with respect to the correction amount for the preset number of recording sheets.

10. The image forming apparatus according to claim 9, wherein the sheet transport position detecting portion includes a first sheet transport position detecting portion that detects the sheet transport position at a position close to the registration roller on upstream side of the registration roller in the recording sheet transport direction.

11. The image forming apparatus according to claim 10, wherein the sheet transport position detecting portion includes a second sheet transport position detecting portion that detects the sheet transport position on upstream side of the first sheet transport position detecting portion in the recording sheet transport direction.

12. The image forming apparatus according to claim 9, wherein switching is performed to the high speed correction mode in a case where a difference value between the correction amount for the preset number of recording sheets and the correction amount for a recording sheet detected at time of the image formation is within a preset reference range, and switching is performed to the linear correction mode in a case where the difference value is not within the reference range.

13. The image forming apparatus according to claim 12, wherein a plurality of sheet feed portions that feed a recording sheet to the sheet transport path are arranged on upstream side of the registration roller in the recording sheet transport direction.

14. The image forming apparatus according to claim 13, wherein, in a case where a difference value between the correction amount for the preset number of recording sheets and the correction amount for a recording sheet detected at time of the image formation is successively not within the reference range for a prescribed number of sheets, a recording sheet is fed from another sheet feed portion for the same size, and the count of a number of successive sheets in which the difference value is successively not within the reference range is reset.

15. The image forming apparatus according to claim 14, further comprising a notifier that gives notice to effect that it is necessary to check a sheet feed portion that was feeding a recording sheet before the other sheet feed portion feeds a recording sheet in a case where a recording sheet is fed from the other sheet feed portion.

16. The image forming apparatus according to claim 9, wherein an average value obtained by measuring the correction amount of the image writing position for the preset number of recording sheets in the high speed correction mode and averaging the correction amounts of the number of recording sheets is used as the correction amount of the image writing position.

17. The image forming apparatus according to claim 16, wherein, in a case where a difference value between the correction amount for the preset number of recording sheets and the correction amount for a recording sheet detected at time of the image formation is not within the preset reference range, the correction amount in which the difference value is not within the reference range is excluded from data for the average value.

18. The image forming apparatus according to claim 9, wherein the control portion includes a mode switching operation that performs switching to either one of the high speed correction mode and the linear correction mode according to the correction amount for the recording sheet detected at time of the image formation with respect to the correction amount for the preset number of recording sheets.

19. The image forming apparatus according to claim 9, wherein the control portion includes a linear correction mode prioritizing operation that performs switching to the linear correction mode regardless of a value corresponding to the correction amount for the recording sheet detected at time of the image formation with respect to the correction amount for the preset number of recording sheets.

* * * * *